US012172051B2

(12) United States Patent
Yim et al.

(10) Patent No.: US 12,172,051 B2
(45) **Date of Patent: *Dec. 24, 2024**

(54) EXERCISE MACHINE

(71) Applicant: JOHNSON HEALTH TECH RETAIL, INC., Cottage Grove, WI (US)

(72) Inventors: Rasmey Yim, Vancouver, WA (US); Marcus L. Marjama, Vancouver, WA (US); Kevin M. Hendricks, Portland, OR (US); Thomas H. Moran, Portland, OR (US)

(73) Assignee: JOHNSON HEALTH TECH RETAIL, INC., Cottage Grove, WI (US)

( * ) Notice: Subject to any disclaimer, the term of this patent is extended or adjusted under 35 U.S.C. 154(b) by 74 days.

This patent is subject to a terminal disclaimer.

(21) Appl. No.: 17/736,469

(22) Filed: May 4, 2022

(65) Prior Publication Data

US 2022/0401793 A1 Dec. 22, 2022

Related U.S. Application Data

(63) Continuation of application No. 16/751,989, filed on Jan. 24, 2020, now Pat. No. 11,324,994, which is a (Continued)

(51) Int. Cl.
*A63B 22/06* (2006.01)
*A63B 21/008* (2006.01)

(Continued)

(52) U.S. Cl.
CPC ..... *A63B 22/0664* (2013.01); *A63B 21/0088* (2013.01); *A63B 22/001* (2013.01);

(Continued)

(58) Field of Classification Search
CPC .... A63B 22/001; A63B 22/0015–0017; A63B 22/0056;

(Continued)

(56) References Cited

U.S. PATENT DOCUMENTS 219,439 A 9/1879 Blend
3,134,378 A 5/1964 Harwood (Continued)

FOREIGN PATENT DOCUMENTS

CA 3013141 A1 9/2014
CN 1512903 A 7/2004

(Continued)

OTHER PUBLICATIONS

"Examination Report for EP18731642.7, mailed Nov. 2, 2022".

(Continued)

*Primary Examiner* — Joshua T Kennedy
(74) *Attorney, Agent, or Firm* — Dorsey & Whitney LLP

(57) ABSTRACT

Described herein are embodiments of stationary exercise machines having reciprocating foot and/or hand members, such as foot pedals that move in a closed loop path. Some embodiments can include reciprocating foot pedals that cause a user's feet to move along a closed loop path that is substantially inclined, such that the foot motion simulates a climbing motion more than a flat walking or running motion. Some embodiments can further include reciprocating handles that are configured to move in coordination with the foot via a linkage to a crank wheel also coupled to the foot pedals. Variable resistance can be provided via a rotating air-resistance based mechanism, via a magnetism based mechanism, and/or via other mechanisms, one or more of which can be rapidly adjustable while the user is using the machine.

20 Claims, 37 Drawing Sheets

Related U.S. Application Data continuation of application No. 15/960,174, filed on Apr. 23, 2018, now Pat. No. 10,543,396, which is a continuation of application No. 14/859,015, filed on Sep. 18, 2015, now Pat. No. 9,950,209, which is a continuation-in-part of application No. 14/218,808, filed on Mar. 18, 2014, now Pat. No. 9,199,115, which is a continuation of application No. PCT/US2014/030875, filed on Mar. 17, 2014.

(60) Provisional application No. 61/798,663, filed on Mar. 15, 2013.

(51) Int. Cl.

| | |
|---|---|
| ***A63B 22/00*** | (2006.01) |
| ***A63B 22/20*** | (2006.01) |
| ***A63B 24/00*** | (2006.01) |
| *A63B 21/00* | (2006.01) |
| *A63B 21/005* | (2006.01) |
| *A63B 21/012* | (2006.01) |
| *A63B 21/22* | (2006.01) |
| *A63B 22/04* | (2006.01) |

(52) U.S. Cl.

CPC ..... *A63B 22/0015* (2013.01); *A63B 22/0017* (2015.10); *A63B 22/205* (2013.01); *A63B 24/0087* (2013.01); *A63B 21/00076* (2013.01); *A63B 21/0051* (2013.01); *A63B 21/012* (2013.01); *A63B 21/154* (2013.01); *A63B 21/225* (2013.01); *A63B 22/0056* (2013.01); *A63B 22/04* (2013.01); *A63B 2022/0676* (2013.01); *A63B 22/20* (2013.01)

(58) Field of Classification Search

CPC .. A63B 22/0664–2022/0688; A63B 21/00192; A63B 21/005; A63B 21/0051–0052; A63B 21/0088

See application file for complete search history.

(56) References Cited

U.S. PATENT DOCUMENTS

| | | | | |
|---|---|---|---|---|
| 3,213,852 | A | 10/1965 | Zent | |
| 3,964,742 | A | 6/1976 | Carnielli | |
| 4,880,225 | A | 11/1989 | Lucas et al. | |
| 5,048,824 | A | 9/1991 | Chen | |
| 5,051,638 | A | 9/1991 | Pyles | |
| 5,094,447 | A * | 3/1992 | Wang | A63B 22/0605 482/903 |
| 5,242,343 | A | 9/1993 | Miller | |
| 5,290,211 | A | 3/1994 | Stearns | |
| 5,290,212 | A | 3/1994 | Metcalf | |
| 5,383,829 | A | 1/1995 | Miller | |
| 5,499,956 | A | 3/1996 | Habing et al. | |
| 5,518,473 | A | 5/1996 | Miller | |
| 5,529,555 | A | 6/1996 | Rodgers, Jr. | |
| 5,540,637 | A | 7/1996 | Rodgers, Jr. | |
| 5,549,526 | A | 8/1996 | Rodgers, Jr. | |
| 5,562,574 | A | 10/1996 | Miller | |
| 5,573,480 | A | 11/1996 | Rodgers, Jr. | |
| 5,577,985 | A | 11/1996 | Miller | |
| 5,593,371 | A | 1/1997 | Rodgers, Jr. | |
| 5,593,372 | A | 1/1997 | Rodgers, Jr. | |
| 5,595,553 | A | 1/1997 | Rodgers, Jr. | |
| 5,611,758 | A | 3/1997 | Rodgers, Jr. | |
| 5,653,662 | A | 8/1997 | Rodgers, Jr. | |
| 5,683,330 | A | 11/1997 | Kobayashi | |
| 5,685,804 | A | 11/1997 | Whan-Tong et al. | |
| 5,690,589 | A | 11/1997 | Rodgers, Jr. | |
| 5,707,321 | A | 1/1998 | Maresh | |
| 5,738,614 | A | 4/1998 | Rodgers, Jr. | |
| 5,743,834 | A | 4/1998 | Rodgers, Jr. | |
| 5,795,270 | A | 8/1998 | Woods et al. | |
| 5,836,855 | A | 11/1998 | Eschenbach | |
| 5,997,445 | A * | 12/1999 | Maresh | A63B 22/0664 482/70 |
| 6,019,710 | A | 2/2000 | Dalebout et al. | |
| 6,024,676 | A | 2/2000 | Eschenbach | |
| 6,206,806 | B1 | 3/2001 | Chu | |
| 6,422,977 | B1 | 7/2002 | Eschenbach | |
| D512,112 | S | 11/2005 | Nagano | |
| 7,086,993 | B1 | 8/2006 | Maresh | |
| 7,201,705 | B2 | 4/2007 | Rodgers, Jr. | |
| 7,238,146 | B1 | 7/2007 | Chen | |
| D559,925 | S | 1/2008 | Horita | |
| D565,129 | S | 3/2008 | Chang et al. | |
| D567,310 | S | 4/2008 | Chen et al. | |
| D567,314 | S | 4/2008 | Horita | |
| 7,377,879 | B1 | 5/2008 | Chen | |
| D575,363 | S | 8/2008 | Horita | |
| 7,448,986 | B1 | 11/2008 | Porth | |
| 7,455,624 | B2 | 11/2008 | Liao Lai | |
| 7,462,134 | B2 | 12/2008 | Lull et al. | |
| 7,494,447 | B2 | 2/2009 | Eschenbach | |
| 7,556,591 | B2 | 7/2009 | Chuang et al. | |
| 7,591,761 | B1 | 9/2009 | Ellis | |
| 7,611,446 | B2 | 11/2009 | Chuang et al. | |
| 7,618,350 | B2 | 11/2009 | Dalebout et al. | |
| D606,599 | S | 12/2009 | Murray et al. | |
| 7,666,122 | B2 | 2/2010 | Chiles et al. | |
| 7,674,205 | B2 | 3/2010 | Dalebout et al. | |
| 7,736,278 | B2 | 6/2010 | Lull et al. | |
| 7,785,235 | B2 | 8/2010 | Lull et al. | |
| 7,789,808 | B2 | 9/2010 | Lee et al. | |
| 7,811,206 | B2 | 10/2010 | Chuang et al. | |
| 7,901,330 | B2 | 3/2011 | Dalebout et al. | |
| D703,278 | S | 4/2014 | Horita | |
| 8,734,298 | B2 | 5/2014 | Murray | |
| 8,926,478 | B2 | 1/2015 | Huang et al. | |
| 8,979,713 | B2 | 3/2015 | Huang et al. | |
| 9,056,217 | B2 | 6/2015 | Kao et al. | |
| 9,061,174 | B2 | 6/2015 | Jun | |
| 9,192,809 | B1 | 11/2015 | Miller et al. | |
| 9,199,115 | B2 | 12/2015 | Yim et al. | |
| 9,254,414 | B2 | 2/2016 | Liu et al. | |
| 9,468,797 | B1 | 10/2016 | Miller | |
| 9,522,300 | B1 | 12/2016 | Miller | |
| 9,586,087 | B1 | 3/2017 | Lin | |
| D792,530 | S | 7/2017 | Hendricks | |
| 9,950,209 | B2 | 4/2018 | Yim et al. | |
| 9,974,998 | B2 | 5/2018 | Miller | |
| 9,987,513 | B2 | 6/2018 | Yim et al. | |
| 10,252,101 | B2 | 4/2019 | Yim et al. | |
| 10,328,301 | B2 | 6/2019 | Anderson et al. | |
| 10,543,396 | B2 | 1/2020 | Yim et al. | |
| 10,561,891 | B2 | 2/2020 | Luger et al. | |
| 11,198,033 | B2 | 12/2021 | Yim et al. | |
| 11,324,994 | B2 * | 5/2022 | Yim | A63B 22/205 |
| 2003/0096677 | A1 | 5/2003 | Chu | |
| 2005/0018191 | A1 | 8/2005 | Porth | |
| 2005/0181912 | A1 | 8/2005 | Eschenbach | |
| 2006/0079381 | A1 | 4/2006 | Cornejo et al. | |
| 2006/0166791 | A1 | 7/2006 | Liao et al. | |
| 2006/0172865 | A1 | 8/2006 | Dey et al. | |
| 2006/0029315 | A1 | 12/2006 | Porth et al. | |
| 2006/0281604 | A1 * | 12/2006 | Stewart | A63B 22/0023 482/52 |
| 2006/0293153 | A1 | 12/2006 | Porth et al. | |
| 2007/0087906 | A1 | 4/2007 | Rodgers | |
| 2007/0117683 | A1 | 5/2007 | Ercanbrack et al. | |
| 2007/0129219 | A1 | 6/2007 | Mahleberg | |
| 2007/0232457 | A1 | 10/2007 | Porth | |
| 2007/0254778 | A1 | 11/2007 | Ashby | |
| 2008/0161163 | A1 | 7/2008 | Stewart et al. | |
| 2008/0207400 | A1 | 8/2008 | Liao Lai | |
| 2008/0220947 | A1 | 9/2008 | Meng | |
| 2008/0261777 | A1 | 10/2008 | Chuang et al. | |
| 2008/0280731 | A1 | 11/2008 | Dalebout et al. | |
| 2009/0011904 | A1 | 1/2009 | Chuang et al. | |
| 2009/0048077 | A1 | 2/2009 | Chuang et al. | |

(56) References Cited

U.S. PATENT DOCUMENTS

| | | | | |
|---|---|---|---|---|
| 2009/0093346 | A1* | 4/2009 | Nelson | A63B 22/001 482/52 |
| 2009/0124463 | A1 | 5/2009 | Chen | |
| 2009/0203501 | A1 | 8/2009 | Rodgers, Jr. | |
| 2009/0312156 | A1 | 12/2009 | Chen et al. | |
| 2010/0016787 | A1 | 7/2010 | Grind | |
| 2010/0190613 | A1 | 7/2010 | Murray et al. | |
| 2010/0234185 | A1 | 9/2010 | Watt et al. | |
| 2011/0237403 | A1 | 9/2011 | Huber et al. | |
| 2012/0088635 | A1 | 4/2012 | Lee et al. | |
| 2013/0012363 | A1 | 1/2013 | Eschenbach | |
| 2013/0085042 | A1 | 4/2013 | Huang | |
| 2013/0199317 | A1 | 8/2013 | Law et al. | |
| 2013/0237379 | A1 | 9/2013 | Huang et al. | |
| 2014/0194253 | A1 | 7/2014 | Huang et al. | |
| 2014/0248998 | A1 | 9/2014 | Lu et al. | |
| 2014/0274575 | A1 | 9/2014 | Yim et al. | |
| 2015/0238809 | A1 | 8/2015 | Huang et al. | |
| 2016/0008658 | A1 | 1/2016 | Yim et al. | |
| 2016/0082308 | A1 | 3/2016 | Yim et al. | |
| 2016/0175642 | A1 | 6/2016 | Merli | |
| 2017/0056709 | A1 | 3/2017 | Ercanbrack et al. | |
| 2017/0056717 | A1 | 3/2017 | Ercanbrack et al. | |
| 2018/0250550 | A1 | 9/2018 | Yim et al. | |
| 2018/0304117 | A1 | 10/2018 | Yim et al. | |
| 2018/0339189 | A1 | 11/2018 | Luger et al. | |
| 2019/0232104 | A1 | 8/2019 | Yim et al. | |
| 2020/0155894 | A1 | 5/2020 | Yim et al. | |

FOREIGN PATENT DOCUMENTS

| | | | |
|---|---|---|---|
| CN | 1933877 | A | 3/2007 |
| CN | 101417170 | A | 4/2009 |
| CN | 101444661 | A | 6/2009 |
| CN | 203886109 | U | 10/2014 |
| CN | 204261262 | U | 4/2015 |
| CN | 105080050 | A | 11/2015 |
| CN | 105579103 | A | 5/2016 |
| CN | 205796379 | U | 12/2016 |
| CN | 106422176 | A | 2/2017 |
| EP | 0323056 | A2 | 7/1989 |
| EP | 0323056 | B1 | 3/1993 |
| EP | 2383020 | A1 | 11/2011 |
| EP | 2382020 | B1 | 4/2013 |
| HK | 1221430 | A1 | 2/2019 |
| WO | 2009026604 | A2 | 3/2009 |
| WO | 2014145981 | A1 | 9/2014 |
| WO | 2018217776 | | 11/2018 |

OTHER PUBLICATIONS

Bowflex , "Bowflex Max Trainer M7", Youtube, https://www.youtube.com/watch?v=VaeRjre0RIM [Retrieved form the internet on Nov. 4, 2016], Feb. 5, 2016, 4 Pages.

English translation of Office Action for CN Application No. 201880046523.6, dated Dec. 25, 2020.

Office Action for CA Application No. 3,013,141, dated Oct. 6, 2020.

Office Action received in CA App. No. 3,013,141 dated Jan. 31, 2020.

Taiwan Office Action received in TW App. No. 107117768 dated Jul. 7, 2021.

"European Extended Search Report dated May 22, 2018 for Application No. 17194219.6, 13 pages".

"PCT Internation Search Report and Written Opinion, PCT Application No. PCT/US2018/033925 dated Aug. 9, 2018, 12 pages".

"PCT International Search Report", PCT International Search Report dated Aug. 20, 2014 for International Application No. PCT/US2014/030845, 2 pages.

"PCT International Search Report and Written Opinion", PCT International Search Report and Written Opinion dated Nov. 18, 2014 for International Application No. PCT/US2014/031119, 18 pages.

"PCT International Search Report and Written Opinion", PCT International Search Report and Written Opinion dated Oct. 14, 2014, Applicantion No. PCT/US2014/030875, 13 pages.

"PCT Written Opinion", PCT Written Opinion dated Aug. 20, 2014 for International Application No. PCT/US2014/030845, 7 pages.

* cited by examiner

EXERCISE MACHINE

CROSS-REFERENCE TO RELATED APPLICATIONS

This application is a continuation of U.S. patent application Ser. No. 16/751,989, filed Jan. 24, 2020, and entitled "Exercise Machine," which is a continuation of U.S. patent application Ser. No. 15/960,174, filed Apr. 23, 2018, now issued as U.S. Pat. No. 10,543,396, and entitled "Exercise Machine," which is a continuation of U.S. patent application Ser. No. 14/859,015, filed Sep. 18, 2015, now issued as U.S. Pat. No. 9,950,209, and entitled "Exercise Machine," which is a continuation-in-part of U.S. patent application Ser. No. 14/218,808, filed Mar. 18, 2014, now issued as U.S. Pat. No. 9,199,115, and entitled "Exercise Machine," which is a continuation of PCT International Patent Application No. PCT/US2014/030875, filed on Mar. 17, 2014, entitled "Exercise Machine," which claims, under 35 U.S.C. § 119(e), the benefit of U.S. Provisional Patent Application No. 61/798,663, filed on Mar. 15, 2013, entitled "Exercise Machine." All of these applications are hereby incorporated by reference in their entireties.

TECHNICAL FIELD

This application concerns stationary exercise machines having reciprocating members.

BACKGROUND

Traditional stationary exercise machines include stair climber-type machines and elliptical running-type machines. Each of these types of machines typically offers a different type of workout, with stair climber-type machines providing for a lower frequency vertical climbing simulation, and with elliptical machines providing for a higher frequency horizontal running simulation. Additionally, if these machines have handles that provide upper body exercise, the connection between the handles, the foot pedals/pads, and/or the flywheel mechanism provide an insufficient exercise experience for the upper body.

It is therefore desirable to provide an improved stationary exercise machine and, more specifically, an improved exercise machine that may address or improve upon the above-described stationary exercise machines and/or which more generally offers improvements or an alternative to existing arrangements.

SUMMARY

Described herein are embodiments of stationary exercise machines having reciprocating foot and/or hand members, such as foot pedals that move in a closed loop path. Some embodiments can include reciprocating foot pedals that cause a user's feet to move along a closed-loop path that is substantially inclined, such that the foot motion simulates a climbing motion more than a flat walking or running motion. Some embodiments can further include reciprocating handles that are configured to move in coordination with the foot via a linkage to a crank wheel also coupled to the foot pedals. Variable resistance can be provided via a rotating air-resistance based mechanism, via a magnetism based mechanism, and/or via other mechanisms, one or more of which can be rapidly adjustable while the user is using the machine.

Some embodiments of a stationary exercise machine comprise first and second reciprocating foot pedals each configured to move in a respective closed loop path, with each of the closed loop paths defining a major axis extending between two points in the closed loop path that are furthest apart from each other, and wherein the major axis of the closed loop paths is inclined more than 45° relative to a horizontal plane. The machine includes at least one resistance mechanism configured to provide resistance against motion of the foot pedals along their closed loop paths, with the resistance mechanism including an adjustable portion configured to change the magnitude of the resistance provided by the resistance mechanism at a given reciprocation frequency of the foot pedals, and such that the adjustable portion is configured to be readily adjusted by a user of the machine while the user is driving the foot pedals with his feet during exercise.

In some embodiments, the adjustable portion is configured to rapidly adjust between two predetermined resistance settings, such as in less than one second. In some embodiments, the resistance mechanism is configured to provide increased resistance as a function of increased reciprocation frequency of the foot pedals.

In some embodiments, the resistance mechanism includes an air-resistance based resistance mechanism wherein rotation of the air-resistance based resistance mechanism draws air into a lateral air inlet and expels the drawn in air through radial air outlets. The air-resistance based resistance mechanism can include an adjustable air flow regulator that can be adjusted to change the volume of air flow through the air inlet or air outlet at a given rotational velocity of the air-resistance based resistance mechanism. The adjustable air flow regulator can include a rotatable plate positioned at a lateral side of the air-resistance based resistance mechanism and configured to rotate to change a cross-flow area of the air inlet, or the adjustable air flow regulator can include a axially movable plate positioned at a lateral side of the air-resistance based resistance mechanism and configured to move axially to change the volume of air entering the air inlet. The adjustable air flow regulator can be configured to be controlled by an input of a user remote from the air-resistance based resistance mechanism while the user is driving the foot pedals with his feet.

In some embodiments, the resistance mechanism includes a magnetic resistance mechanism that includes a rotatable rotor and a brake caliper, the brake caliper including magnets configured to induce an eddy current in the rotor as the rotor rotates between the magnets, which causes resistance to the rotation of the rotor. The brake caliper can be adjustable to move the magnets to different radial distances away from an axis of rotation of the rotor, such that increasing the radial distance of the magnets from the axis increases the amount of resistance the magnets apply to the rotation of the rotor. The adjustable brake caliper can be configured to be controlled by an input of a user remote from the magnetic resistance mechanism while the user is driving the foot pedals with his feet. Some embodiments of a stationary exercise machine include a stationary frame, first and second reciprocating foot pedals coupled to the frame with each foot pedal configured to move in a respective closed loop path relative to the frame, a crank wheel rotatably mounted to the frame about a crank axis with the foot pedals being coupled to the crank wheel such that reciprocation of the foot pedals about the closed loop paths drives the rotation of the crank wheel, at least one handle pivotably coupled to the frame about a first axis and configured to be driven by a user's hand, wherein the first axis is substantially parallel to and fixed relative to the crank axis. The machine further includes a first linkage fixed relative to the handle and pivotable about the first axis and having a radial end extending opposite the first axis, a second linkage having a first end pivotally coupled to the radial end of the first linkage about a second axis that is substantially parallel to the crank axis, a third linkage that is rotatably coupled to a second end of the second linkage about a third axis that is substantially parallel to the crank axis, wherein the third linkage is fixed relative to the crank wheel and rotatable about the crank axis. The machine is configured such that pivoting motion of the handle is synchronized with motion of one of the foot pedals along its closed loop path.

In some embodiments, the second end of the second linkage includes an annular collar and the third linkage includes a circular disk that is rotatably mounted within the annular collar.

In some embodiments, the third axis passes through the center of the circular disk and the crank axis passes through the circular disk at a location offset from the center of the circular disk but within the annular collar.

In some embodiments, the frame can include inclined members having non-linear portions configured to cause intermediate portions of the lower reciprocating members to move in non-linear paths, such as by causing rollers attached to the intermediate portions of the foot members to roll along the non-linear portions of the inclined members.

Some embodiments of the exercise machine may include a frame including an upper support structure; a crank shaft rotatably coupled with the upper support structure and rotatable about a crank axis; first and second connection members that each rotate about a rotation axis that substantially coincides with the crank axis; first and second crank arms respectively coupled to the first and second connection members to rotate about the rotation axis of its respective connection member; first and second reciprocating foot members operatively associated with the first and second crank arms, respectively, in such a manner that at least a portion of each of the first and second reciprocating foot members orbits the crank shaft as the crank shaft rotates; first and second foot pedals coupled to the first and second reciprocating foot members, respectively; first and second handles supported by the upper support structure to rotate about a handle axis; first and second reciprocating members rotatably coupled to the first and second handles, respectively; and third and fourth connection members operatively associated with the crank shaft and with the first and second connection members, respectively. The third and fourth connection members may each define a rotation axis that is parallel to and offset from the crank axis. The first and second reciprocating members may be rotatably coupled to the third and fourth connection members, respectively, to rotate about the rotation axis defined by its respective connection member.

In some embodiments, the exercise machine may include a first foot member pivot axis defined by the operable association between the first crank arm and the first reciprocating foot member, a second foot member pivot axis defined by the operable association between the second crank arm and the second reciprocating foot member, a first angle formed between a line defined by the crank axis and the first foot member pivot axis and a line defined by the crank axis and the rotation axis formed by the third connection member is greater than 0 degrees and less than 180 degrees, and a second angle formed between a line defined by the crank axis and the second foot member pivot axis and a line defined by the crank axis and the rotation axis formed by the fourth connection member is greater than 0 degrees and less than 180 degrees. The first and second angles may be between approximately 60 degrees and approximately 90 degrees. The first and second angles may be approximately 75 degrees.

In some embodiments, the exercise machine may include at least two spaced-apart plates extending away from the crank axis and each of the plates defining a free end portion, the third connection member positioned between the respective free end portions of each of the plates.

In some embodiments, each rotation axis of the third and fourth connection members may orbit the crank axis as the crank shaft rotates.

Embodiments of the exercise machine may include a frame including an upper support structure; a drive mechanism rotatably coupled with the upper support structure and rotatable about a crank axis; first and second crank arms each engaging the drive mechanism and rotatable about the crank axis; first and second reciprocating foot members operatively associated with first and second crank arms, defining a foot member pivot axis, respectively, wherein the first and second reciprocating foot members are coupled to first and second foot pedals, respectively; and first and second handles operatively associated with first and second reciprocating members. The first and second handles may rotate about a handle axis supported by the upper support structure. The first and second handles may be rotatably coupled to the first and second reciprocating members, respectively, defining a reciprocating axis. The first and second reciprocating members may each be rotatably coupled at a lower end to the drive mechanism and rotatable about an offset axis. Each of the respective offset axes may be parallel to and offset from the crank axis. The first and second crank arms may be fixed to the drive mechanism at respective positions spaced radially inwardly from the offset axes.

In some embodiments, each offset axis may orbit the crank axis as the drive mechanism rotates.

In some embodiments, the drive mechanism may include a central portion, opposing outer end portions, and opposing offset portions positioned between the central portion and each opposing end portion, respectively. The offset portions may extend diametrically from the crank axis. The offset portions may extend away from the crank axis an equal distance. The offset portions may extend away from the crank axis different distances. Each outer end portion may be aligned with the crank axis. Each offset portion may include a pair of spaced-apart plates extending away from the crank axis and each defining free end portions. A shaft may extend between the respective free end portions of the pair of plates. The drive mechanism may be an integral one-piece structure.

In some embodiments, the drive mechanism may include a central portion and opposing offset portions, each of the offset portions including a shaft extending parallel to the crank axis. The lower end of each reciprocating member may rotatably couple to the shaft of one offset portion. The first and second crank arms may each engage an opposing end of the drive mechanism. Each opposing end of the drive mechanism may define an outer end portion. The first and second crank arms may each engage one of the outer end portions The foregoing and other objects, features, and advantages of the invention will become more apparent from the following detailed description, which proceeds with reference to the accompanying figures.

DETAILED DESCRIPTION

Figure 1:
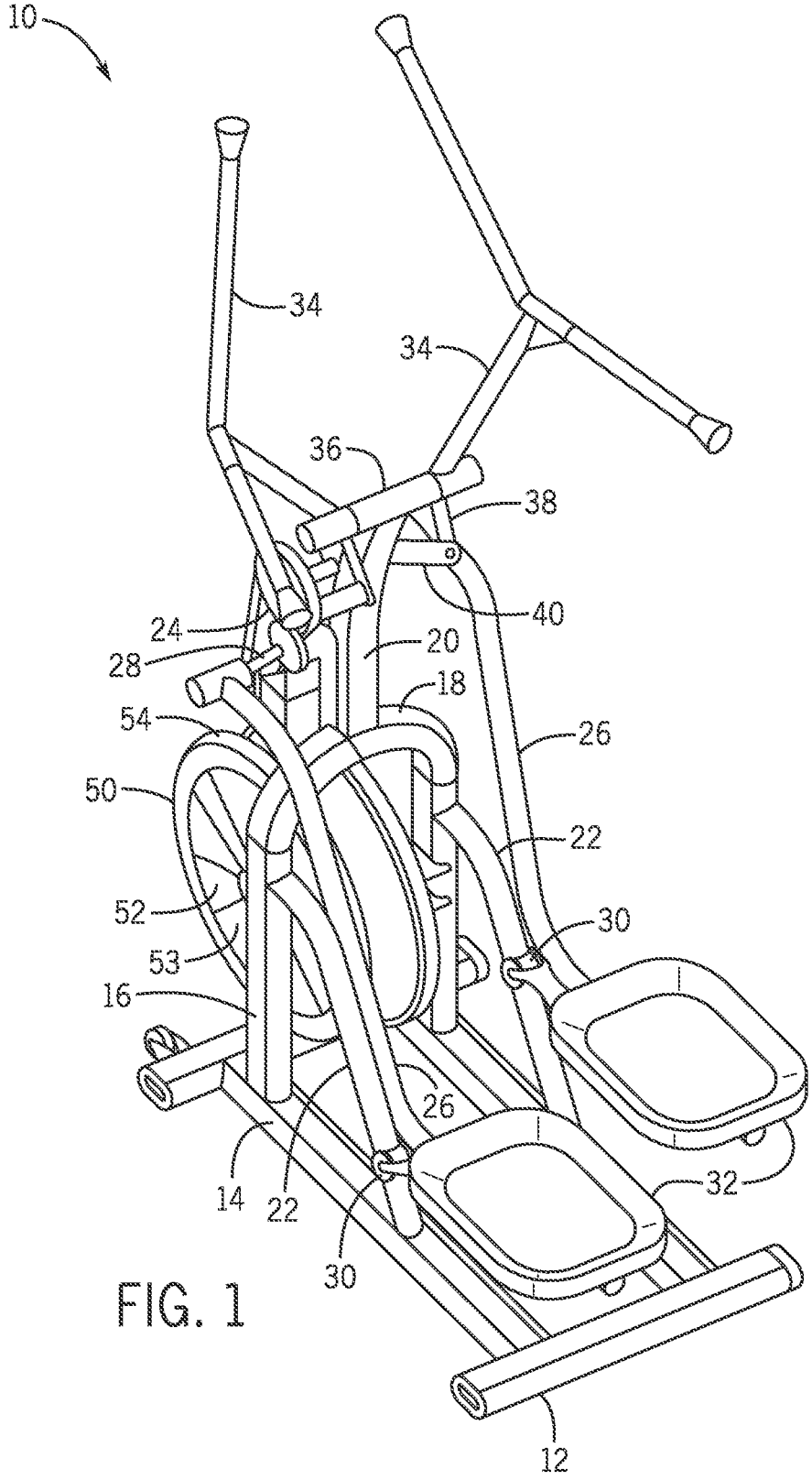
FIG. 1 is a perspective view of an exemplary exercise machine.
Figure 2B:
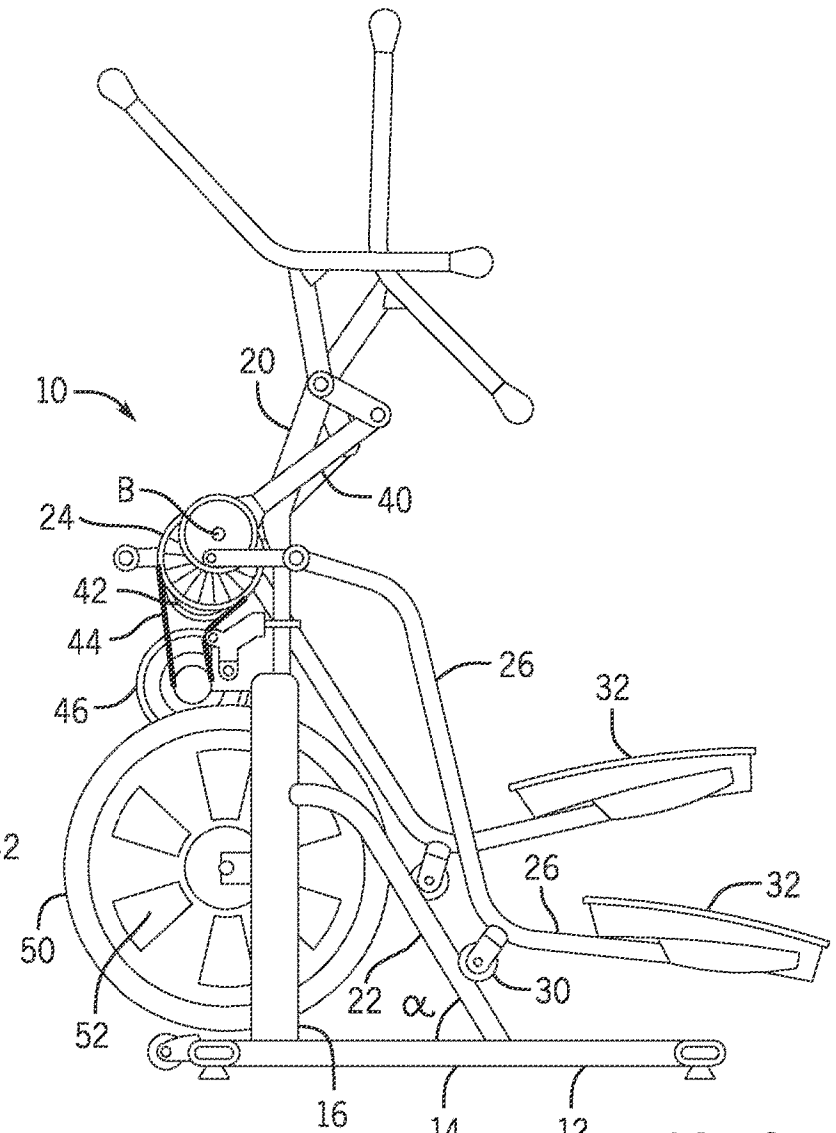
FIGS. 2A-2D are left side views of the machine of FIG. 1, showing different stages of a crank cycle.
Figure 2A:
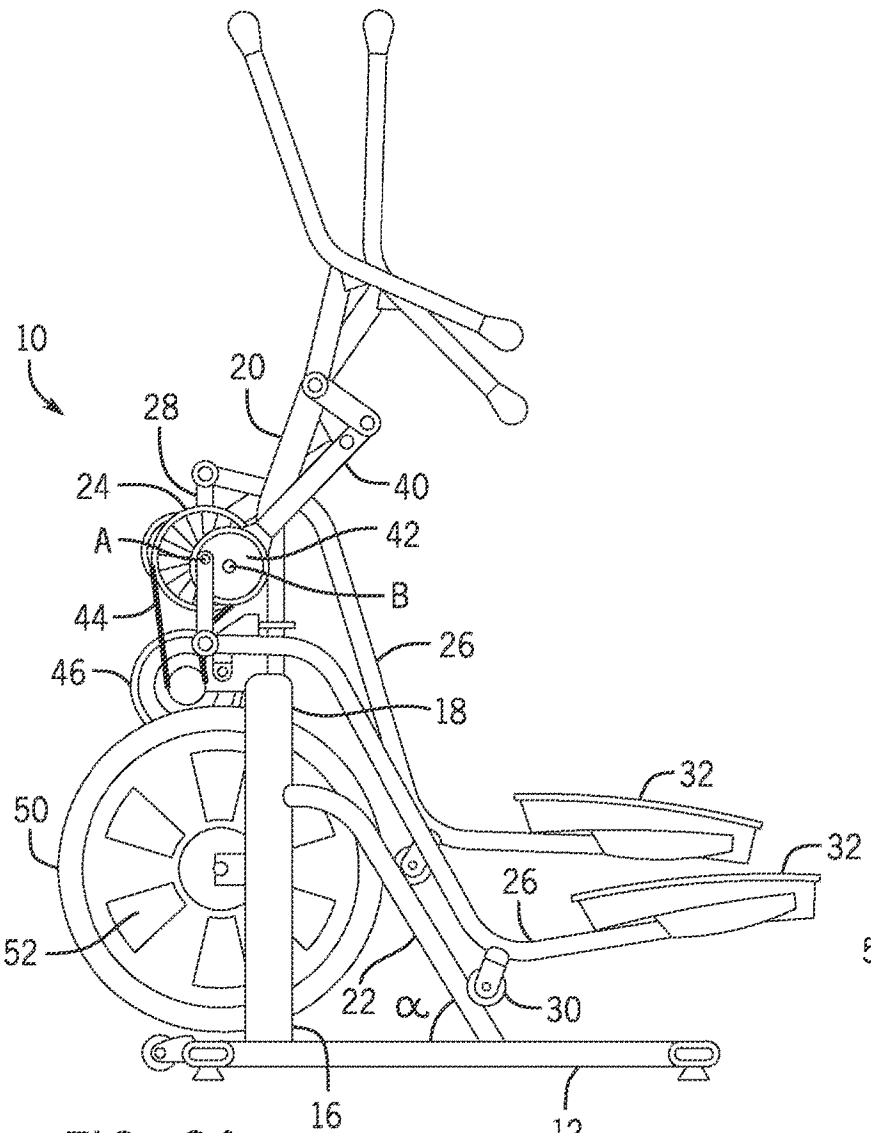
Figure 2D:
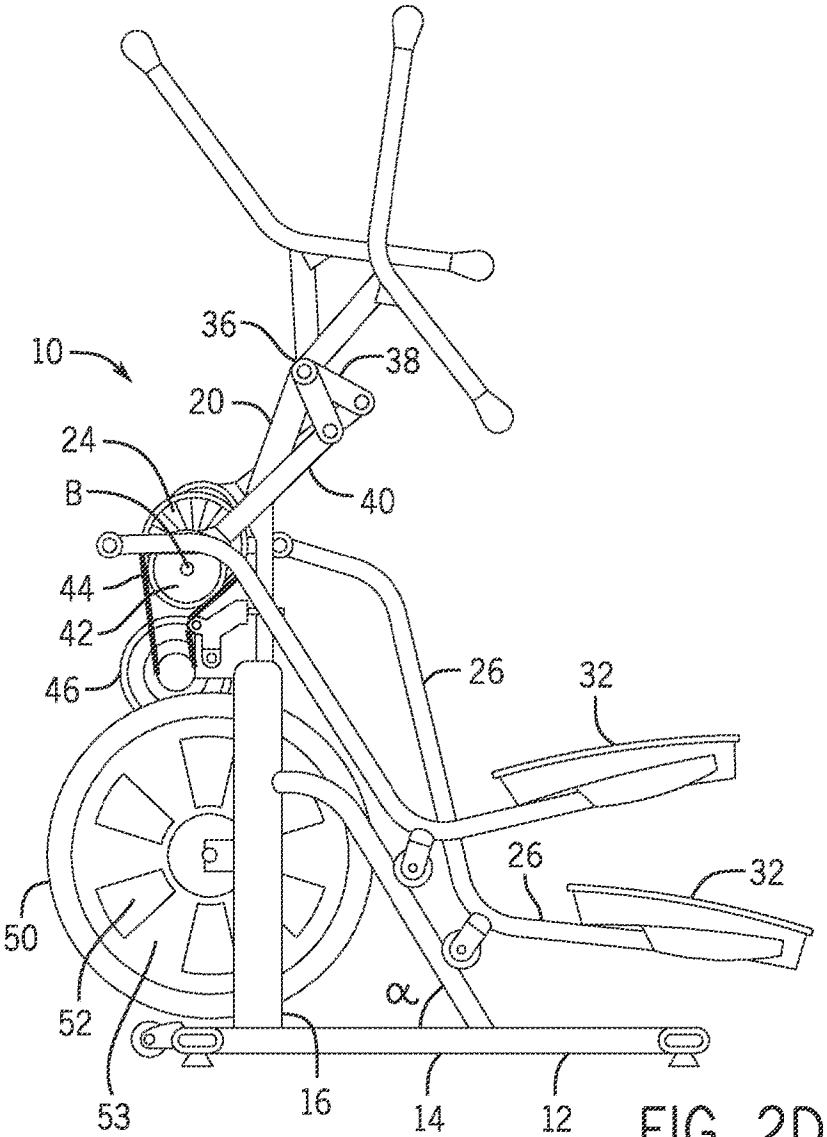
Figure 2C:
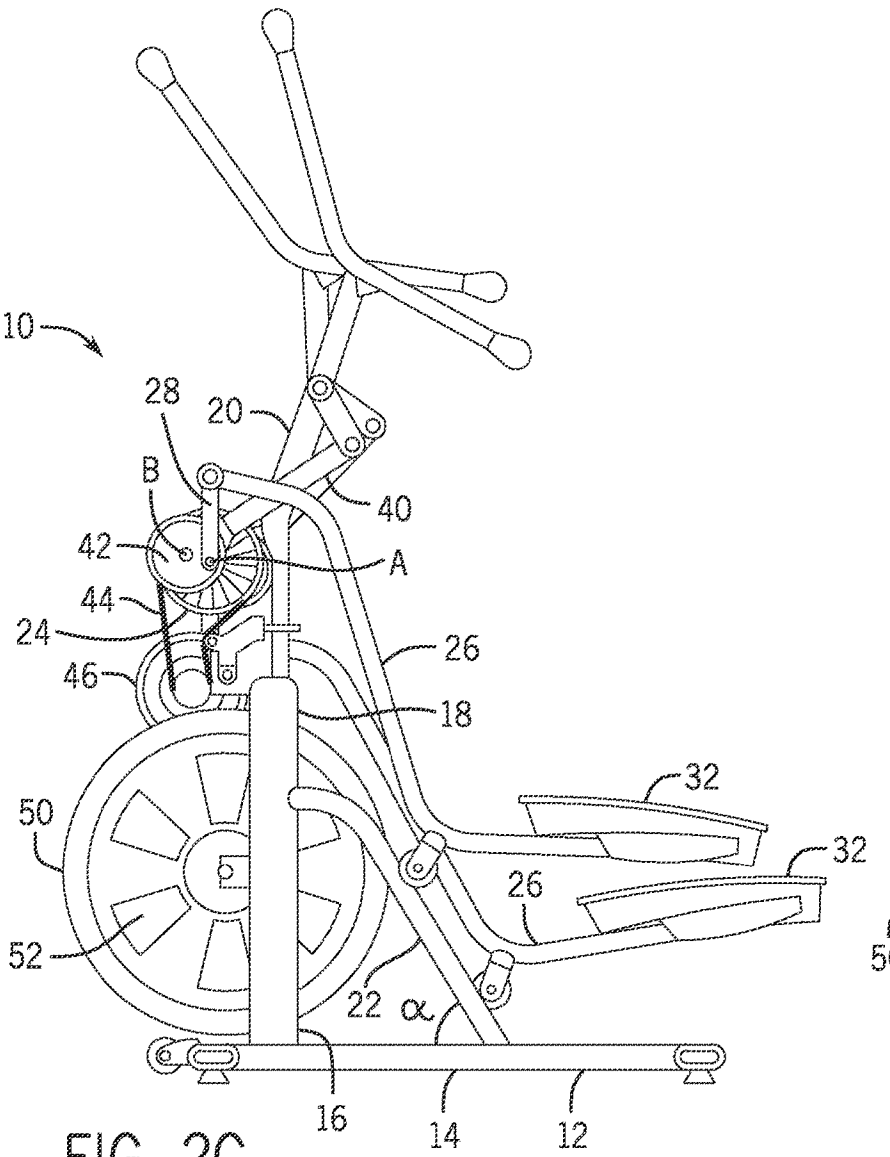
Figure 3:
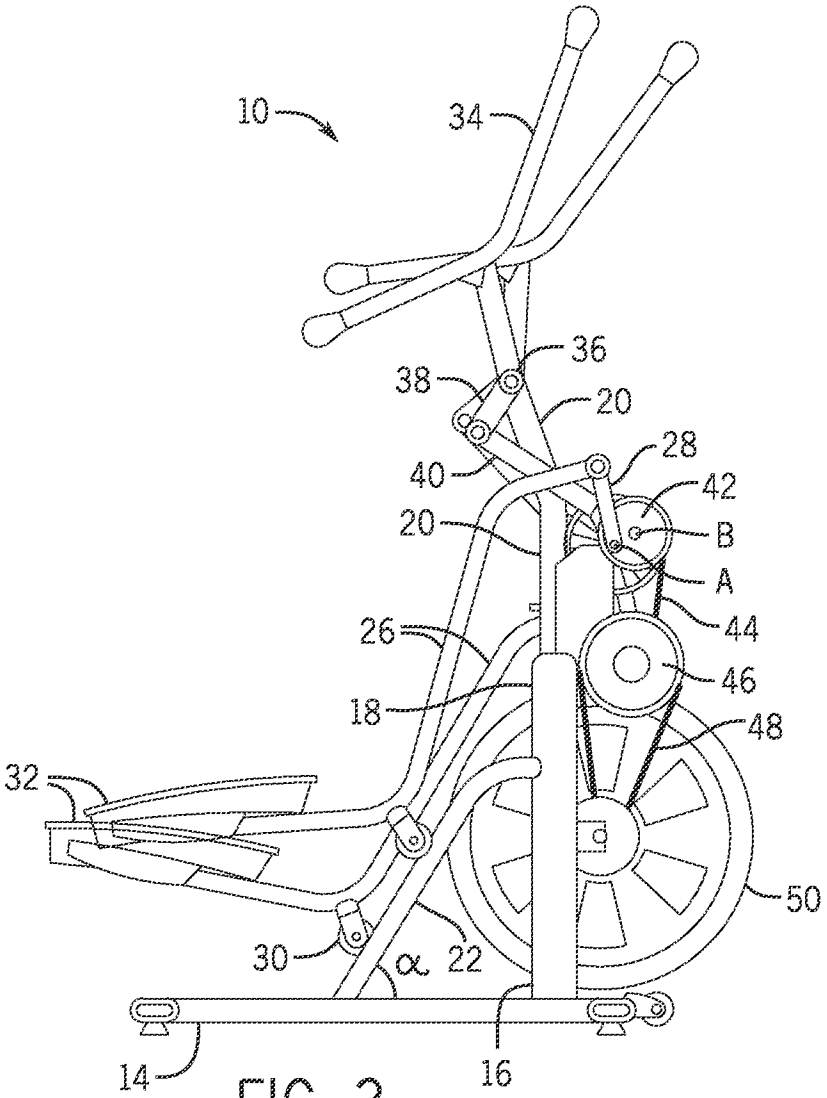
FIG. 3 is a right side view of the machine of FIG. 1.

Described herein are embodiments of stationary exercise machines having reciprocating foot and/or hand members, such as foot pedals that move in a closed loop path. The disclosed machines can provide variable resistance against the reciprocal motion of a user, such as to provide for variable-intensity interval training. Some embodiments can include reciprocating foot pedals that cause a user's feet to move along a closed loop path that is substantially inclined, such that the foot motion simulates a climbing motion more than a flat walking or running motion. Some embodiments can further include upper reciprocating members that are configured to move in coordination with the foot pedals and allow the user to exercise upper body muscles. The resistance to the hand members may be proportional to the resistance to the foot pedals. Variable resistance can be provided via a rotating air-resistance based fan-like mechanism, via a magnetism based eddy current mechanism, via friction based brakes, and/or via other mechanisms, one or more of which can be rapidly adjusted while the user is using the machine to provide variable intensity interval training.

FIGS. 1-7A show an exemplary embodiment of an exercise machine 10. The machine 10 may include a frame 12 having a base 14 for contact with a support surface, first and second vertical braces 16 coupled by an arched brace 18, an upper support structure 20 extending above the arched brace 18, and first and second inclined members 22 that extend between the base 14 and the first and second vertical braces 16, respectively.

Figure 4:
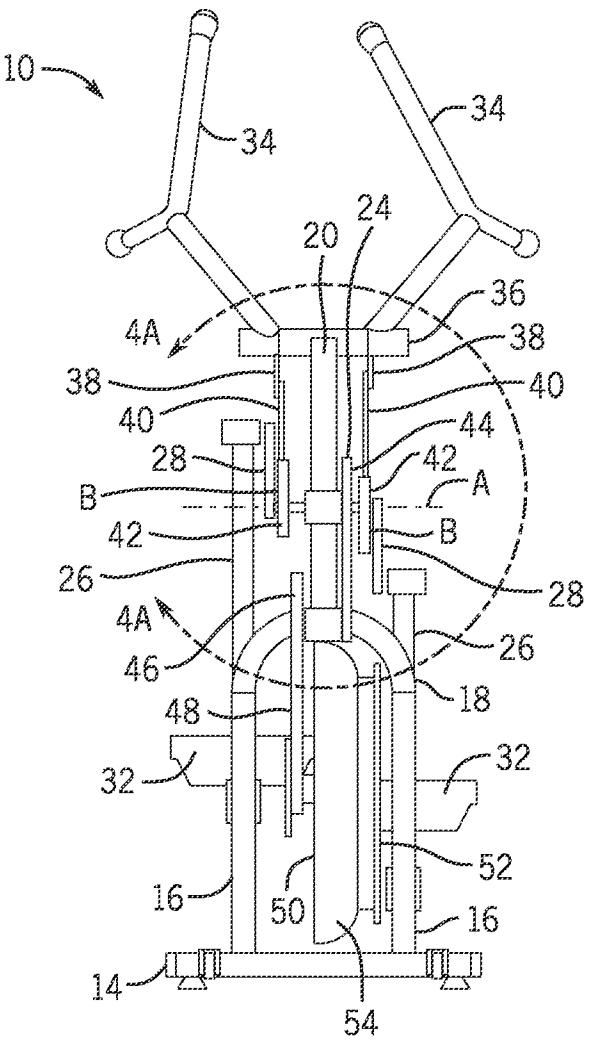
FIG. 4 is a front view of the machine of FIG. 1.
Figure 4A:
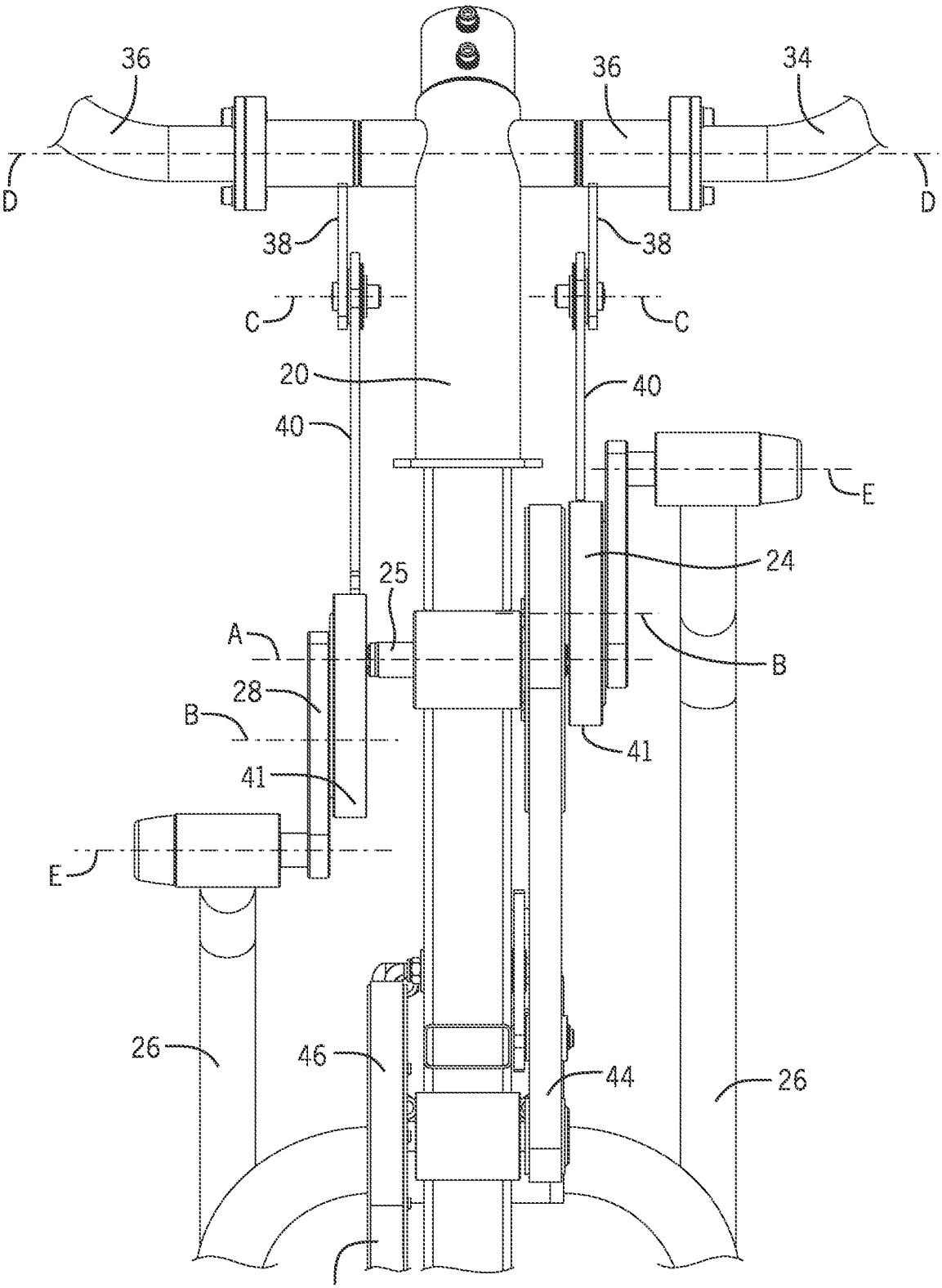
FIG. 4A is an enlarged view of a portion of FIG. 4.
Figure 6:
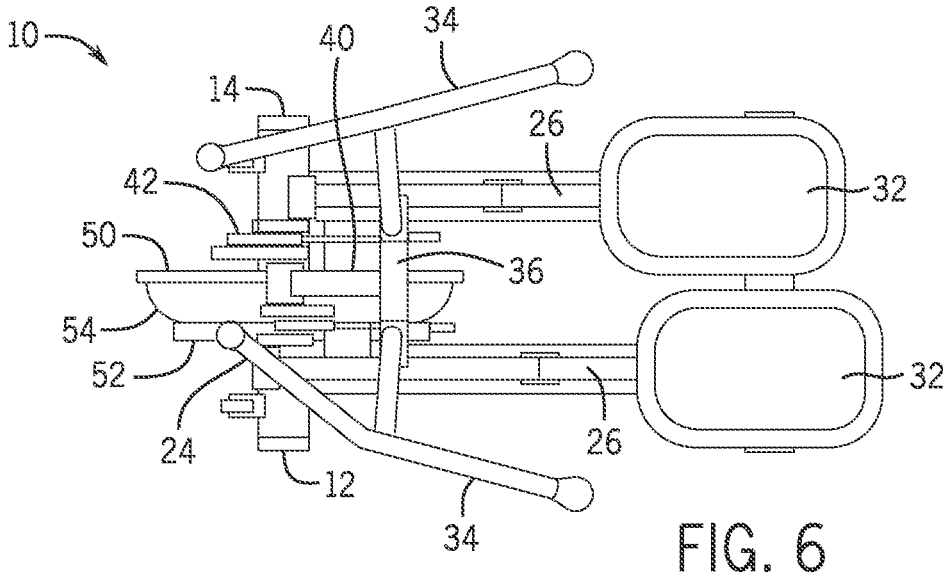
FIG. 6 is a top view of the machine of FIG. 1.

A crank wheel 24 is fixed to a crankshaft 25 (see FIGS. 4A and 5A) that is rotatably supported by the upper support structure 20 and rotatable about a fixed horizontal crank axis A. First and second crank arms 28 are fixed relative to the crank wheel 24 and crankshaft 25 and positioned on either side of the crank wheel and also rotatable about the crank axis A, such that rotation of the crank arms 28 causes the crankshaft 25 and the crank wheel 24 to rotate about the crank axis A. (Each of the left half and right half of the exercise machine 10 may have similar or identical components, and as discussed herein these similar or identical components may be utilized with the same callout number although opposing components are represented. E.g. crank arms 28 may be located on each side of the machine 10 as illustrated in FIG. 4A). The first and second crank arms 28 have respective first ends fixed to the crankshaft 25 at the crank axis A and second ends that are distal from the first end. The first crank arm 28 extends from its first end to its second end in a radial direction that is opposite the radial direction that the second crank arm extends from its first end and its second end. First and second lower reciprocating members 26 have forward ends that are pivotably coupled to the second ends of the first and second crank arms 28, respectively, and rearward ends that are coupled to first and second foot pedals 32, respectively. First and second rollers 30 are coupled to intermediate portions of the first and second lower reciprocating members 26, respectively, such that the rollers 30 can rollingly translate along the inclined members 22 of the frame 12. In alternative embodiments, other bearing mechanisms can be used to facilitate translational motion of the lower reciprocating members 26 along the inclined members 22 instead of or in addition to the rollers 30, such as sliding friction-type bearings.

Figure 17:
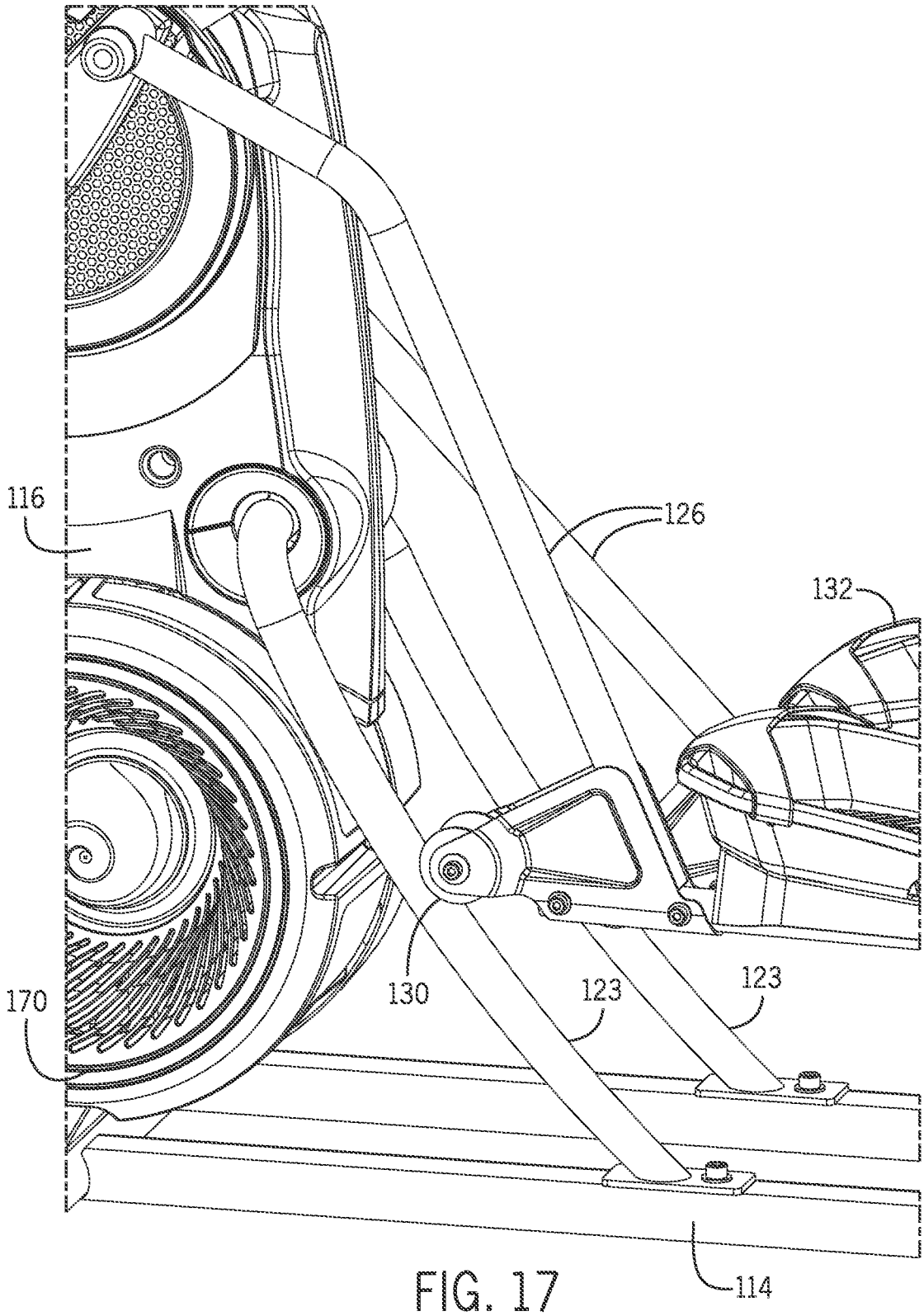
FIG. 17 is a partial side view of an exemplary exercise machine having curved inclined members taken from FIG. 14.
Figure 18A:
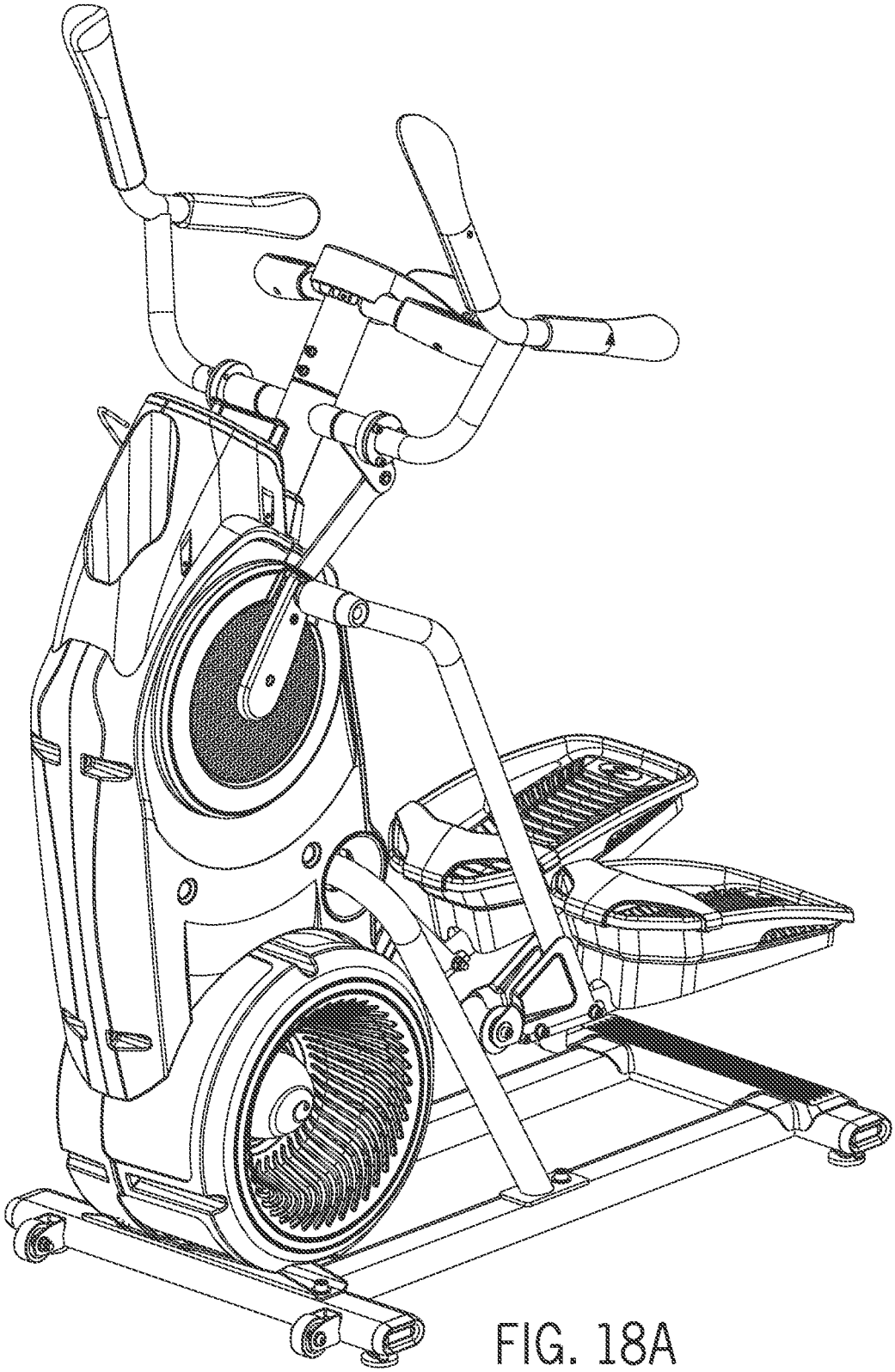
FIGS. 18A-18G are isometric, front, back, left, right, top, and bottom views of an exemplary exercise machine.
Figure 18B:
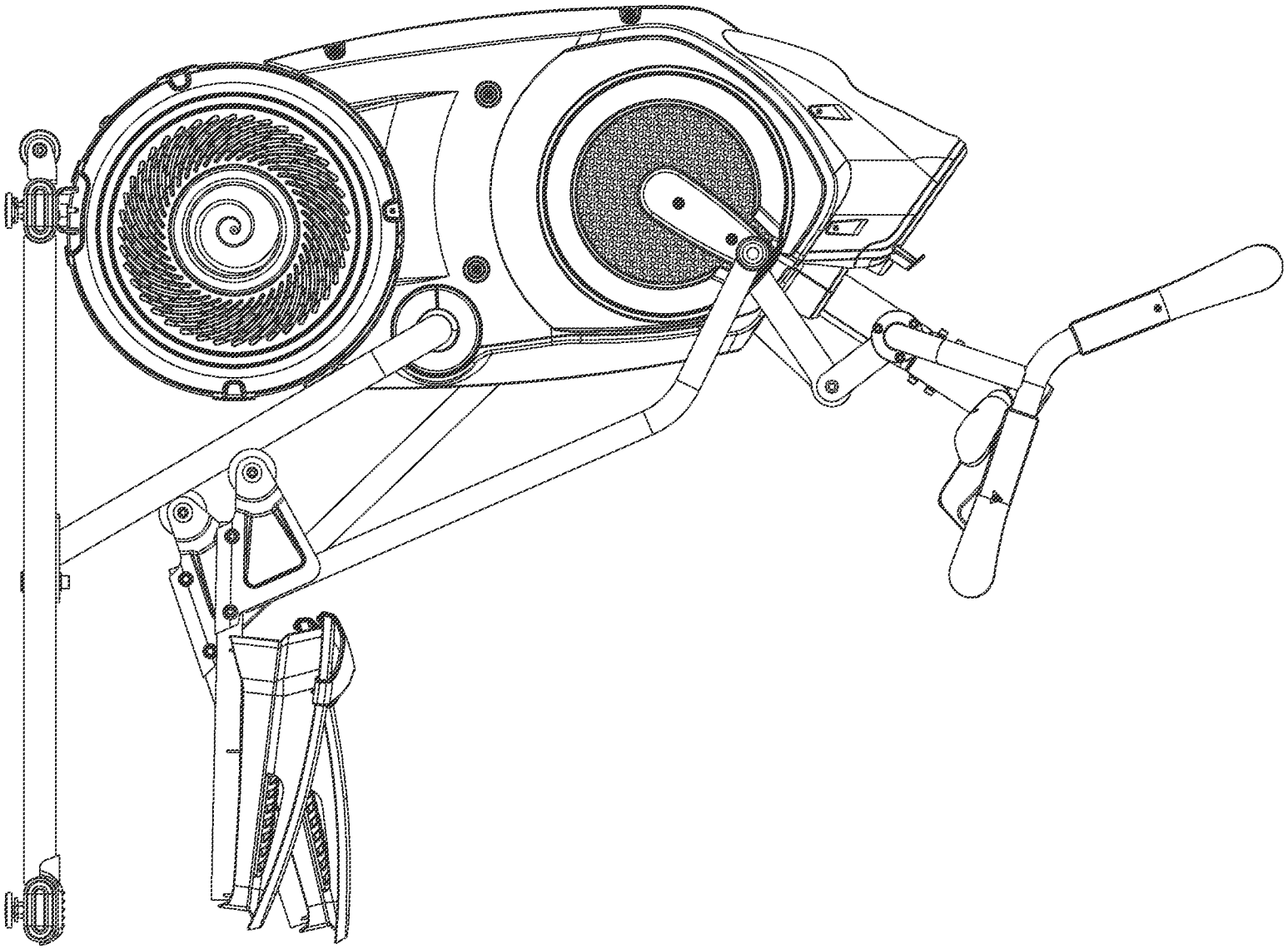
Figure 18C:
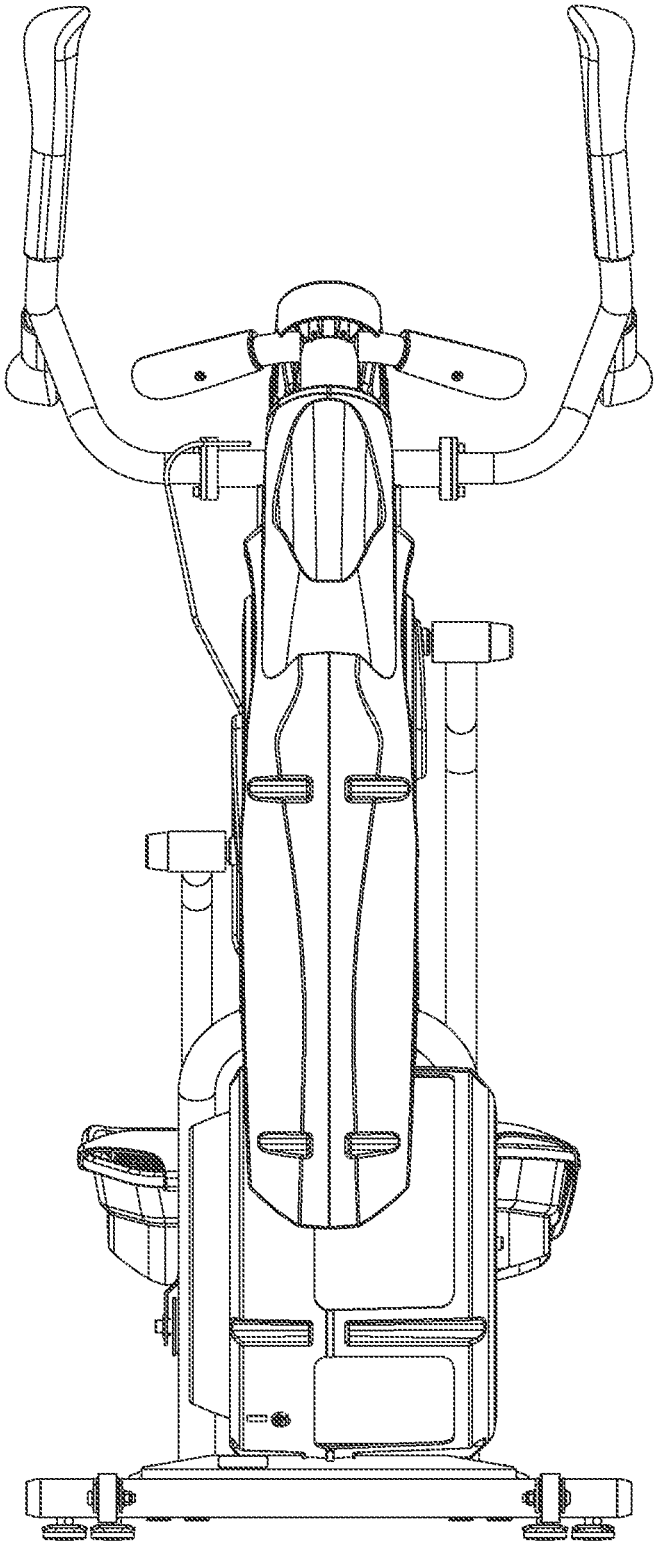
Figure 18D:
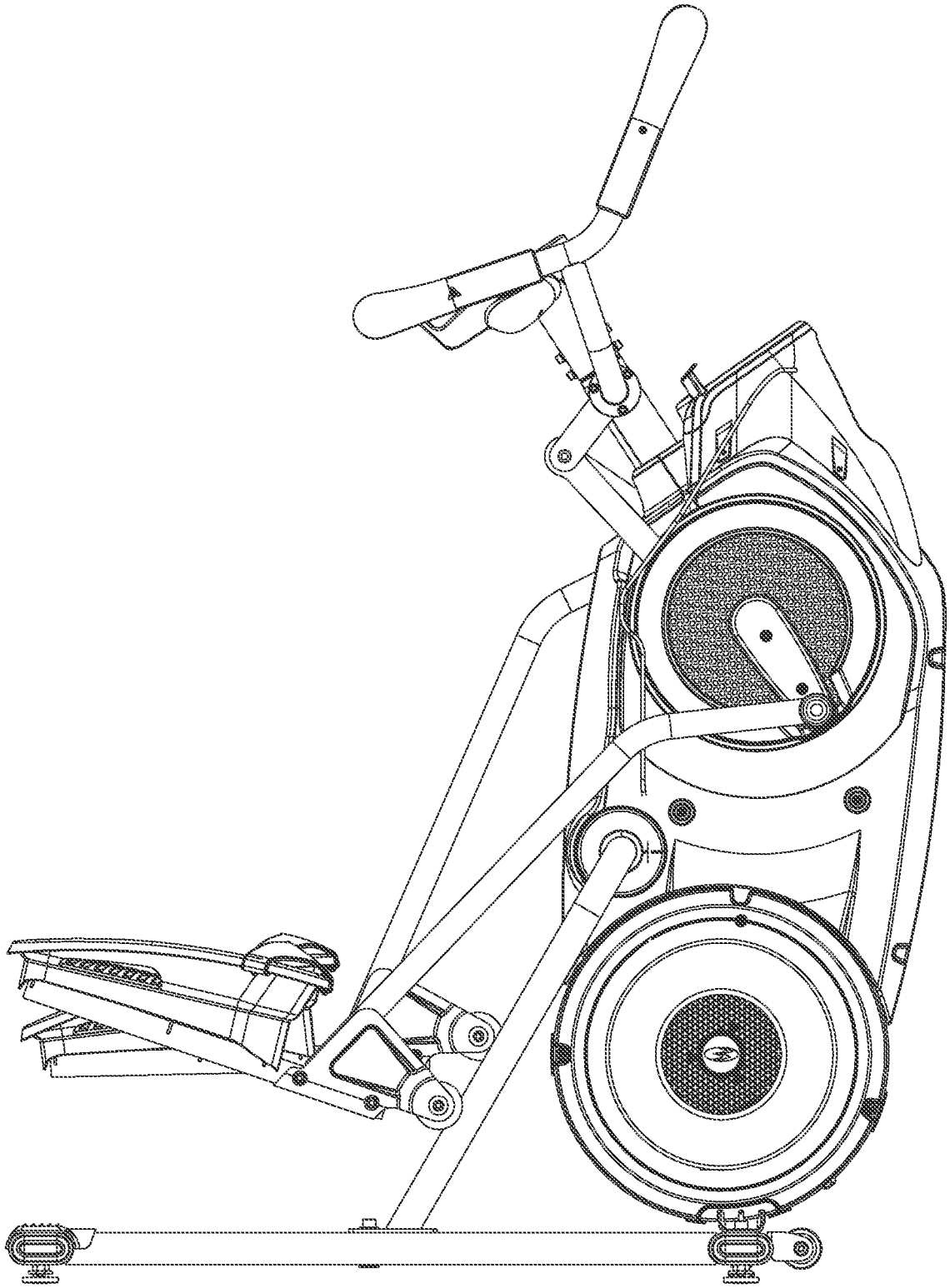
Figure 18E:
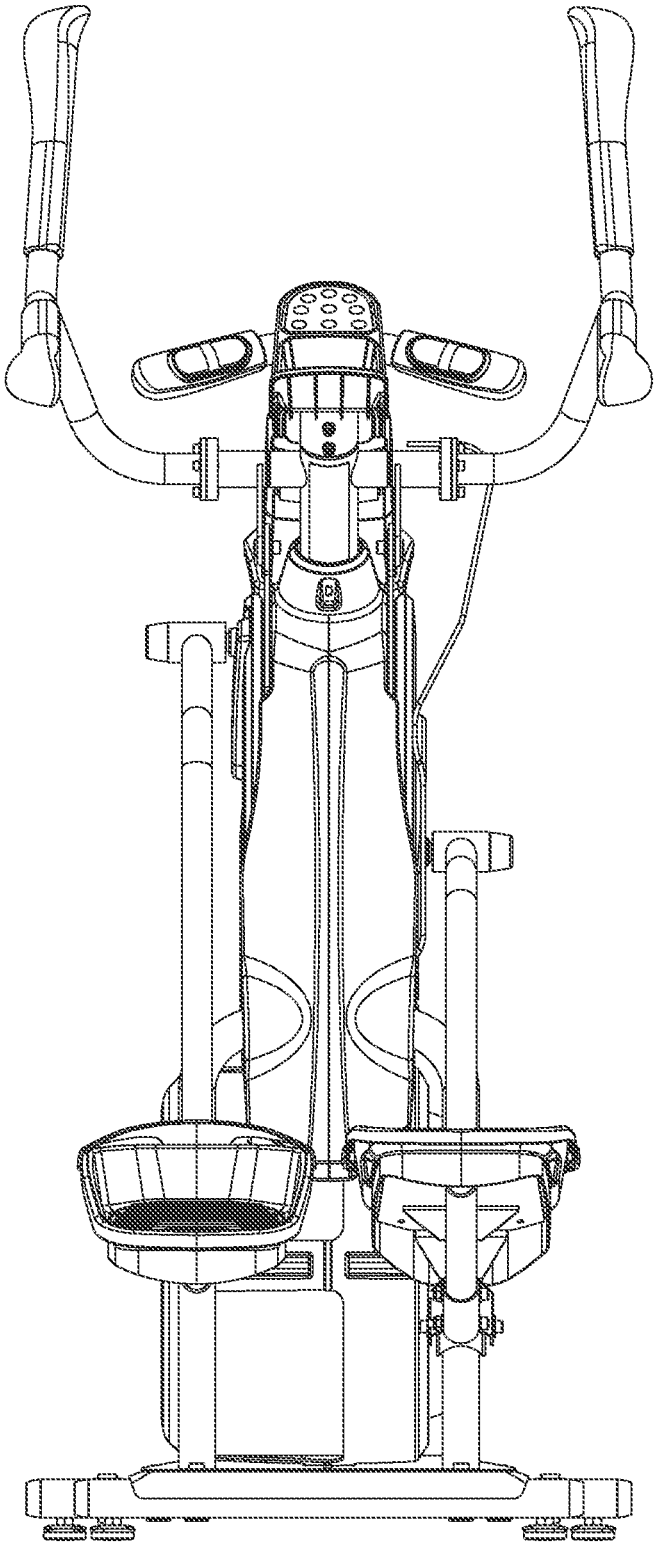
Figure 18F:
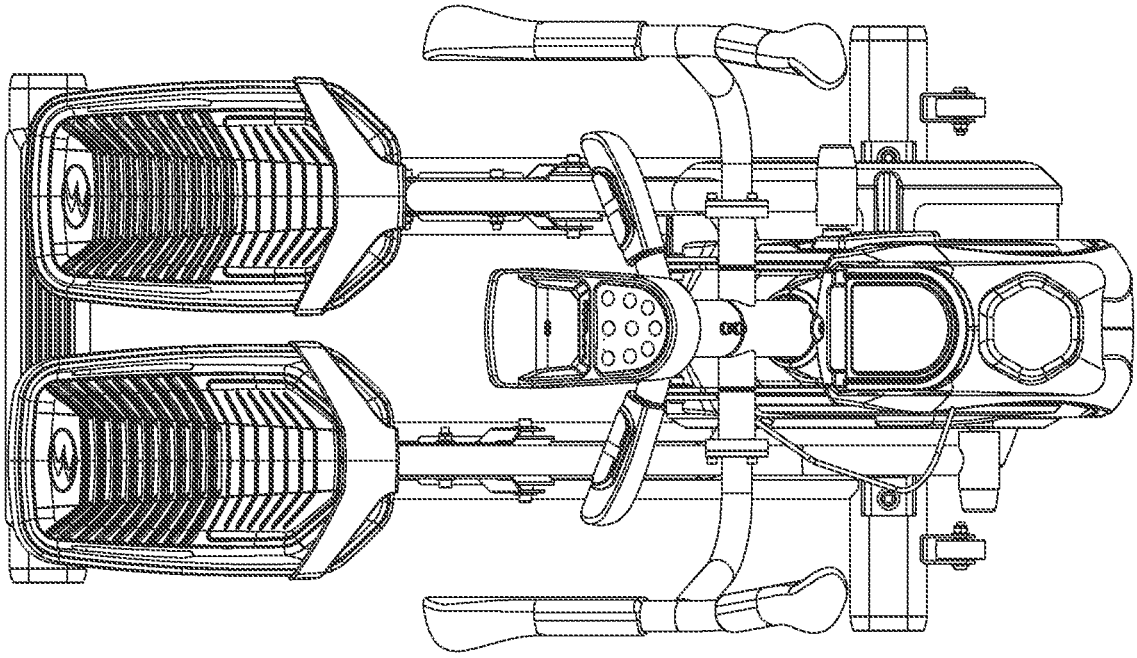
Figure 18G:
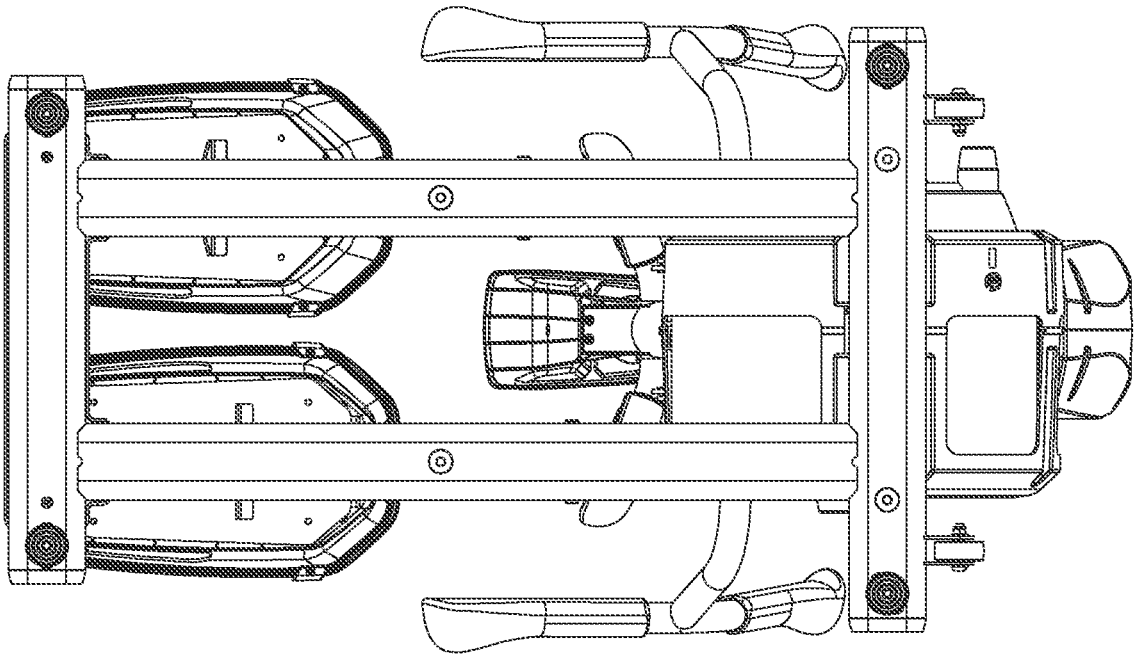

When the foot pedals 32 are driven by a user, the intermediate portions of the lower reciprocating members 26 translate in a substantially linear path via the rollers 30 along the inclined members 22. In alternative embodiments, the inclined members 22 can include a non-linear portion, such as a curved or bowed portion (e.g., see the curved inclined members 123 in FIG. 17), such that intermediate portions of the lower reciprocating members 26 translate in non-linear path via the rollers 30 along the non-linear portion of the inclined members 22. The non-linear portion of the inclined members 22 can have any curvature, such as a constant or no constant radius of curvature, and can present convex, concave, and/or partially linear surfaces for the rollers 30 to travel along. In some embodiments, the non-linear portion of the inclined members 22 can have an average angle of inclination of at least 45°, and/or can have a minimum angle of inclination of at least 45°, relative to a horizontal ground plane.

The front ends of the lower reciprocating members 26 can move in circular paths about the rotation axis A, which circular motion drives the crank arms 28 and the crank wheel 24 in a rotational motion. The combination of the circular motion of the forward ends of the lower reciprocating members 26 and the linear or non-linear motion of the intermediate portions of the foot members causes the pedals 32 at the rearward ends of the lower reciprocating members 26 to move in non-circular closed loop paths, such as substantially ovular and/or substantially elliptical closed loop paths. For example, with reference to FIG. 7A, a point F at the front of the pedals 32 can traverse a path 60 and a point R at the rear of the pedals can traverse a path 62. The closed loop paths traversed by different points on the foot pedals 32 can have different shapes and sizes, such as with the more rearward portions of the pedals 32 traversing longer distances. For example, the path 60 can be shorter and/or narrower than the path 62. A closed loop path traversed by the foot pedals 32 can have a major axis defined by the two points of the path that are furthest apart. The major axis of one or more of the closed loop paths traversed by the pedals 32 can have an angle of inclination closer to vertical than to horizontal, such as at least 45°, at least 50°, at least 55°, at least 60°, at least 65°, at least 70°, at least 75°, at least 80°, and/or at least 85°, relative to a horizontal plane defined by the base 14. To cause such inclination of the closed loop paths of the pedals, the inclined members can include a substantially linear or non-linear portion (e.g., see inclined members 123 in FIG. 17) over which the rollers 30 traverse that forms a large angle of inclination a, an average angle of inclination, and/or a minimum angle of inclination, relative to the horizontal base 14, such as at least 45°, at least 50°, at least 55°, at least 60°, at least 65°, at least 70°, at least 75°, at least 80°, and/or at least 85°. This large angle of inclination of the foot pedal motion can provide a user with a lower body exercise more akin to climbing than to walking or running on a level surface. Such a lower body exercise can be similar to that provided by a traditional stair climbing machine.

Figure 5:
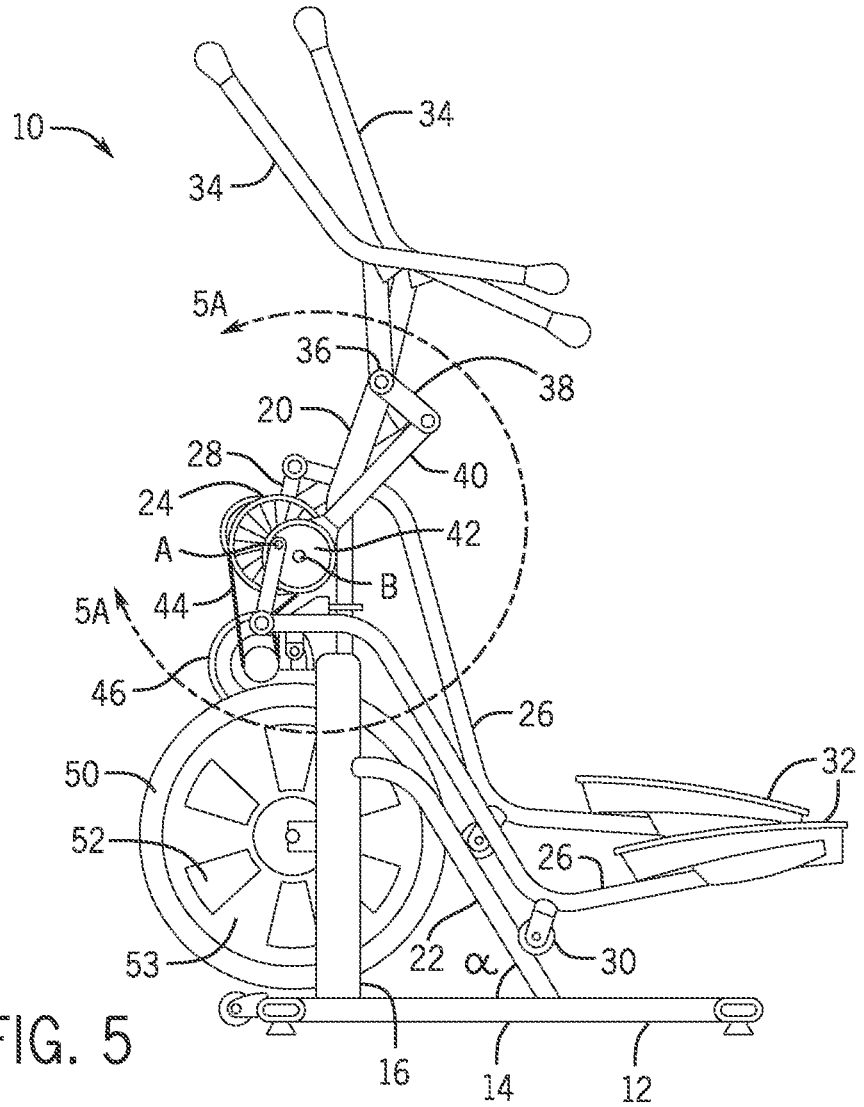
FIG. 5 is a left side view of the machine of FIG. 1.
Figure 5A:
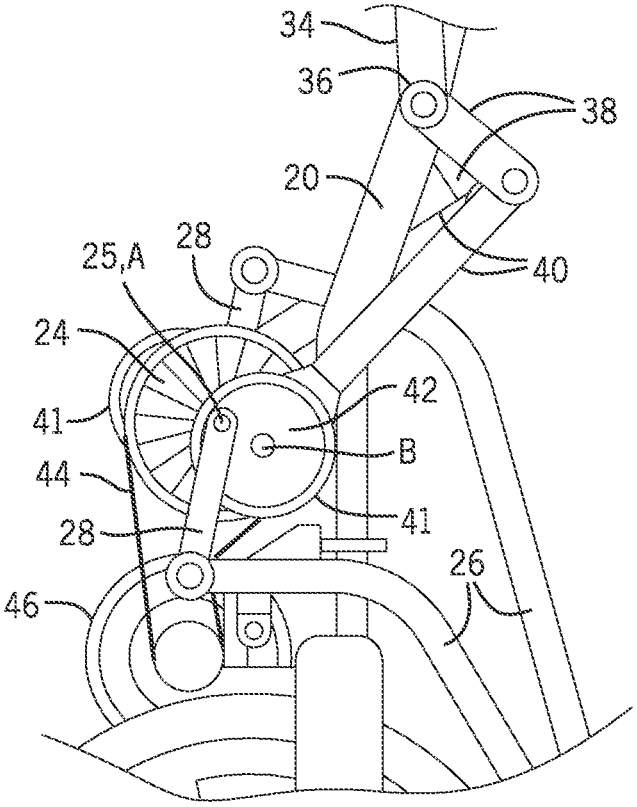
FIG. 5A is an enlarged view of a portion of FIG. 5.
Figure 7A:
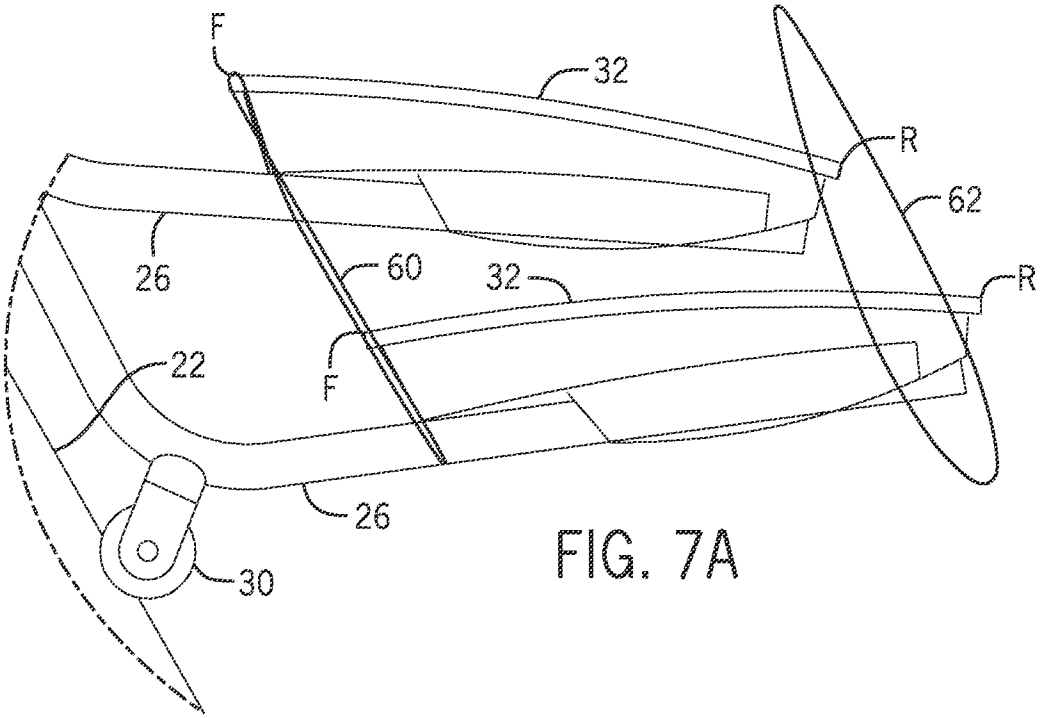
FIG. 7A is an enlarged view of a portion of FIG. 7, showing closed loop paths traversed by foot pedals of the machine.
Figure 7:
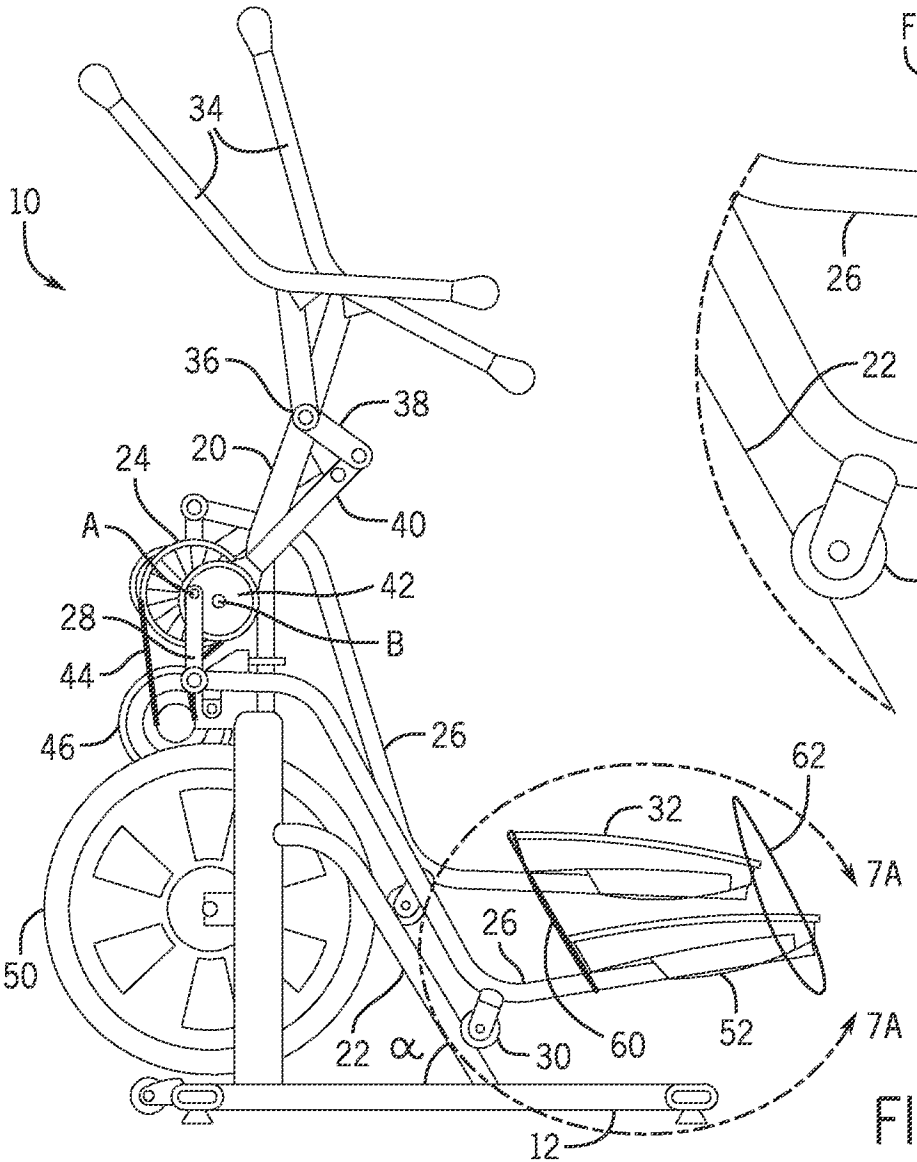
FIG. 7 is a left side view of the machine of FIG. 1.

The machine 10 can also include first and second handles 34 pivotally coupled to the upper support structure 20 of the frame 12 at a horizontal axis D. Rotation of the handles 34 about the horizontal axis D causes corresponding rotation of the first and second links 38, which are pivotably coupled at their radial ends to first and second upper reciprocating members 40. As shown in FIGS. 4A and 5A, for example, the lower ends of the upper reciprocating members 40 may include respective annular collars 41. A respective circular disk 42 is rotatably mounted within each of the annular collars 41, such that the disks 42 are rotatable relative to the upper reciprocating members 40 and each of the disks' 43 respective collars 41 about respective disk axes B at the center of each of the disks. The disk axes B are parallel to the fixed crank axis A and offset radially in opposite directions from the fixed crank axis A (see FIGS. 4A and 5A). As the crank wheel 24 rotates about the crank axis A, the disk axes B move in opposite circular orbits about the axis A of the same radius. The disks 42 are also fixed to the crankshaft 25 at the crank axis A, such that the disks 42 rotate within the respective annular collars 41 as the disks 42 pivot about the crank axis A on opposite sides of the crank wheel 24. The disks 42 can be fixed relative to the respective crank arms 28, such that they rotate in unison around the crank axis A to crank the crank wheel 24 when the pedals 32 and/or the handles 34 are driven by a user. The handle linkage assembly may include the handles 34, the pivot axis 36, the links 38, the upper reciprocating members 40, and the disks 42. The components may be configured to cause the handles 34 to reciprocate in an opposite motion relative to the pedals 32. For example, as the left pedal 32 is moving upward and forward, the left handle 34 pivots rearward, and vice versa.

The crank wheel 24 can be coupled to one or more resistance mechanisms to provide resistance to the reciprocation motion of the pedals 32 and handles 34. For example, the one or more resistance mechanisms can include an air-resistance based resistance mechanism 50, a magnetism based resistance mechanism, a friction based resistance mechanism, and/or other resistance mechanisms. One or more of the resistance mechanisms can be adjustable to provide different levels of resistance. Further, one or more of the resistance mechanisms can provide a variable resistance that corresponds to the reciprocation frequency of the exercise machine, such that resistance increases as reciprocation frequency increases.

With reference to FIGS. 1-7, the machine 10 may include an air-resistance based resistance mechanism, such as an air brake 50 that is rotationally mounted to the frame 12. The air brake 50 is driven by the rotation of the crank wheel 24. In the illustrated embodiment, the air brake 50 is driven by a belt or chain 48 that is coupled to a pulley 46, which is further coupled to the crank wheel 24 by another belt or chain 44 that extends around the perimeter of the crank wheel. The pulley 46 can be used as a gearing mechanism to adjust the ratio of the angular velocity of the air brake to the angular velocity of the crank wheel 24. For example, one rotation of the crank wheel 24 can cause several rotations of the air brake 50 to increase the resistance provided by the air brake.

The air brake 50 may include a radial fin structure that causes air to flow through the air brake when it rotates. For example, rotation of the air brake can cause air to enter through lateral openings 52 on the lateral side of the air brake near the rotation axis and exit through radial outlets 54 (see FIGS. 4 and 5). The induced air motion through the air brake 50 causes resistance to the rotation of the crank wheel 24 or other rotating components, which is transferred to resistance to the reciprocation motions of the pedals 32 and handles 34. As the angular velocity of the air brake 50 increases, the resistance force increases in a non-linear relationship, such as a substantially exponential relationship.

In some embodiments, the air brake 50 can be adjustable to control the volume of air flow that is induced to flow through the air brake at a given angular velocity. For example, in some embodiments, the air brake 50 can include a rotationally adjustable inlet plate 53 (see FIG. 5) that can be rotated relative to the air inlets 52 to change the total cross-flow area of the air inlets 52. The inlet plate 53 can have a range of adjustable positions, including a closed position where the inlet plate 53 blocks substantially the entire cross-flow area of the air inlets 52, such that there is no substantial air flow through the fan.

In some embodiments (not shown), an air brake can include an inlet plate that is adjustable in an axial direction (and optionally also in a rotational direction like the inlet plate 53). An axially adjustable inlet plate can be configured to move in a direction parallel to the rotation axis of the air brake. For example, when the inlet plate is further away axially from the air inlet(s), increased air flow volume is permitted, and when the inlet plate is closer axially to the air inlet(s), decreased air flow volume is permitted.

In some embodiments (not shown), an air brake can include an air outlet regulation mechanism that is configured to change the total cross-flow area of the air outlets 54 at the radial perimeter of the air brake, in order to adjust the air flow volume induced through the air brake at a given angular velocity.

In some embodiments, the air brake 50 can include an adjustable air flow regulation mechanism, such as the inlet plate 53 or other mechanism described herein, that can be adjusted rapidly while the machine 10 is being used for exercise. For example, the air brake 50 can include an adjustable air flow regulation mechanism that can be rapidly adjusted by the user while the user is driving the rotation of the air brake, such as by manipulating a manual lever, a button, or other mechanism positioned within reach of the user's hands while the user is driving the pedals 32 with his feet. Such a mechanism can be mechanically and/or electrically coupled to the air flow regulation mechanism to cause an adjustment of air flow and thus adjust the resistance level. In some embodiments, such a user-caused adjustment can be automated, such as using a button on a console near the handles 34 coupled to a controller and an electrical motor coupled to the air flow regulation mechanism. In other embodiments, such an adjustment mechanism can be entirely manually operated, or a combination of manual and automated. In some embodiments, a user can cause a desired air flow regulation adjustment to be fully enacted in a relatively short time frame, such as within a half-second, within one second, within two seconds, within three second, within four seconds, and/or within five seconds from the time of manual input by the user via an electronic input device or manual actuation of a lever or other mechanical device. These exemplary time periods are for some embodiments, and in other embodiments the resistance adjustment time periods can be smaller or greater.

Embodiments that include a variable resistance mechanism that provide increased resistance at higher angular velocity and a rapid resistance mechanism that allow a user to quickly change the resistance at a given angular velocity allow the machine 10 to be used for high intensity interval training. In an exemplary exercise method, a user can perform repeated intervals alternating between high intensity periods and low intensity periods. High intensity periods can be performed with the adjustable resistance mechanism, such as the air brake 50, set to a low resistance setting (e.g., with the inlet plate 53 blocking air flow through the air brake 50). At a low resistance setting, the user can drive the pedals 32 and/or handles 34 at a relatively high reciprocation frequency, which can cause increased energy exertion because, even though there is reduced resistance from the air brake 50, the user is caused to lift and lower his own body weight a significant distance for each reciprocation, like with a traditional stair climber machine. The rapid climbing motion can lead to an intense energy exertion. Such a high intensity period can last any length of time, such as less than one minute, or less than 30 seconds, while providing sufficient energy exertion as the user desires.

Low intensity periods can be performed with the adjustable resistance mechanism, such as the air brake 50, set to a high resistance setting (e.g., with the inlet plate 53 allowing maximum air flow through the air brake 50). At a high resistance setting, the user can be restricted to driving the pedals 32 and/or handles 34 only at relatively low reciprocation frequencies, which can cause reduced energy exertion because, even though there is increased resistance from the air brake 50, the user does not have to lift and lower his own body weight as often and can therefor conserve energy. The relatively slower climbing motion can provide a rest period between high intensity periods. Such a low intensity period or rest period can last any length of time, such as less than two minutes, or less than about 90 seconds. An exemplary interval training session can include any number of high intensity and low intensity periods, such less than 10 of each and/or less than about 20 minutes total, while providing a total energy exertion that requires significantly longer exercise time, or is not possible, on a traditional stair climber or a traditional elliptical machine.

In accordance with various embodiments, the exercise machine illustrated in FIG. 1-7 may have some differences compared to the machine illustrated in FIGS. 8-11. For example, in FIGS. 1-7 the lower reciprocating members 26 support the rollers. As shown, the first and second pedals 32 are a contiguous portion of the first and second lower reciprocating members 26. The first and second lower reciprocating members 26 are each tubular structures with a bend in the tubular structures defining the first and second pedals 32 and with the respective platforms and the respective rollers extending the respective tubular structures forming the first and second pedals. The lower reciprocating member in FIGS. 8-11 attaches directly to a frame 126*a* that supports the foot pads 126*b*. It is understood that the features of each of the embodiments are applicable to the other.

Referring to FIGS. 8-11, the machine 100 may include a frame 112 having a base 114 for contact with a support surface, a vertical brace 116 extending from the base 114 to an upper support structure 120, and first and second inclined members 122 that extend between the base 114 and the vertical brace 116. As reflected in the various embodiments discussed herein, the machine 100 may include an upper moment producing mechanism. The machine may also or alternatively include a lower moment producing mechanism. The upper moment producing mechanism and the lower moment producing mechanism may each provide an input into a crankshaft 125 inducing a tendency for the crankshaft 125 to rotate about axis A. Each mechanism may have a single or multiple separate linkages that produce the moment on the crankshaft 125. For example, the upper moment-producing mechanism may include one or more upper linkages extending from the handles 134 to the crankshaft 125. The lower moment-producing mechanism may include one or more lower linkages extending from the pedal 132 to crankshaft 125. In one example, each machine may have two handles 134 and two linkages connecting each of the handles to the crankshaft 125. Likewise, the lower moment-producing mechanism may include two pedals and have two linkages connecting each of the two pedals to the crankshaft 125. The crankshaft 125 may have a first side and a second side rotatable about a crankshaft axis A. The first side and the second side may be fixedly connected to the two upper linkages and/or the two lower linkages, respectively.

In various embodiments, the lower moment-producing mechanism may include a first lower linkage and a second lower linkage corresponding to a left and right side of machine 100. The first and second lower linkages may include one or more of first and second pedals 132, first and second rollers 130, first and second lower reciprocating members 126, and/or first and second crank arms 128, respectively. The first and second lower linkages may operably transmit a force input from the user into a moment about the crankshaft 125.

The machine 100 may include first and/or second crank wheels 124 which may be rotatably supported on opposite sides of the upper support structure 120 about a horizontal rotation axis A. The first and second crank arms 128 are fixed relative to the respective crankshaft 125 which may in turn be fixed relative to the respective first and second crank wheels 124. The crank arms 128 may be positioned on outer sides of the crank wheels 124. The crank arms 128 may be rotatable about the rotation axis A, such that rotation of the crank arms 128 causes the crank wheels 124 and/or the crankshaft 125 to rotate. The first and second crank arms 128 extend from central ends at the axis A in opposite radial directions to respective radial ends. For example, the first side and the second side of the crank shaft 125 may be fixedly connected to second ends of first and second lower crank arms. First and second lower reciprocating members 126 have forward ends that are pivotably coupled to the radial ends of the first and second crank arms 128, respectively, and rearward ends that are coupled to first and second foot pedals 132, respectively. First and second rollers 130 may be coupled to intermediate portions of the first and second lower reciprocating members 126, respectively. In various examples, the first and second pedals 132 may each have first ends with first and second rollers 130, respectively, extending therefrom. Each of the first and second pedals 132 may have second ends with first and second platforms 126*b* (or similarly pads), respectively. First and second brackets 126*a* may form the portion of the first and second pedals 132 which connects the first and second platforms 132*b* and the first and second brackets 132*a*. The first and second lower reciprocating members 126 may be fixedly connected to the first and second brackets 126*a* between the first and second rollers 130, respectively, and the first and second platforms 132*b*, respectively. The connection may be closer to a front of the first and second platform than the first and second rollers 130. The first and second platforms 132*b* may be operable for a user to stand on and provide an input force. The first and second rollers 130 rotate about individual roller axes T. The first and second rollers may rotate on and travel along first and second inclined members 122, respectively. The first and second inclined members 122 may form a travel path along the length and height of the first and second incline members. The rollers 130 can rollingly translate along the inclined members 122 of the frame 112. In alternative embodiments, other bearing mechanisms can be used to provide translational motion of the lower reciprocating members 126 along the inclined members 122 instead of or in addition to the rollers 130, such as sliding friction-type bearings.

When the foot pedals 132 are driven by a user, the intermediate portions of the lower reciprocating members 126 translate in a substantially linear path via the rollers 130 along the inclined members 122, and the front ends of the lower reciprocating members 126 move in circular paths about the rotation axis A, which drives the crank arms 128 and the crank wheels 124 in a rotational motion about axis A. The combination of the circular motion of the forward ends of the lower reciprocating members 126 and the linear motion of the intermediate portions of the foot members causes the pedals 132 at the rearward ends of the foot members to move in non-circular closed loop paths, such as substantially ovular and/or substantially elliptical closed loop paths. The closed loop paths traversed by the pedals 132 can be substantially similar to those described with reference to the pedals 32 of the machine 10. A closed loop path traversed by the foot pedals 132 can have a major axis defined by the two points of the path that are furthest apart. The major axis of one or more of the closed loop paths traversed by the pedals 132 can have an angle of inclination closer to vertical than to horizontal, such as at least 45°, at least 50°, at least 55°, at least 60°, at least 65°, at least 70°, at least 75°, at least 80°, and/or at least 85°, relative to a horizontal plane defined by the base 114. To cause such inclination of the closed loop paths of the pedals 132, the inclined members 122 can include a substantially linear portion over which the rollers 130 traverse. The inclined members 122 form a large angle of inclination a relative to the horizontal base 114, such as at least 45°, at least 50°, at least 55°, at least 60°, at least 65°, at least 70°, at least 75°, at least 80°, and/or at least 85°. This large angle of inclination which sets the path for the foot pedal motion can provide the user with a lower body exercise more akin to climbing than to walking or running on a level surface. Such a lower body exercise can be similar to that provided by a traditional stair climbing machine.

In various embodiments, the upper moment-producing mechanism 90 may include a first upper linkage and a second upper linkage corresponding to a left and right side of machine 100. The first and second upper linkages may include one or more of first and second handles 134, first and second links 138, first and second upper reciprocating members 140, and/or first and second virtual crank arms 142*a*, respectively. The first and second upper linkages may operably transmit a force input from the user, at the handles 134, into a moment about the crankshaft 125.

Figure 8:
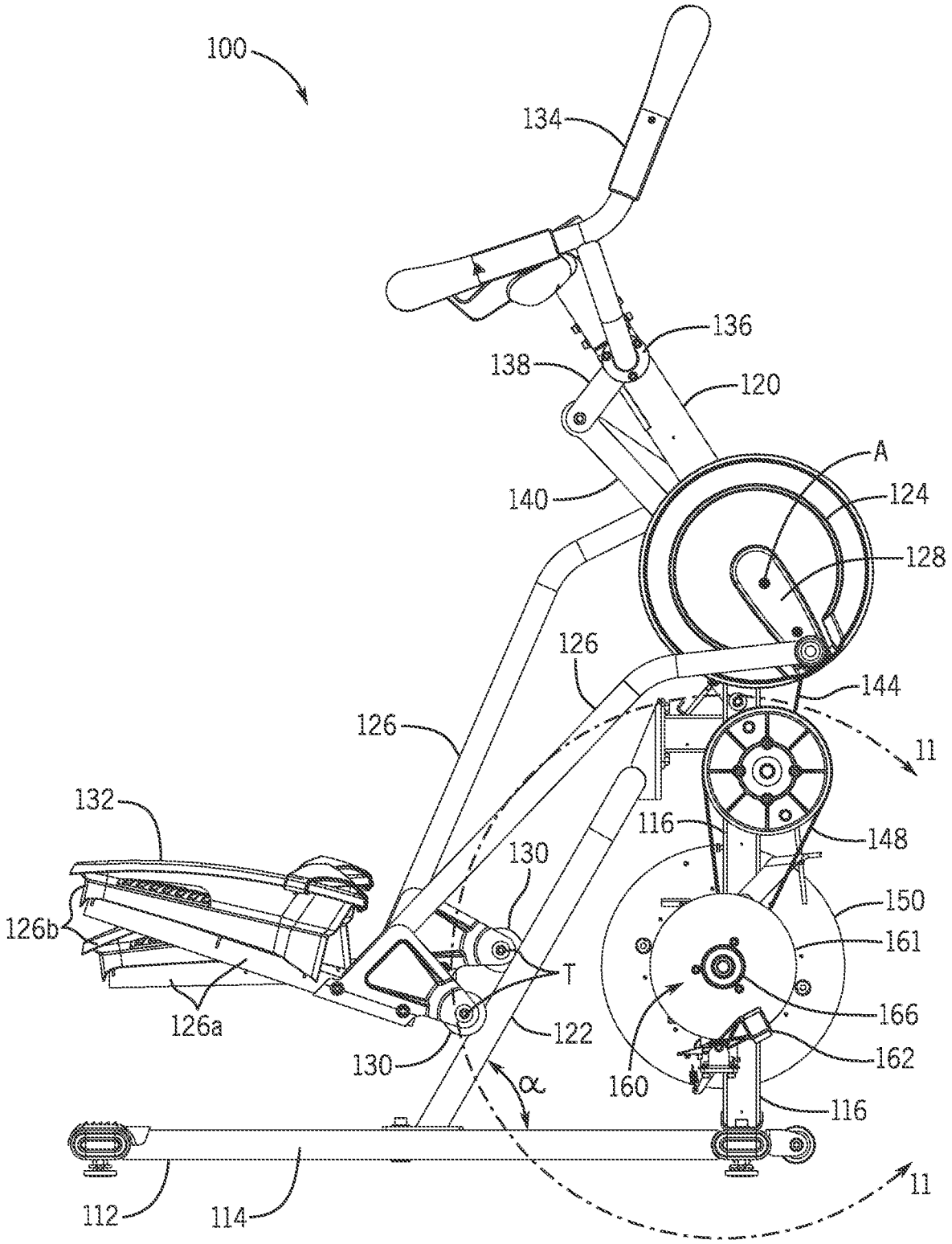
FIG. 8 is a right side view of another exemplary exercise machine.
Figure 9:
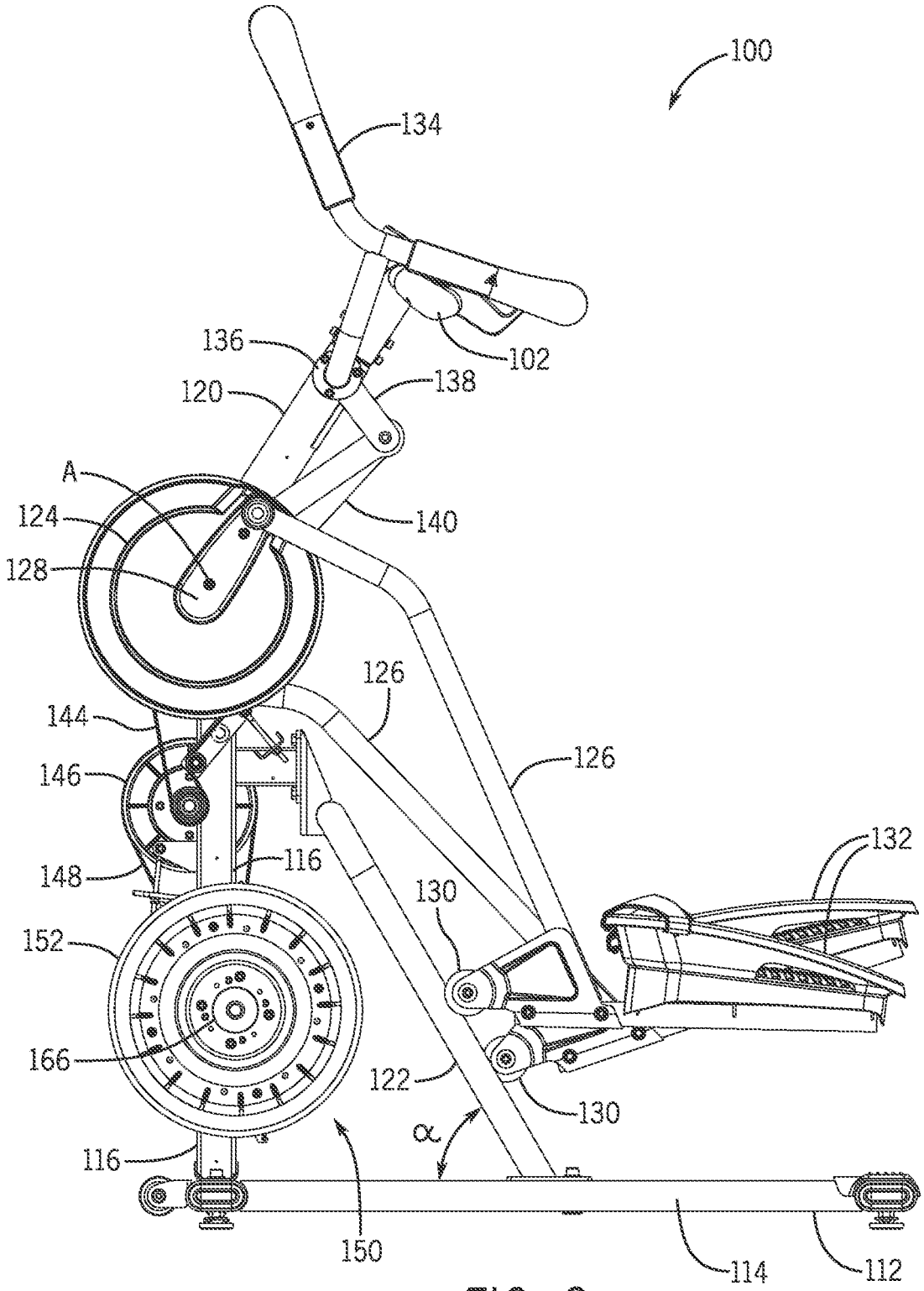
FIG. 9 is a left side view of the machine of FIG. 8.
Figure 9A:
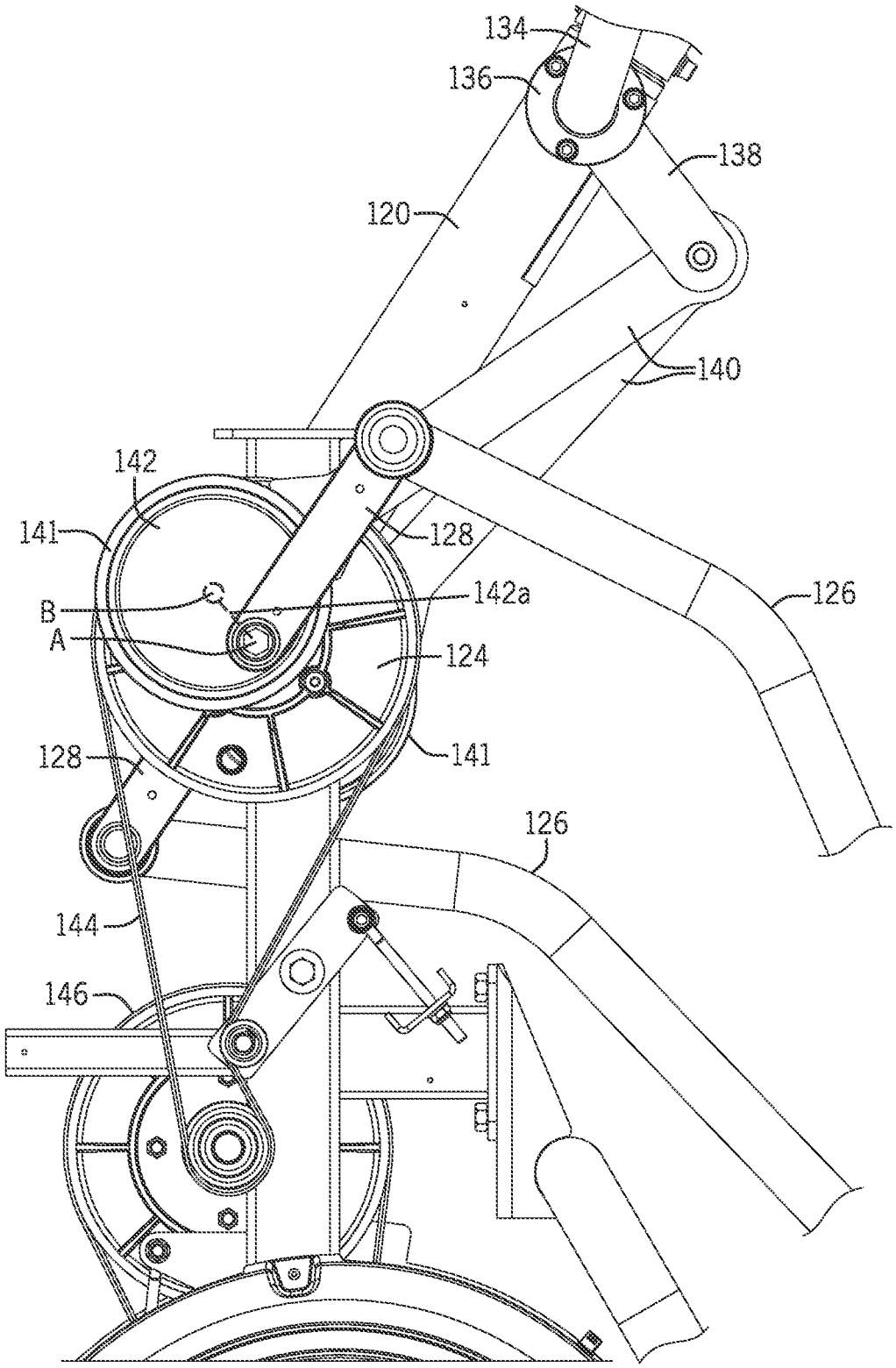
FIGS. 9A-9F are simplified sectional and full views of FIG. 9 highlighting the input linkages of the example exercise machine.
Figure 10:
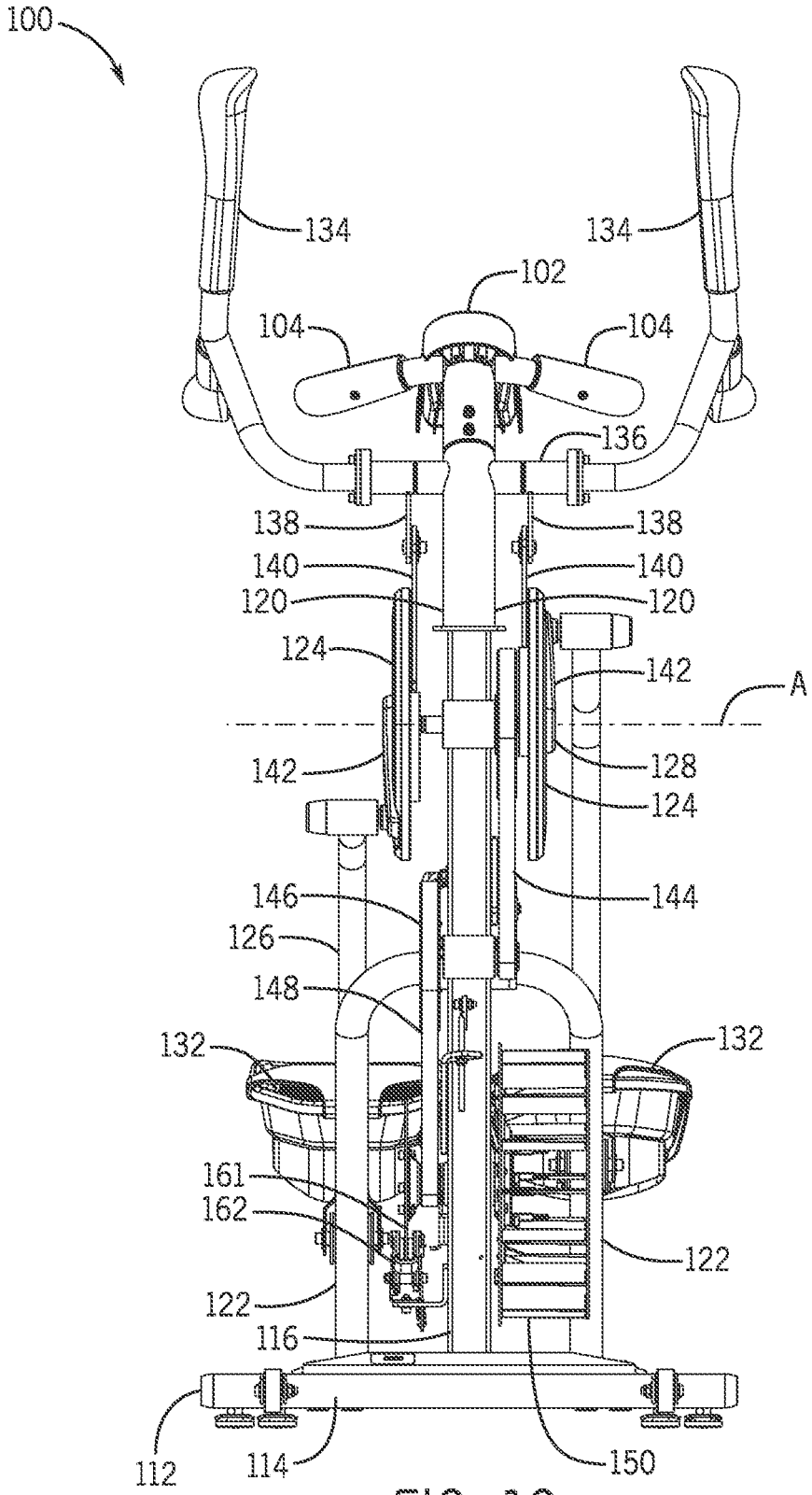
FIG. 10 is a front view of the machine of FIG. 8.

With reference to FIGS. 8-10, the first and second handles 134 may be pivotally coupled to the upper support structure 120 of the frame 112 at a horizontal axis D. Rotation of the handles 134 about the horizontal axis D causes corresponding rotation of first and second links 138, which are pivotably coupled at their radial ends to first and second upper reciprocating members 140. The first and second links 138 and the handle 134 may be pivotable about the D axis. For example, the first and second links 138 may be cantilevered off of handles 134 at the pivot aligned with the D axis. Each of the first and second links 138 may have angle ω with the respective handles 134. The angle may be measured from a plane passing through the axis D and the curve in the handle proximate the connection to the link 138. The angle ω may be any angle such as angles between 0 and 180 degrees. The angle ω may be optimized to one that is most comfortable to a single user or an average user. The lower ends of the upper reciprocating members 140 may pivotably connect to the first and second virtual crank arms 142*a*, respectively. The first and second virtual crank arms 142*a* may be rotatable relative to the rest of the upper reciprocating members 140 about respective axes B (which may be referred to as virtual crank arm axes). Axes B may be parallel to the crank axis A. Each axis B may be located proximal to an end of each of the upper reciprocating members 140. Each axis B may also be located proximal to one end of the virtual crank arm 142*a*. Each axis B may be offset radially in opposite directions from the axis A. Each respective virtual crank arm 142*a* may be perpendicular to axis A and each of the axes B, respectively. The distance between axis A and each axis B may define approximately the length of the virtual crank arm. This distance between axis A and each axis B is also the length of the moment arm of each virtual crank arm 142*a* which exerts a moment on the crankshaft. As used herein, the virtual crank arm 142*a* may be any device which exerts a moment on the crankshaft 125. For example, as used above the virtual crank arm 142*a* may be the disk 142. In another example, the virtual crank arm 142*a* may be a crank arm similar to crank arm 128. Each of the virtual crank arms may be a single length of semi-ridged to ridged material having pivots proximal to each end with one of the reciprocating members pivotably connected along axis B proximal to one end and the crankshaft fixedly connected along axis A proximally connected to the other end. The virtual crank arm may include more than two pivots and have any shape. As discussed hereafter, the virtual crank arm is described as being disk 142 but this is merely as an example, as the virtual crank arm may take any form operable to apply a moment to crankshaft 125. As such, each embodiment including the disk may also include the virtual crank arm or any other embodiment disk herein or would be understood by one of ordinary skill in the art as applicable.

In the embodiment in which the vertical crank arm 142*a* is the rotatable disk 142, the structure of the upper reciprocating members 140 and rotatable disks 142 should be understood to be similar to the upper reciprocating members 40 and disks 42 of the machine 10, as shown in FIG. 3-7. However any of the virtual crank arms, crank arms, disks or the like may also be applicable to the embodiments of FIG. 3-7. The lower ends of the upper reciprocating members 140 may be positioned just inside of the crank wheels 124, as shown in FIG. 10. As the crank wheels 124 rotate about the axis A, the disk axes B orbits about the axis A. The disks 142 are also pivotably coupled to the crank axis A, such that the disks 142 rotate within the respective lower ends of the upper reciprocating members 140 as the disks 142 pivot about the crank axis A on opposite sides of the upper support member 120. The disks 142 can be fixed relative to the respective crank arms 128, such that they rotate in unison around the crank axis A to crank the crank wheel 124 when the pedals 132 and/or the handles 134 are driven by a user.

The first and second links 138 may have additional pivots coaxial with axis C. The upper reciprocating members 140 may be connected to the links 138 at the pivot coaxial with axis C. As indicated above, the upper reciprocating members 140 may be connected with the annular collars 141. Annular collar 141 encompasses rotatable disk 142 with the two being able to rotate independent of one another. As the handles 134 articulate back and forth they move links 138 in an arc, which in turn articulates the upper reciprocating members 140. Via the fixed connection between the upper reciprocating member 140 and annular collar 141, the articulation of handle 134 also moves annular collar 141. As rotatable disk 142 is fixedly connected to and rotatable around the crankshaft which pivots about axis A, rotatable disk 142 also rotates about axis A. As the upper reciprocating member 140 articulates back and forth it forces the annular collar 141 toward and away from the axis A along a circular path with the result of causing axis B and/or the center of disk 142 to circularly orbit around axis A.

Figure 9B:
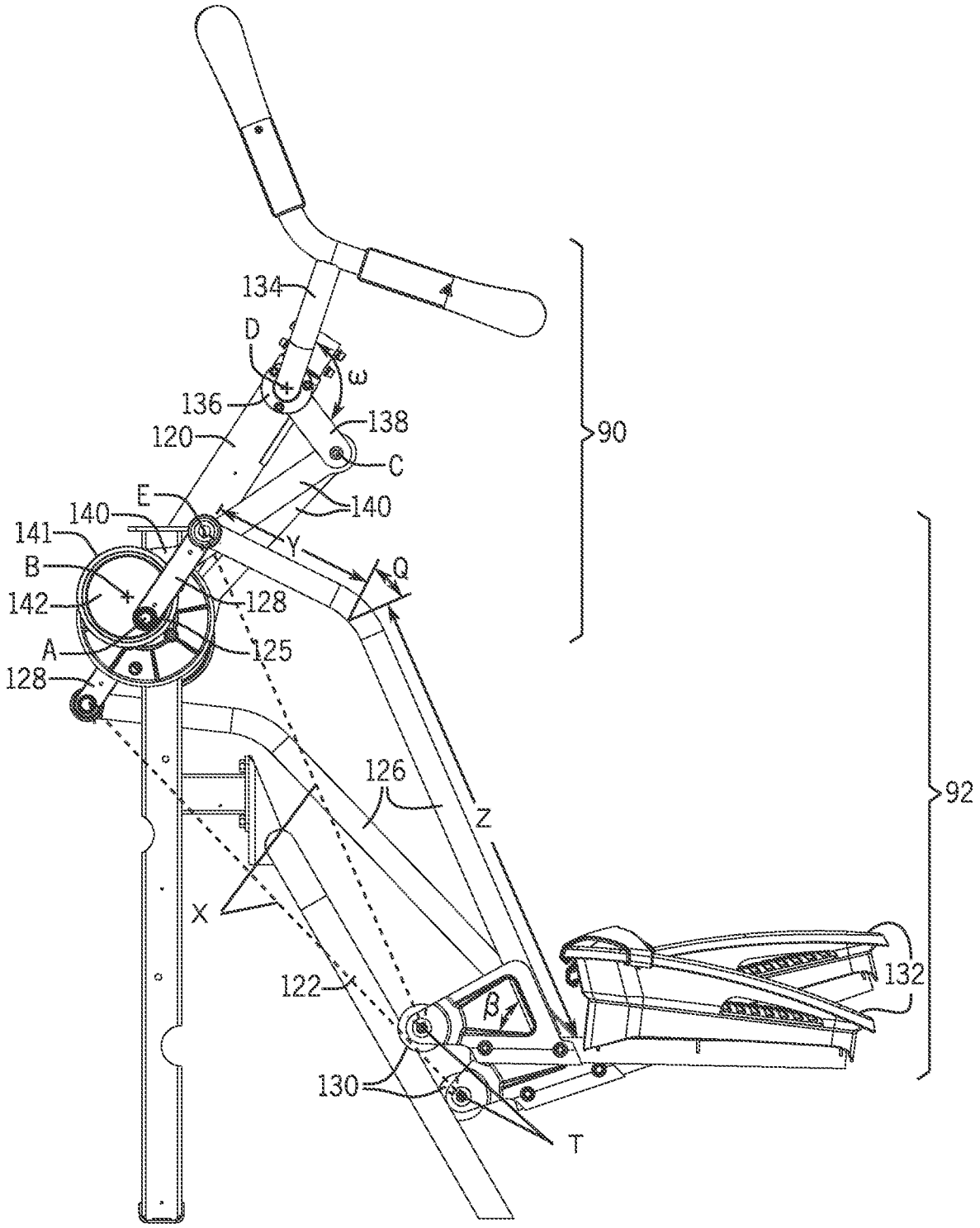
Figure 9C:
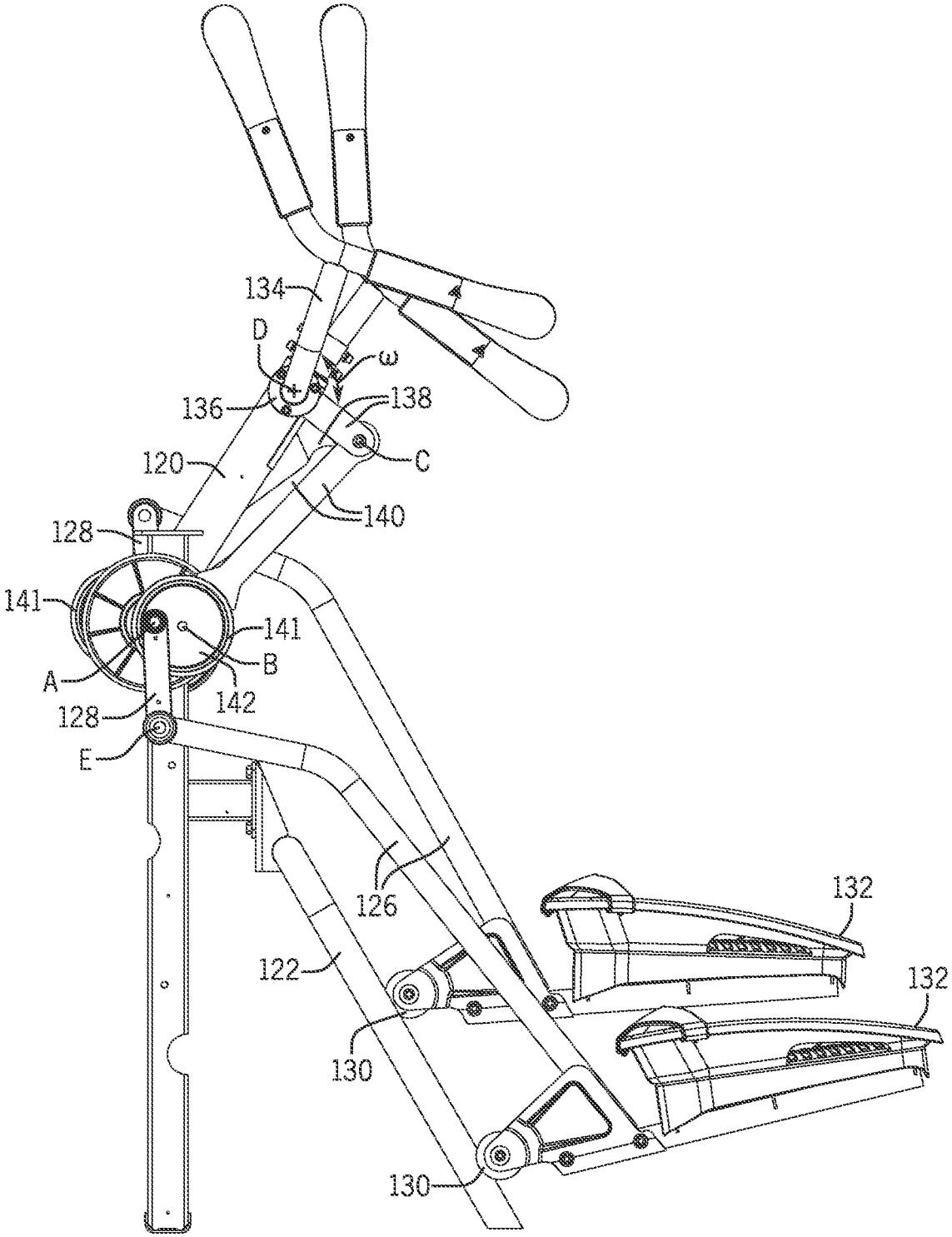
Figure 9D:
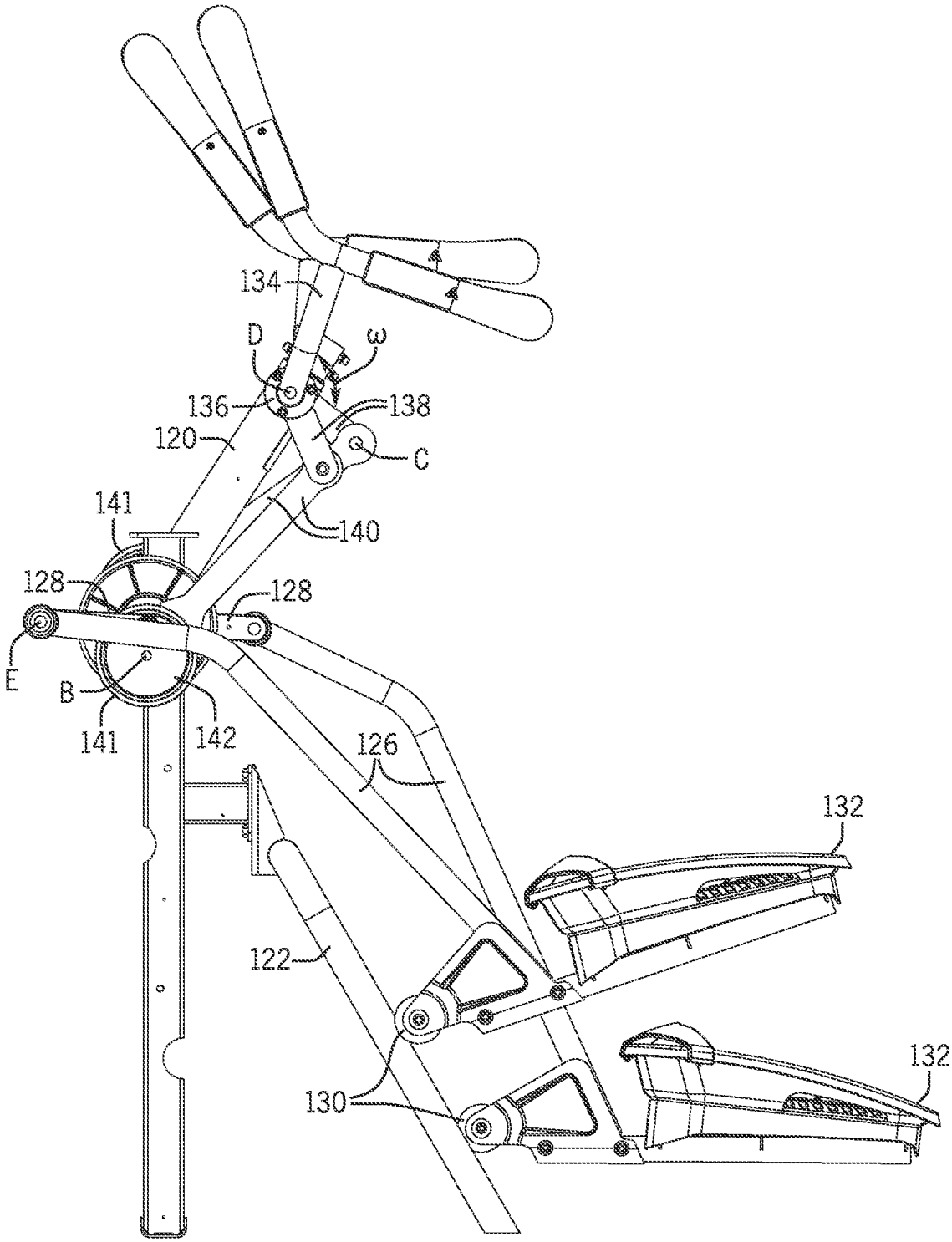
Figure 9E:
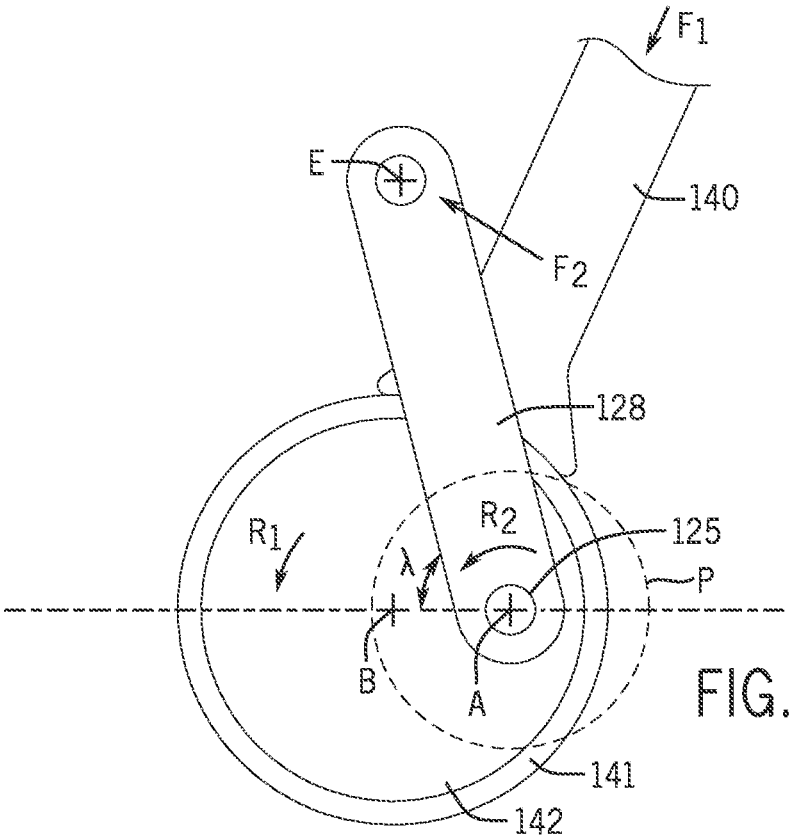
Figure 9F:
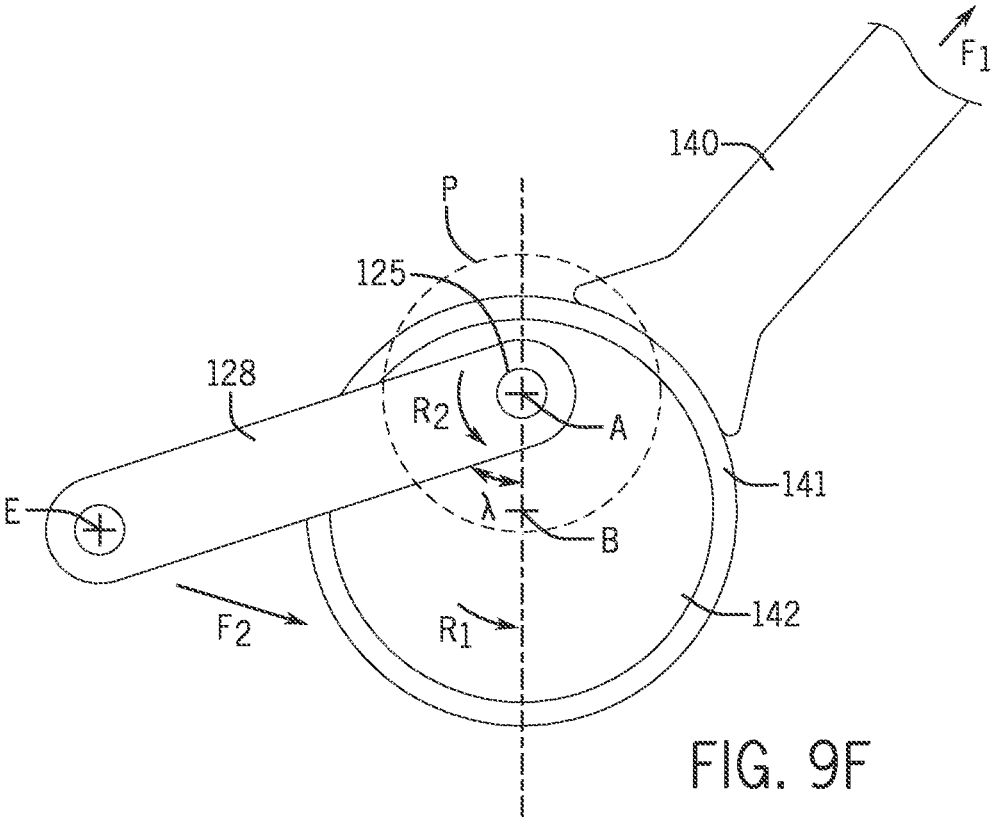
Figure 9H:
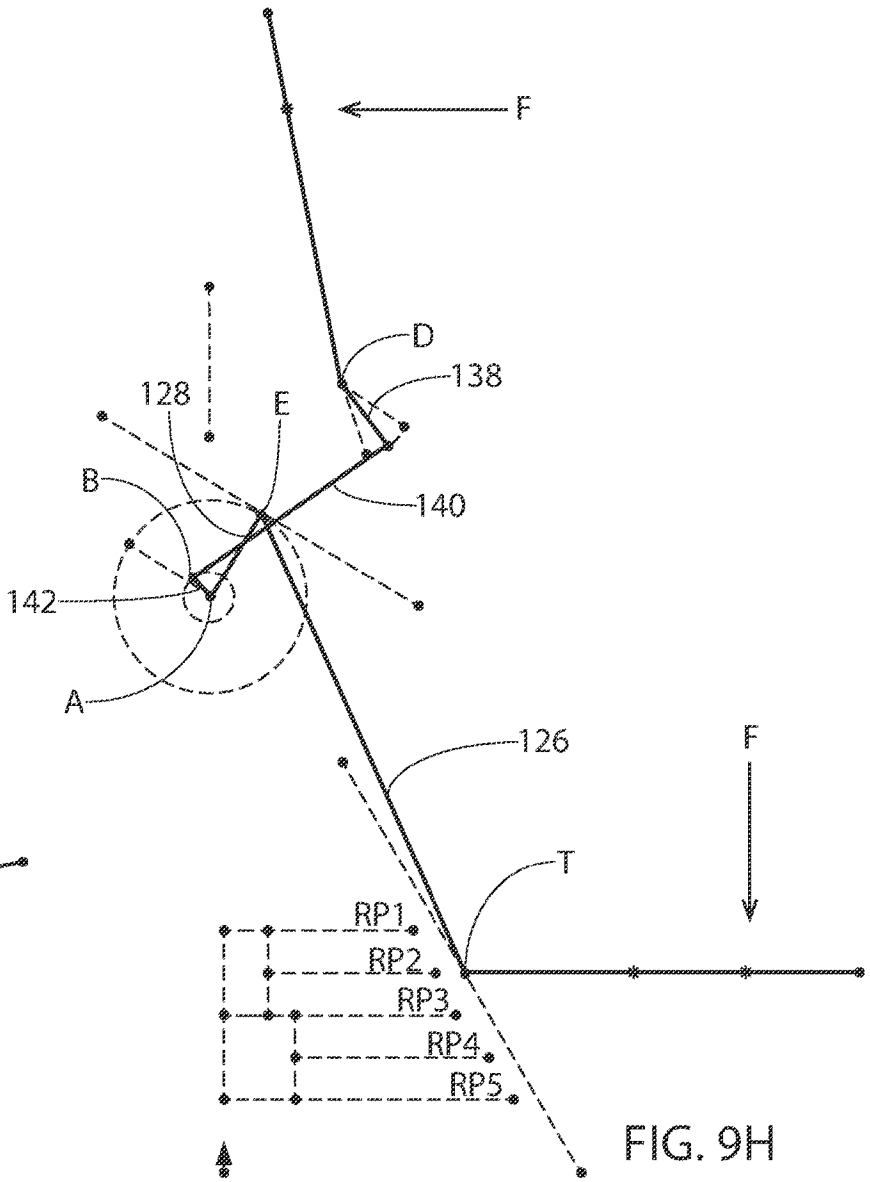
FIGS. 9G-9N are schematic views stepping through a cycle of the machine relative to various positions of the roller through its range of travel.
Figure 9G:
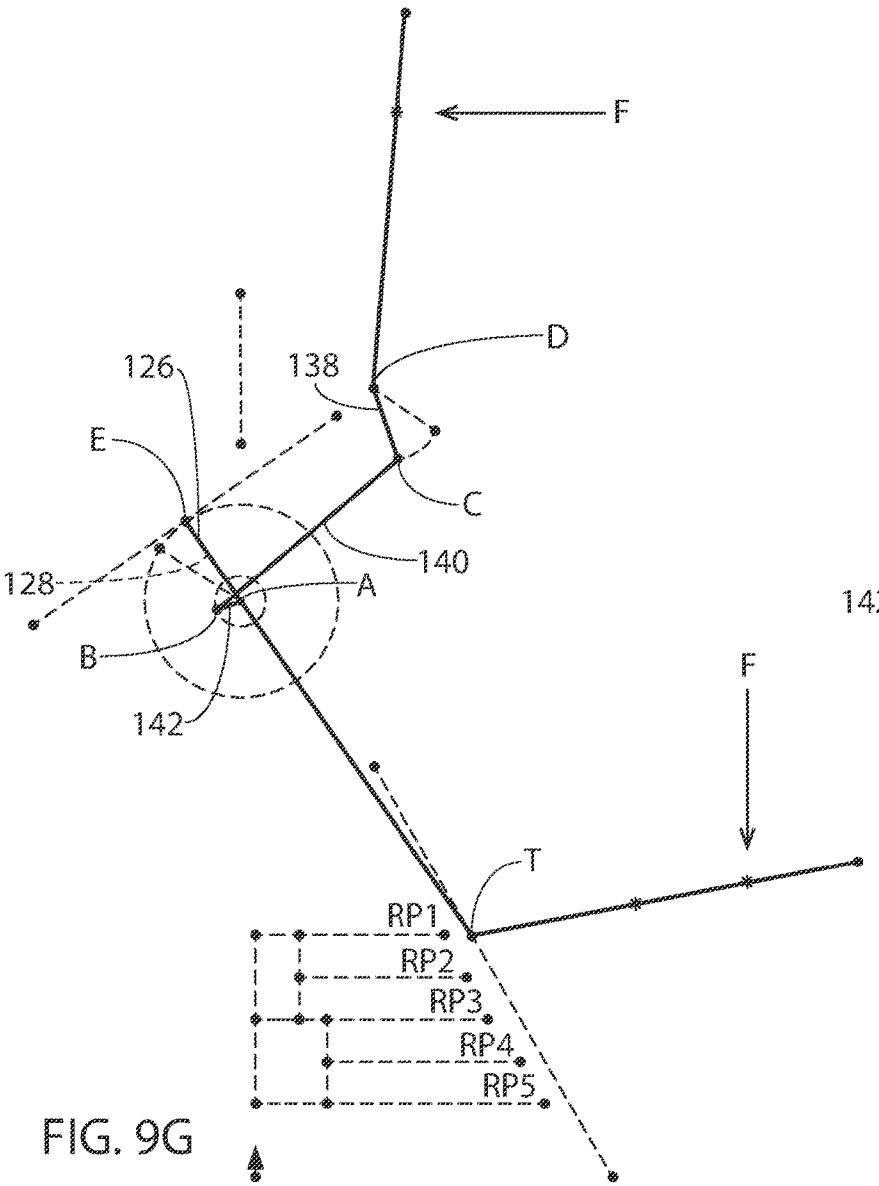
Figure 9J:
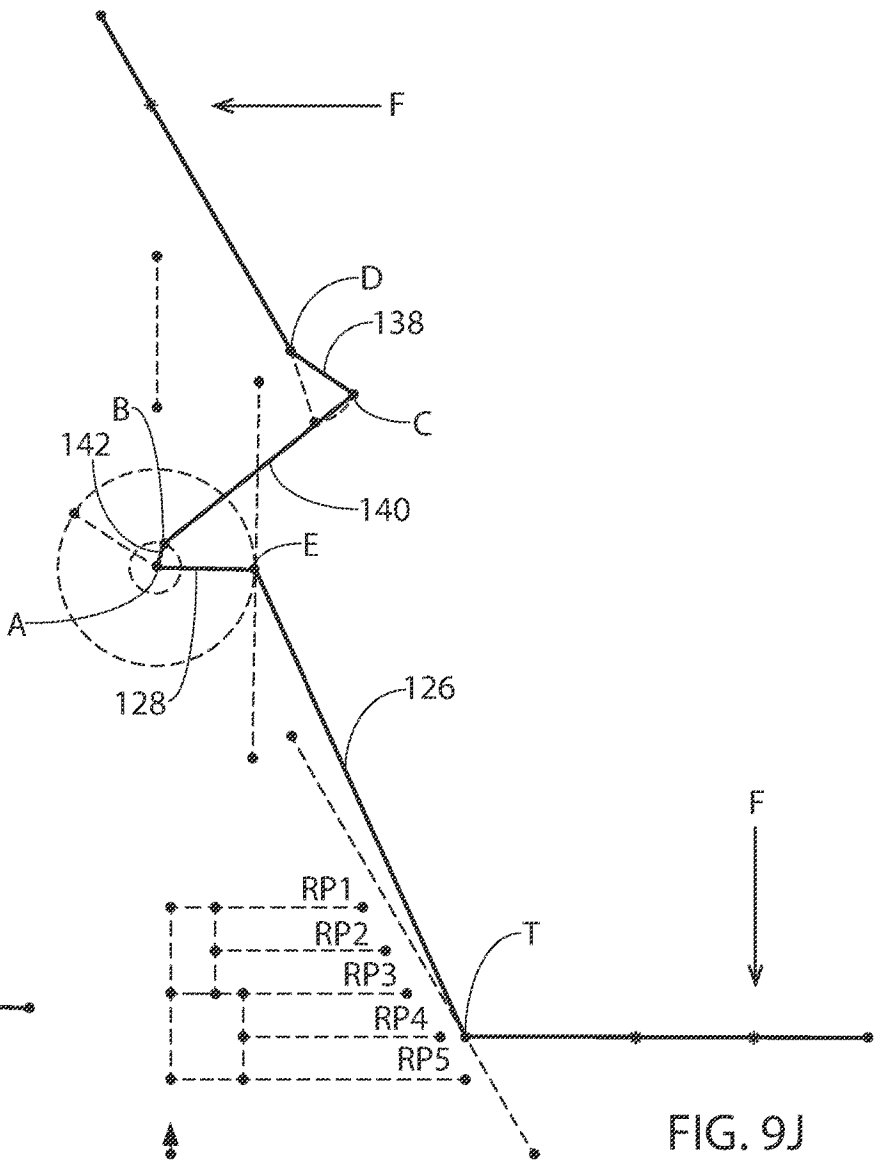
Figure 9I:
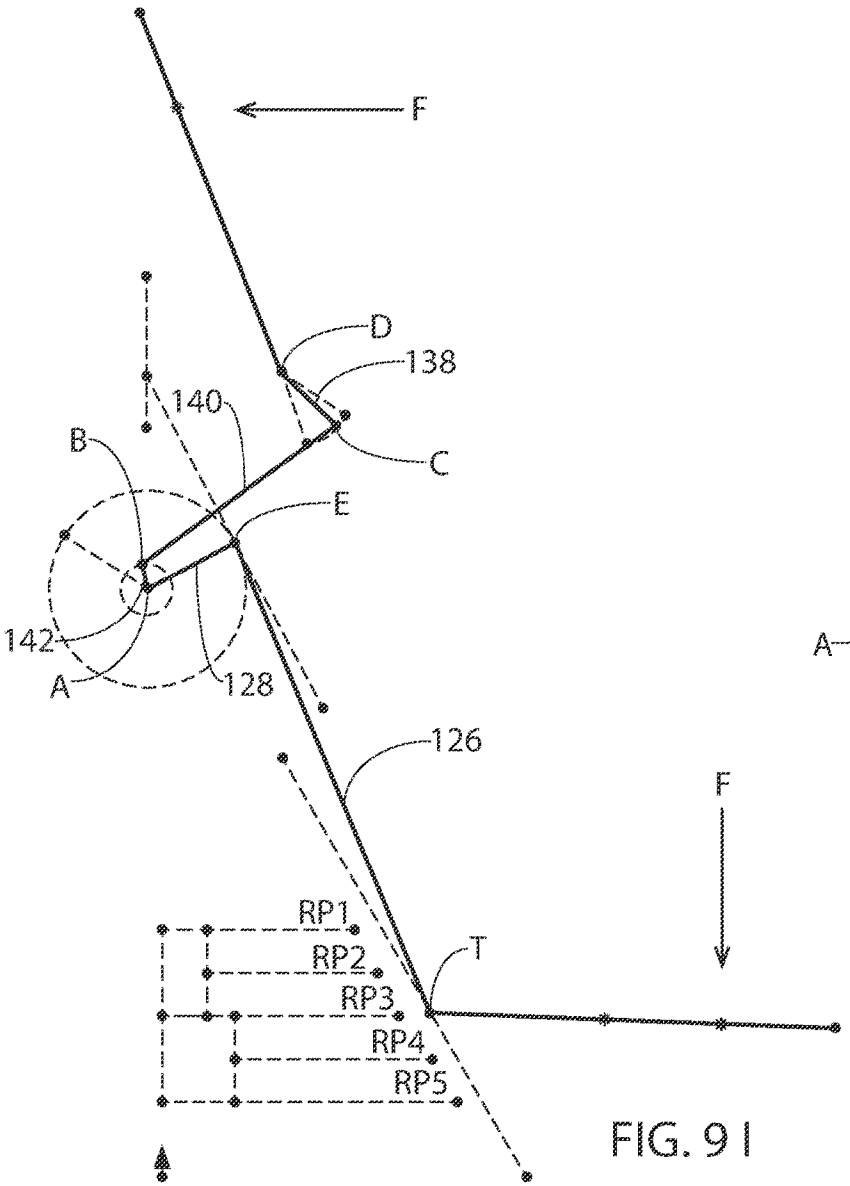
Figure 9L:
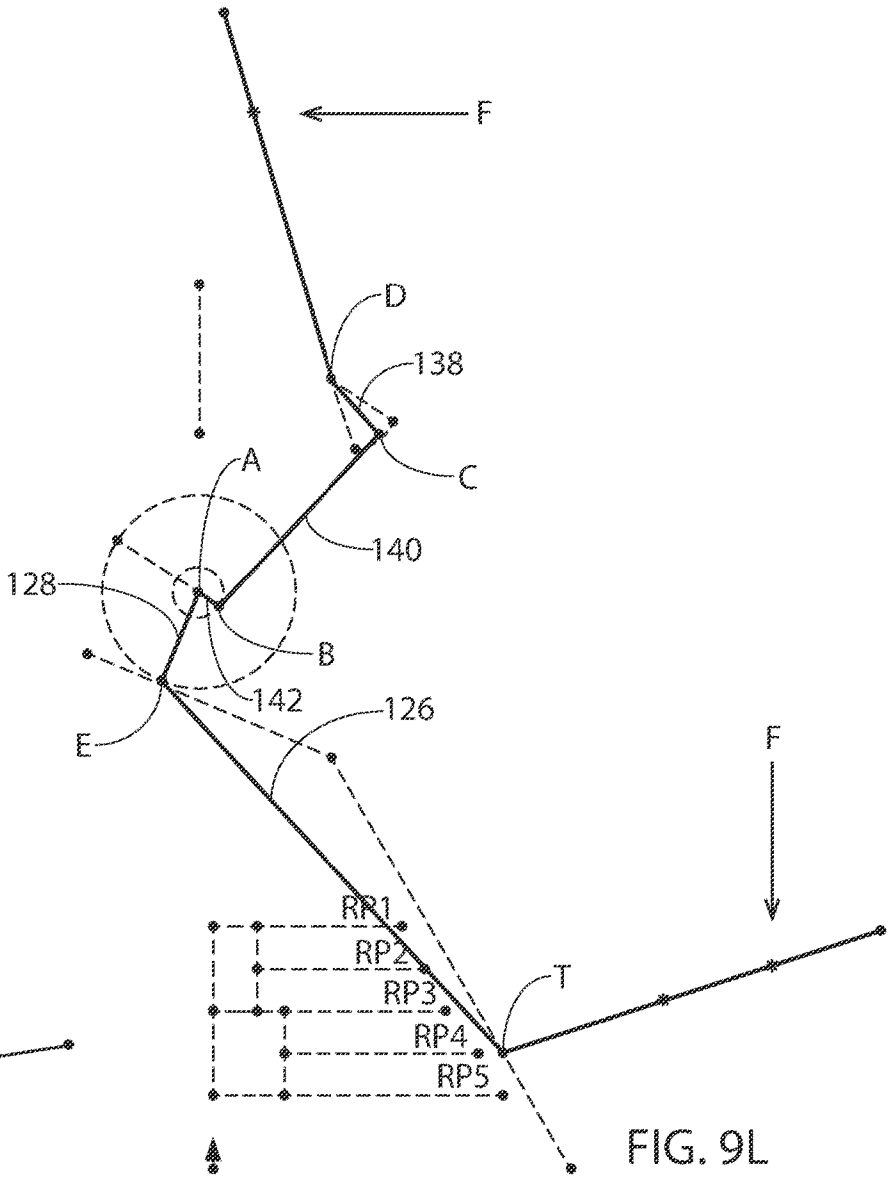
Figure 9K:
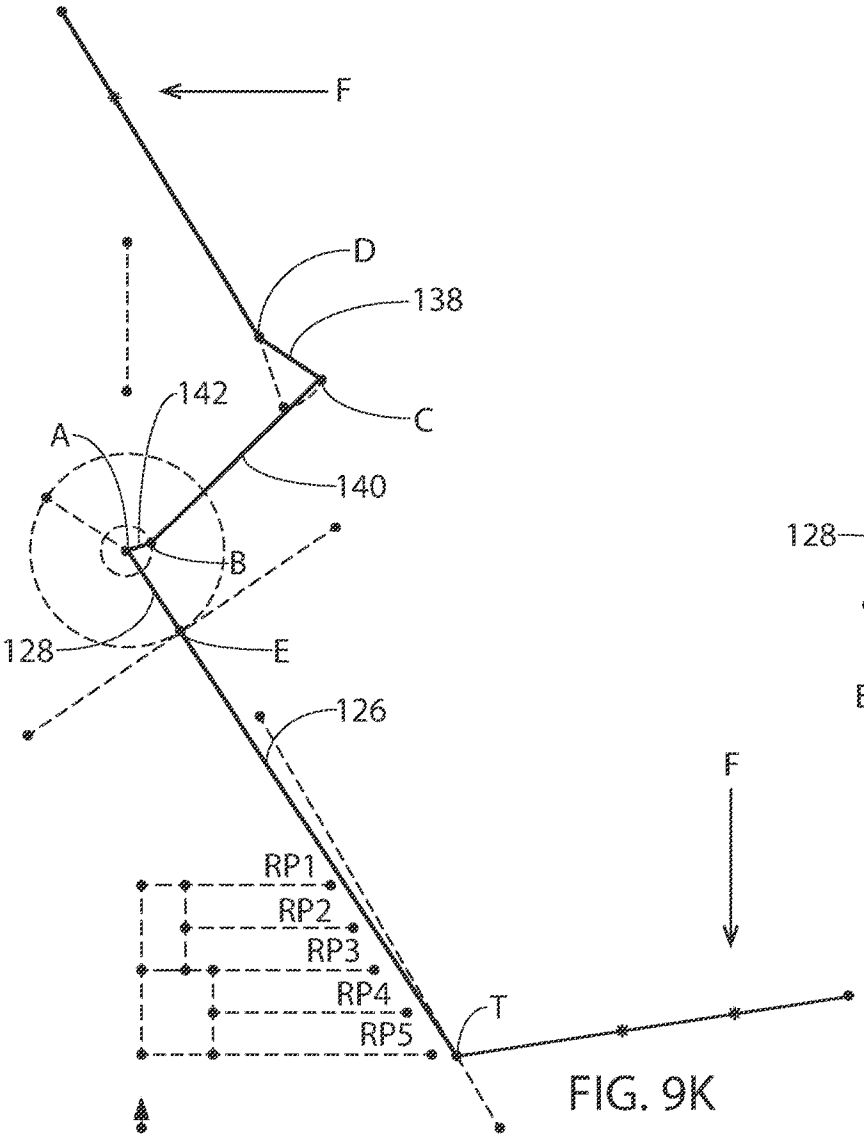
Figure 9N:
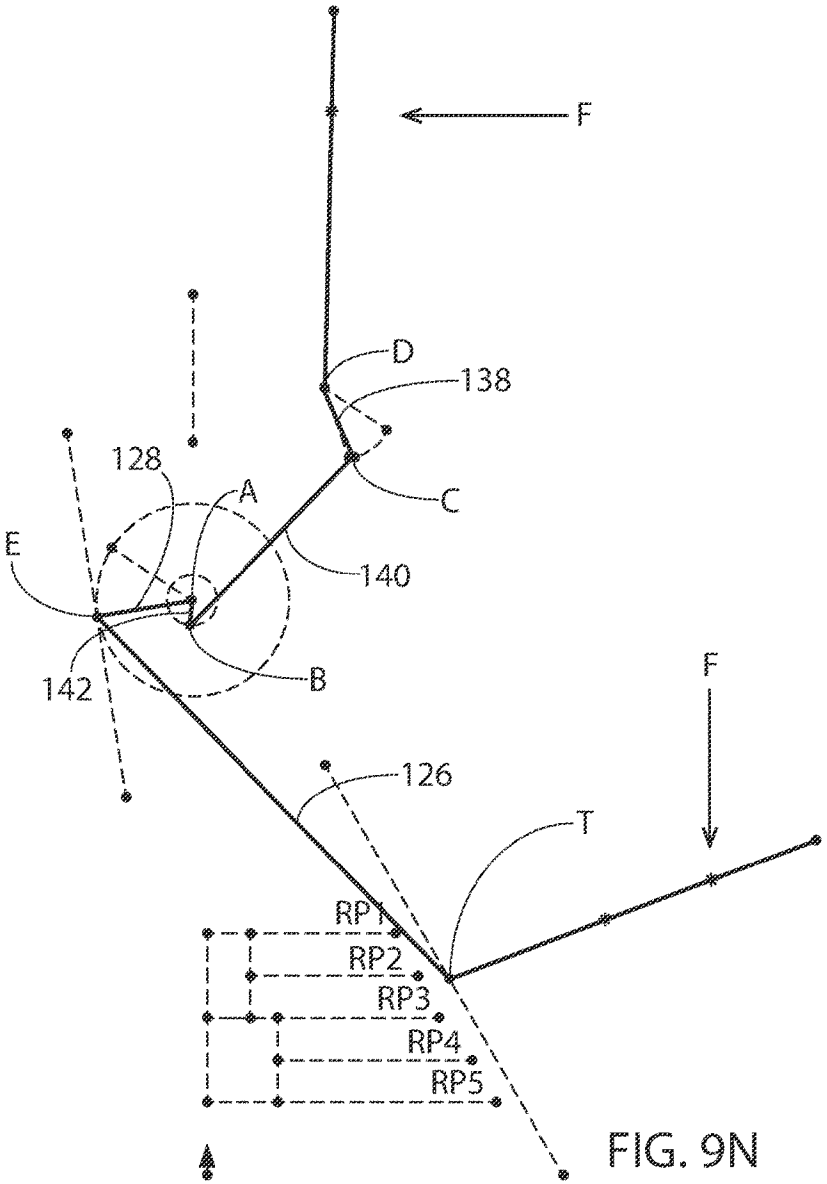
Figure 9M:
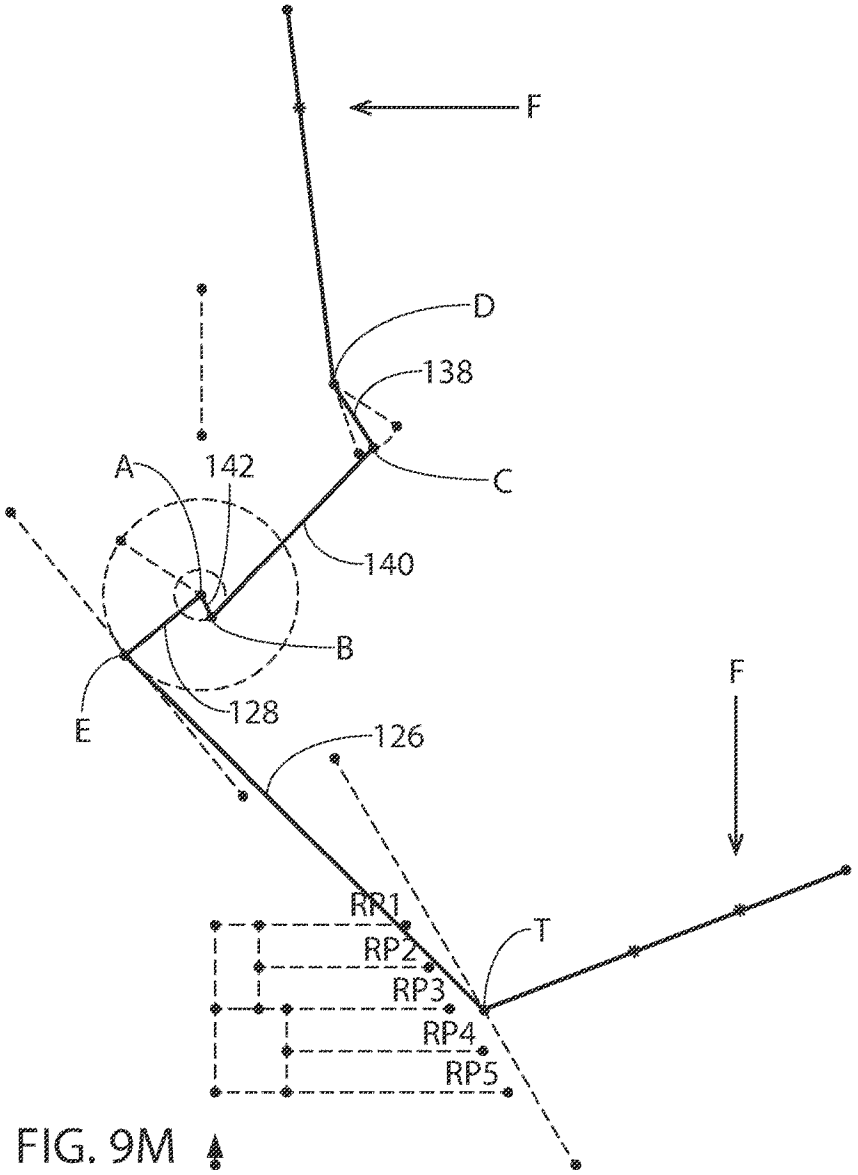

In accordance with various embodiments, the first linkage 90 may be an eccentric linkage. As illustrated in FIG. 9E, the upper reciprocating member 140 drives the eccentric wheel which includes the annular collar 141 and the disk 142. With the disk rotating around axis A as the fixed pivot, the disk center axis B travels around A in a circular path. This path is possible because of the freedom of relative rotational movement between the annular collar 141 and the disk 142. The distance between axis A and axis B is operable as the rotating arm of the linkage. As shown in the diagram illustrated in FIG. 9E, a force F1 is applied to the upper reciprocating member 140. For example, the force may be in the direction shown or opposite the direction shown. If in the direction shown by F1, the upper reciprocating member 140 and the annular collar 141 place a load on disk 142 through axis B. However, as disk 142 is fixed relative to crankshaft 125, which is rotatable around axis A, the load on disk 142 causes a torque to be placed on the crankshaft 125, which is coaxial with axis A. As the force F1 is sufficient to overcome the resistance in crankshaft 125, the disk 142 begins to rotate in direction R1 and the crankshaft begins to rotate in direction R2. With F1 in the opposite direction, R1 and R2 would likewise be in the opposite direction. As illustrated by FIG. 9F, as the cycle continues for the eccentric linkage, the force F1 must change directions in order to continue driving rotation in the direction R1, R2 of the disk 142 and crankshaft 125 respectively.

In accordance with various embodiments, the second mechanical advantage is produced by the combination of components within the second linkage 92. Within the second linkage 92, the pedals 132 pivot around the first and second rollers 30 in response to force being exerted against the first and second lower reciprocating members 126 through the pedals 132. The force on the first and second lower reciprocating members 126 drives the first and second crank arms 128 respectively. The crank arms 128 are pivotably connected at axes E to the first and second lower reciprocating members 126 and fixedly connected to the crankshaft 125 at axis A. As the first and second lower reciprocating members 126 are articulated, the force (e.g. F2 shown in FIGS. 9E, 9F) drives the crank arms 128, which rotate the crankshaft 125 about axis A. FIGS. 9B, 9C, and 9D each show the pedals 132 in different positions with corresponding different positions in the crank arms 128. These corresponding different positions in the crank arms 128 also represent rotation of the crankshaft 125 which is fixedly attached to the crank arms 128. Due to the fixed attachment, the crank arms 128 can transmit input to the crankshaft 125 that the crank arms 128 receive from the first and second lower reciprocating members 126. The crank arms 128 may be fixedly positioned relative to disk 142. As discussed above, the disk 142 may have a virtual crank arm 142*a* which is the portion of the disk 142 extending approximately perpendicular to and between axis B and axis A.

As shown in FIG. 9E, the virtual crank arm 142*a* may be set at an angle of λ from the angle of the crank arm 128 (i.e. the component extending approximately perpendicular to and between axis A and Axis E.) As the disk 142 and the crank arm 128 rotate, for example 90 degrees, the crank arm 128 may stays at the same relative angle to the virtual crank arm 142*a*. The angle λ may be between any angle (i.e. 0-360 degrees). In one example, the angle λ may be between 60° and 90°. In one example, the angle λ may be 75°.

Understanding this exemplary embodiment of linkages 90 and 92, it may be understood that the mechanical advantage of the linkages may be manipulated by altering the characteristics of the various elements. For example, in first linkage 90, the leverage applied by the handles 134 may be established by length of the handles or the location from which the handles 134 receive the input from the user. The leverage applied by the first and second links 138 may be established by the distance from axis D to axis C. The leverage applied by the eccentric linkage may be established by the distance between axis B and axis A. The upper reciprocating member 140 may connect the first and second links 138 to the eccentric linkage (disk 142 and annular collar 141) over the distance from axis C to axis B. The ratio of the distance between axes D and C compared to the distance between axis B and A (i.e. D-C:B-A) may be in one example, between 1:4 and 4:1. In another example, the ratio may be between 1:1 and 4:1. In another example, the ratio may be between 2:1 and 3:1. In another example, the ratio may be about 2.8:1. In one example, the distance from axis D to axis C may be about 103 mm and the distance from axis B to axis A may be about 35 mm. This defines a ratio of about 2.9:1. Similar ratios may apply to the ratio of axis B to axis A compared to axis A to axis E (i.e. B-A:A-E). In various examples, the distance from axis A to axis E may be about 132 mm. In various examples, the distance from either of axes E to one of the respective axes T (i.e. one of the axes around which the roller rotates) is about 683 mm. The distance from E to T may be represented by X as shown in FIG. 9B. While X generally follows the length of the lower reciprocating member, it may be noted as discussed herein that the lower reciprocating member 126 may not be a straight connecting member but may be multiple portions or multiple members with one or more bends occurring intermediately therein as illustrated in FIG. 8, for example.

With reference to FIGS. 9A-9F, the handles 134 provide an input into the crankshaft 125 through the upper linkage. The pedals 132 provide an input into the crankshaft wheel 125 through a second linkage 92. The crankshaft being fixedly connected to the crank wheel 124 causes the two to rotate together relative to each other.

Each handle may have a linkage assembly, including the handle 134, the pivot axis D, the link 138, the upper reciprocating member 140, and the disk 142. Two handle linkage assemblies may provide input into the crankshaft 125. Each handle linkage may be connected to the crankshaft 125 relative to the pedal linkage assembly such that each of the handles 134 reciprocates in an opposite motion relative to the pedals 132. For example, as the left pedal 132 is moving upward and forward, the left handle 134 pivots rearward, and vice versa.

The upper moment-producing mechanism 90 and the lower moment-producing mechanism 92, functioning together or separately, transmit input by the user at the handles to a rotational movement of the crankshaft 125. In accordance with various embodiments, the upper moment-producing mechanism 90 drives the crankshaft 125 with a first mechanical advantage (e.g. as a comparison of the input force to the moment at the crankshaft). The first mechanical advantage may vary throughout the cycling of the handles 134. For example, as the first and second handles 134 reciprocate back and forth around axis D through the cycle of the machine, the mechanical advantage supplied by the upper moment-producing mechanism 90 to the crankshaft 125 may change with the progression of the cycle of the machine. The upper moment-producing mechanism 90 drives the crankshaft 125 with a second mechanical advantage (e.g. as a comparison of the input force at the pedals to the torque at the crankshaft at a particular instant or angle). The second mechanical advantage may vary throughout the cycle of the pedals as defined by the vertical position of the rollers 130 relative to their top vertical and bottom vertical position. For example, as the pedals 132 change position, the mechanical advantage supplied by the lower moment-producing mechanism 92 may change with the changing position of the pedals 132. The various mechanical advantage profiles may rise to a maximum mechanical advantage for the respective moment-producing mechanisms at certain points in the cycle and may fall to minimum mechanical advantages at other points in the cycle, In this respect, each of the moment-producing mechanisms 90, 92 may have a mechanical advantage profile that describes the mechanical effect across the entire cycle of the handles or pedals. The first mechanical advantage profile may be different than the second mechanical advantage profile at any instance in the cycle and/or the profiles may generally be different across the entire cycle. The exercise machine 100 may be configured to balance the user's upper body workout (e.g. at the handles) by utilizing the first mechanical advantage differently as compared to the user's lower body workout (e.g. at the pedals 132) utilizing the second mechanical advantage. In various embodiments, the upper moment-producing mechanism 90 may substantially match the lower moment-producing mechanism 92 at such points where the respective mechanical advantage profiles are near their respective maximums. Regardless of difference or similarities in respective mechanical advantage profiles throughout the cycling of the exercise machine, the inputs to the handles and pedals still work in concert through their respective mechanisms to drive the crankshaft 125.

One example of the structure and characteristics of the exercise machine is provided in the table below and reflected in FIGS. 9G-N. The table represents an embodiment as described below and analyzed as a single linkage such as on one half of a machine (e.g. the left linkage of an exercise machine). The force applied to the handle or the handle force and the force applied to the pedal or the pedal force is shown by arrow F and each of the forces is equal forces. The handle force is applied at a distance about 376 mm from the axis D which locates the force at a position about the middle of the handle grip that a user may typically use. The pedal force is applied to the foot pad at a distance of about 381 mm from the axis T which locates the force at a position about the middle of the foot pad where a user may typically stand. The length from axis D to axis C is about 104 mm. The length from axis B to axis A is about 35 mm. The length from axis A to axis E is about 132 mm. The length from axis E to axis T is about 683 mm. The angle between the member that extends between axis B to axis A and the member that extends between axis A and axis E is about 75°. The exercise machine may include an individual cycle as defined by a full reciprocation of one of the handles, a full rotation of the crankshaft, a full loop of one of the foot pedals, or any other criteria that would indicate a full repetition of the components of the exercise machine. Column 1 below identifies a step in the cycle so as to identify the locations, ranges, and/or changing values of the other attributes in the table. Column 2 identifies positions of the handles relative to the other attributes in the table. Column 3 identifies positions of the roller axis relative to the other attributes in the table. Column 4 identifies the positions of the crankshaft relative to the other attributes as measured from a vertical plane passing through axis A; the angles are measured from 0 to 180° on a first half of the cycle as defined by the crankshaft angle and from −180 to 0° on the second half of the cycle as defined the crankshaft angle. Column 5 identifies the angle between the component that extends between axis D and axis C and the component that extends between axis B and axis C relative to the point in the cycle. Column 6 identifies the angle between the component that extends between axis C and axis B and the component that extends between axis A and axis B relative to the point in the cycle. Column 7 identifies the angle between the component that extends between axis A and axis E and the component that extends between axis T and axis E relative to the point in the cycle. Column 8 identifies the approximate mechanical advantage ratio relative to the point in the cycle. The mechanical advantage ratio is equal to the mechanical advantage in lower moment-producing mechanism 92 divided by the mechanical advantage in the upper moment-producing mechanism 90.

| Machine Cycle Position | Handle Position | Roller position | Crank Arm Angle | DCB angle | CBA angle | AET angle | Mech. Adv. Ratio | FIG. |
|---|---|---|---|---|---|---|---|---|
| 1 | Rear | Proximal Top | −57 | 114 | 0 | −18.3 | N/A | Cycled between FIG. 9N and 9G |
| 2 | Proximal to Rear | Top | −34 | 110 | 20.2 | 0 | N/A | FIG. 9G |
| 3 | Proximal to Middle | Top Mid. | 31 | 88.3 | 80.7 | 55.1 | .86 | FIG. 9H |
| 4 | Forward Mid. | Middle | 62 | 79.0 | 112.0 | 84.4 | 1.05 | FIG. 9I |
| 5 | Proximal to Forward | Bottom Mid. | 91 | 73.3 | 144 | 115.3 | 1.38 | FIG. 9J |
| 6 | Forward | Proximal to Bottom | 123 | 73.0 | 180 | 152 | N/A | Cycled between FIG. 9J and 9K |
| 7 | Proximal to Forward | Bottom | 147 | 77.6 | 154 | 180 | N/A | FIG. 9K |
| 8 | Proximal to Middle | Bottom Mid. 2 | −158 | 95.5 | 95.8 | 115.3 | .63 | FIG. 9L |
| 9 | Mid. Rear | Middle 2 | −129 | 105.3 | 67.1 | 84.4 | .83 | FIG. 9M |
| 10 | Proximal to Rear | Top Mid. 2 | −99 | 112.7 | 38.2 | 55.1 | 1.2 | FIG. 9N |

In accordance with various embodiments, the rollers may travel along the incline members from a bottom position to a top position and back down. The full round trip of the rollers may account for a cycle of the exercise machine. As shown in FIGS. 9G-9N, the rollers may have vertical positions along the incline member as indicated by RP1, RP2, RP3, RP4, and RP5. RP1 corresponds to the top vertical position of the roller also reflected in the table above. RP2 corresponds to the top middle vertical position of the roller also reflected in the table above. RP3 corresponds to the middle vertical position of the roller also reflected in the table above. RP4 corresponds to the bottom middle vertical position of the roller also reflected in the table above. RP5 corresponds to the bottom vertical position of the roller also reflected in the table above. During a single cycle, the roller may be positioned at RP2, RP3, and RP4 each twice, once on the way down and once on the way up, thus forming eight example positions. Each of these positions may also be accounted for by crankshaft angle as measured off the vertical and also relative position of the handle as shown in the table above. It may be noted that an infinite number of positions exist in each cycle, but these positions are shown as mere examples.

The power band of the cycle may be defined as the range in the cycle of the exercise machine in which the moment-producing mechanisms (e.g. upper moment-producing mechanism 90 and lower moment-producing mechanism 92) obtain their respective maximum mechanical advantages. Stated another way, the moment-producing mechanisms are outside of their respective dead zones, the dead zones being the range of the cycle in which the moment goes to zero. In these dead zones, the ratio between the upper moment-producing mechanism 90 and lower moment-producing mechanism 92 decreases in its usefulness as the ratio may approach zero or infinity. Each cycle may have a plurality of power bands. The cycle may have one power band, two power bands, three power bands, four power bands, or more. For example, if there are four different linkages (e.g. two upper linkages and two lower linkages) and each linkage has two dead zones different from the other linkages, in a cycle there may be eight power bands existing between each of those dead zones. In another example, if there are four different linkages (e.g. two upper linkages and two lower linkages) and the dead zones of some linkages are the same (e.g. the upper linkages are the same and the lower linkages are the same) and the dead zones of the opposing linkages (e.g. upper linkages versus lower linkages) are different but still close together, then there may not be a power band between the dead zones of the opposing linkages. Linkages on opposite sides of the machine (e.g. left versus right side) may have identical mechanical advantage profiles but be 180 degrees out of phase, thus having dead zones at the same time but from different parts of the cycle.

In accordance with one example, the table and FIGS. 9G-9N show an example of two linkages from the same side of an exercise machine. The exercise machine may have an angular power band between 0° and 110° in one half of the cycle and 155° to 180° and −180° to −70° in the other half of the cycle as defined by the angle of the crankshaft beginning with the crank arm in a vertical position. The converse of this is that the dead zones may exist from 110° to 155° and −70° to 0° of the crankshaft. These power bands for the cycle may be similarly described in terms of roller vertical position or handle position. For example, the exercise machine may have a power band as defined by the roller from the upper middle roller position (e.g. RP2) to the lower middle roller position (e.g. RP4). In another example, the exercise machine may have a power band as defined by the handle from the forward middle handle position to the rear middle handle position.

In accordance with various embodiments, the upper moment-producing mechanism 90 and the lower moment-producing mechanism 92 provide a mechanical advantage ratio of between about 0.6 and 1.4 in a power band of the cycle as defined by roller position. In various examples, the upper moment-producing mechanism 90 and the lower moment-producing mechanism 92 provide a mechanical advantage ratio of between about 0.8 and 1.1 in response to the roller being located at its midpoint of vertical travel during the cycle.

In accordance with various embodiments, the lower moment-producing mechanism 92 (e.g. the first and second lower linkages) may produce a maximum mechanical advantage on the crankshaft in response to being in a power band of the cycle. In accordance with various embodiments, the upper moment-producing mechanism 90 (e.g. first and second upper linkages) may produce a maximum mechanical advantage on the crankshaft in response to being in a power band of the cycle.

In accordance with various embodiments, the angle between the component (e.g. the upper links 138) that extends between axis D and axis C and the component (e.g.

the upper reciprocating links 140) that extends between axis B and axis C may be from about 70° to 115° throughout the cycle. In various examples, this angle may between 80° and 100° in response to the first and second handles being proximate to the midpoint of their travel. In various examples, this angle may be between about 80° and 105° in response to the respective first and second rollers being at about the midpoint of their travel which is approximately the location in which the lower linkage has maximum mechanical advantage on the crankshaft. In various examples, this angle may between 80° and 100° in response to the exercise machine being within the power band of its cycle.

The angle between the component (e.g. the upper reciprocating member) that extends between axis C and axis B and the component (e.g. the virtual crank arm) that extends between axis A and axis B may be from about 0° to 180° throughout the cycle. In various examples, this angle may between 65° and 115° in response to at least one of the respective first and second rollers being at about the midpoint of their travel, the first and second lower linkages producing a maximum mechanical advantage on the crankshaft, the first and second handles being proximate to the midpoint of their travel, or the exercise machine being within the power band of its cycle.

The angle between the component (e.g. the crank arm) that extends between axis A and axis E and the component (e.g. the lower reciprocating member) that extends between axis T and axis E may be from −20° to 165° throughout the cycle. In various examples, this angle may be between 80° and 100° in response to at least one of the respective first and second rollers being at about the midpoint of their travel, the first and second lower linkages producing a maximum mechanical advantage on the crankshaft, the first and second handles being proximate to the midpoint of their travel, or the exercise machine being within the power band of its cycle. As shown in FIG. 10, the machine 100 can further include a user interface 102 mounted near the top of the upper support member 120. The user interface 102 can include a display to provide information to the user, and can include user inputs to allow the user to enter information and to adjust settings of the machine, such as to adjust the resistance. The machine 100 can further include stationary handles 104 mounted near the top of the upper support member 120.

The resistance mechanisms as variously discussed herein may be operatively connected to the crankshaft 125 such that the resistance mechanism resists the combined moments provided at the crankshaft from the upper moment-producing mechanism 90 and the lower moment-producing mechanism 92. The crank wheels 124 can be coupled to one or more resistance mechanisms directly or through the crankshaft 125 to provide resistance to the reciprocation motion of the pedals 132 and handles 134. For example, the one or more resistance mechanisms can include an air-resistance based resistance mechanism 150, a magnetism based resistance mechanism 160, a friction based resistance mechanism, and/or other resistance mechanisms. One or more of the resistance mechanisms can be adjustable to provide different levels of resistance at a given reciprocation frequency. Further, one or more of the resistance mechanisms can provide a variable resistance that corresponds to the reciprocation frequency of the exercise machine, such that resistance increases as reciprocation frequency increases.

As shown in FIGS. 8-10, the machine 100 can include an air-resistance based resistance mechanism, or air brake, 150 that is rotationally mounted to the frame 112 on an horizontal shaft 166, and/or a magnetism based resistance mechanism, or magnetic brake, 160, which includes a rotor 161 rotationally mounted to the frame 112 on the same horizontal shaft 166 and brake caliper 162 also mounted to the frame 112. The air brake 150 and rotor 161 are driven by the rotation of the crank wheels 124. In the illustrated embodiment, the shaft 166 is driven by a belt or chain 148 that is coupled to a pulley 146. Pulley 146 is coupled to another pulley 125 mounted coaxially with the axis A by another belt or chain 144. The pulleys 125 and 146 can be used as a gearing mechanism to set the ratio of the angular velocity of the air brake 150 and the rotor 161 relative to the reciprocation frequency of the pedals 132 and handles 134. For example, one reciprocation of the pedals 132 can cause several rotations of the air brake 150 and rotor 161 to increase the resistance provided by the air brake 150 and/or the magnetic brake 160.

The air brake 150 can be similar in structure and function to the air brake 50 of the machine 10 and can be similarly adjustable to control the volume of air flow that is induced to flow through the air brake at a given angular velocity.

Figure 11:
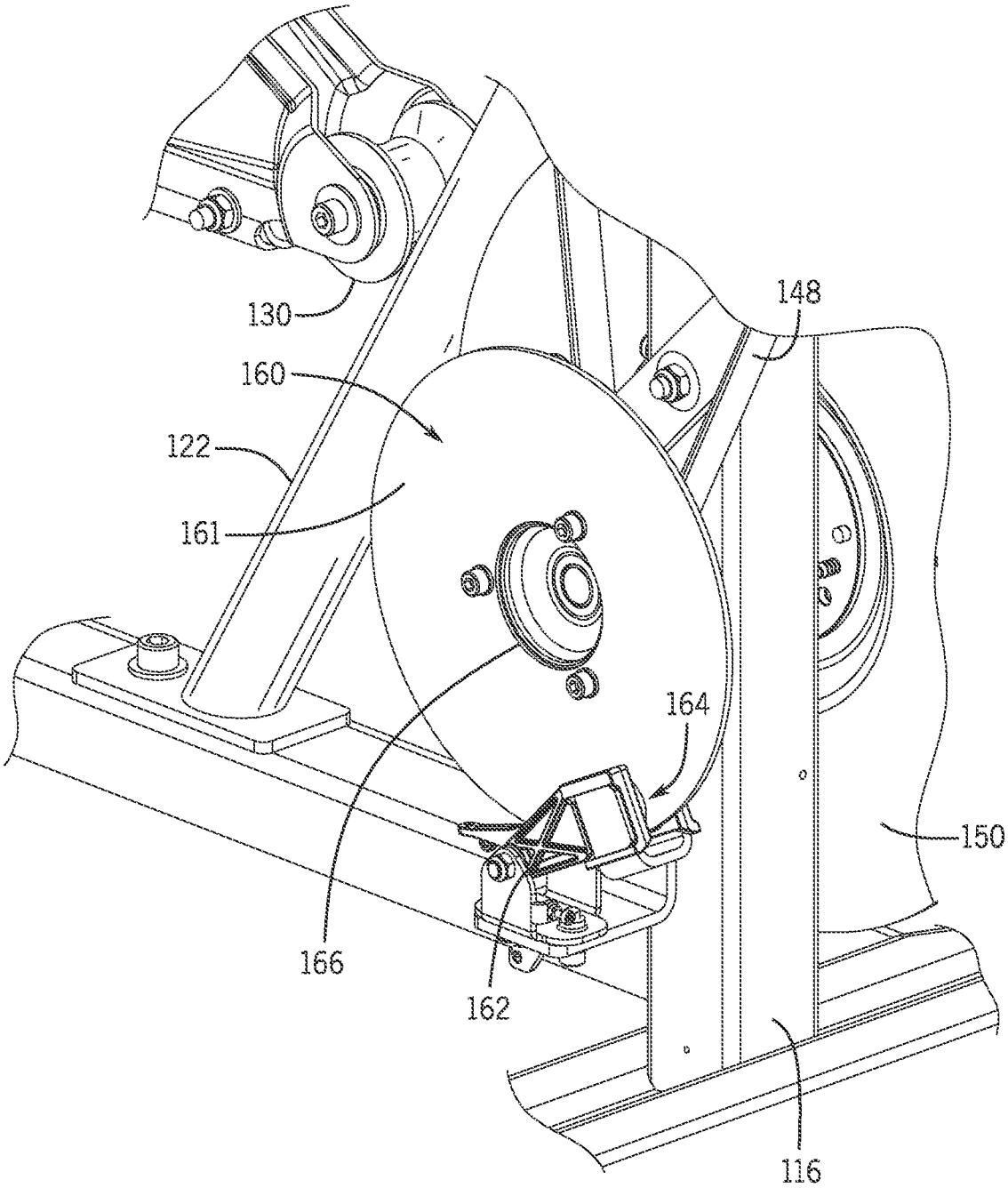
FIG. 11 is a perspective view of a magnetic brake of the machine of FIG. 8.

The magnetic brake 160 provides resistance by magnetically inducing eddy currents in the rotor 161 as the rotor rotates. As shown in FIG. 11, the brake caliper 162 includes high power magnets 164 positioned on opposite sides of the rotor 161. As the rotor 161 rotates between the magnets 164, the magnetic fields created by the magnets induce eddy currents in the rotor, producing resistance to the rotation of the rotor. The magnitude of the resistance to rotation of the rotor can increase as a function of the angular velocity of the rotor, such that higher resistance is provided at high reciprocation frequencies of the pedals 132 and handles 134. The magnitude of resistance provided by the magnetic brake 160 can also be a function of the radial distance from the magnets 164 to the rotation axis of the shaft 166. As this radius increases, the linear velocity of the portion of the rotor 161 passing between the magnets 164 increases at any given angular velocity of the rotor, as the linear velocity at a point on the rotor is a product of the angular velocity of the rotor and the radius of that point from the rotation axis. In some embodiments, the brake caliper 162 can be pivotably mounted, or otherwise adjustable mounted, to the frame 116 such that the radial position of the magnets 134 relative to the axis of the shaft 166 can be adjusted. For example, the machine 100 can include a motor coupled to the brake caliper 162 that is configured to move the magnets 164 to different radial positions relative to the rotor 161. As the magnets 164 are adjusted radially inwardly, the linear velocity of the portion of the rotor 161 passing between the magnets decreases, at a given angular velocity of the rotor, thereby decreasing the resistance provided by the magnetic brake 160 at a given reciprocation frequency of the pedals 132 and handles 134. Conversely, as the magnets 164 are adjusted radially outwardly, the linear velocity of the portion of the rotor 161 passing between the magnets increases, at a given angular velocity of the rotor, thereby increasing the resistance provided by the magnetic brake 160 at a given reciprocation frequency of the pedals 132 and handles 134.

In some embodiments, the brake caliper 162 can be adjusted rapidly while the machine 10 is being used for exercise to adjust the resistance. For example, the radial position of the magnets 164 of the brake caliper 162 relative to the rotor 161 can be rapidly adjusted by the user while the user is driving the reciprocation of the pedals 132 and/or handles 134, such as by manipulating a manual lever, a button, or other mechanism positioned within reach of the user's hands, illustrated in FIG. 10, while the user is driving the pedals 132 with his feet. Such an adjustment mechanism can be mechanically and/or electrically coupled to the magnetic brake 160 to cause an adjustment of eddy currents in the rotor and thus adjust the magnetic resistance level. The user interface 102 can include a display to provide information to the user, and can include user inputs to allow the user to enter to adjust settings of the machine, such as to adjust the resistance. In some embodiments, such a user-caused adjustment can be automated, such as using a button on the user interface 102 that is electrically coupled to a controller and an electrical motor coupled to the brake caliper 162. In other embodiments, such an adjustment mechanism can be entirely manually operated, or a combination of manual and automated. In some embodiments, a user can cause a desired magnetic resistance adjustment to be fully enacted in a relatively short time frame, such as within a half-second, within one second, within two seconds, within three second, within four seconds, and/or within five seconds from the time of manual input by the user via an electronic input device or manual actuation of a mechanical device. In other embodiments, the magnetic resistance adjustment time periods can be smaller or greater than the exemplary time periods provided above.

Figure 12:
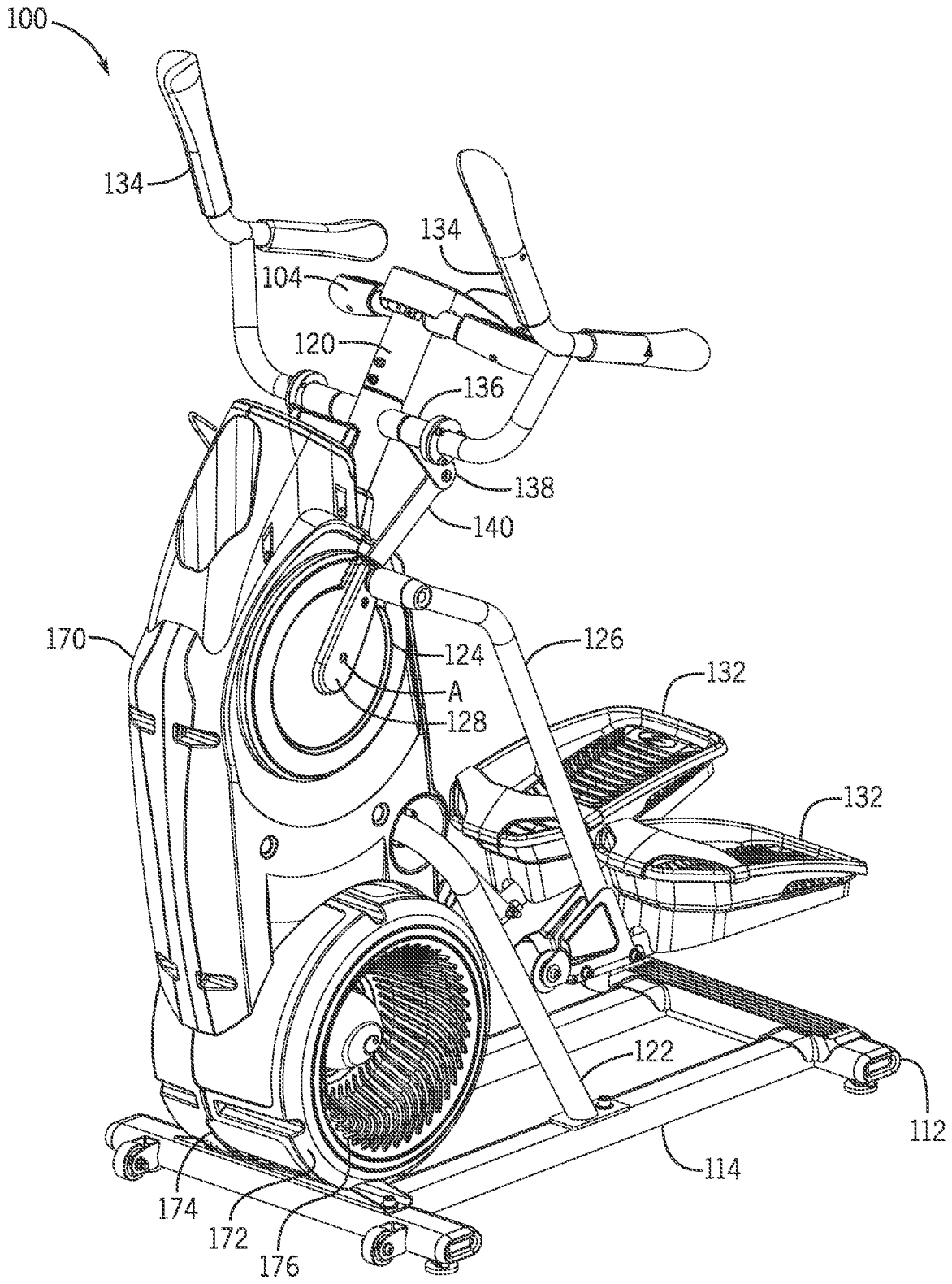
FIG. 12 is a perspective view of an embodiment of the machine of FIG. 8 with an outer housing included.
Figure 13:
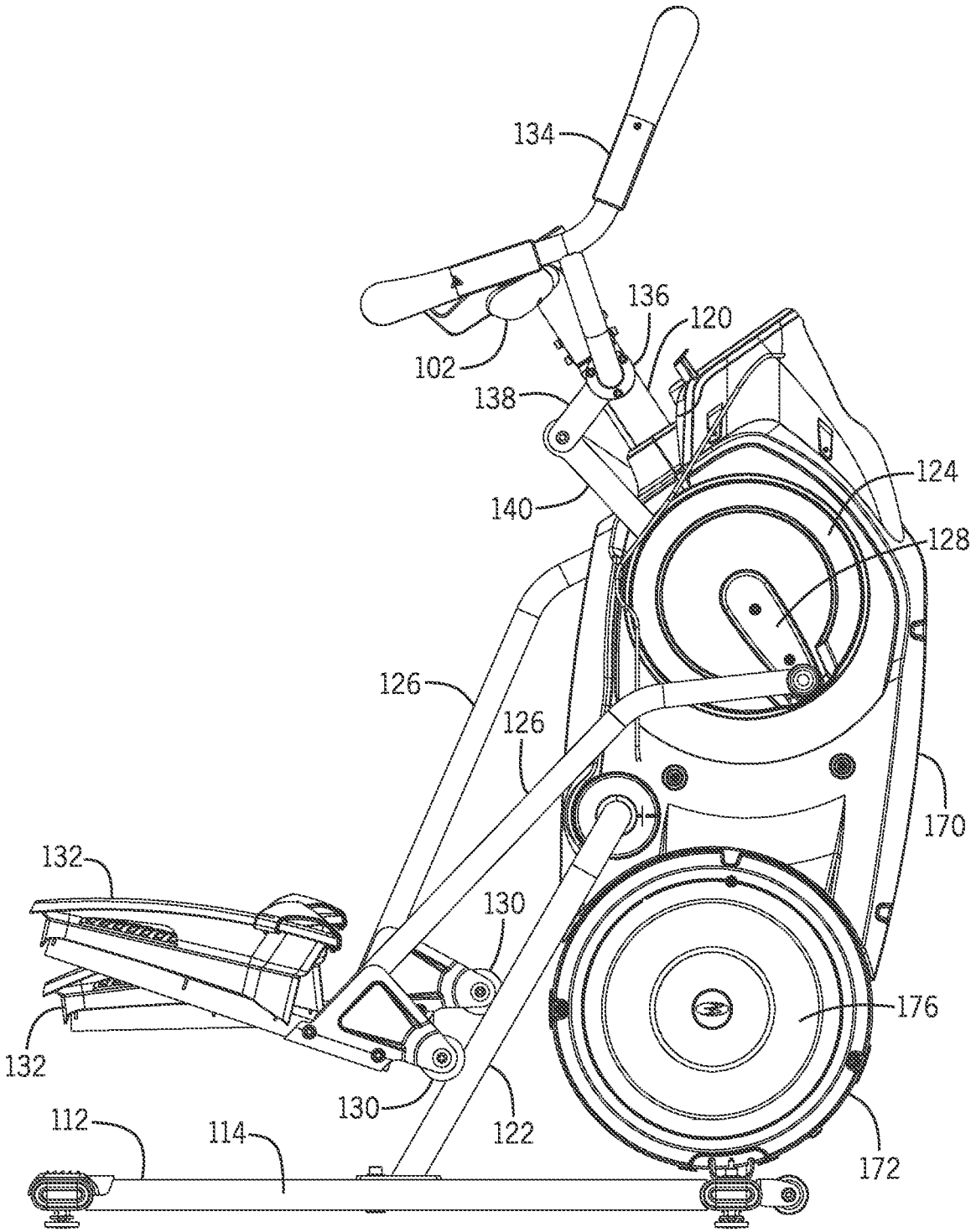
FIG. 13 is a right side view of the machine of FIG. 12.
Figure 14:
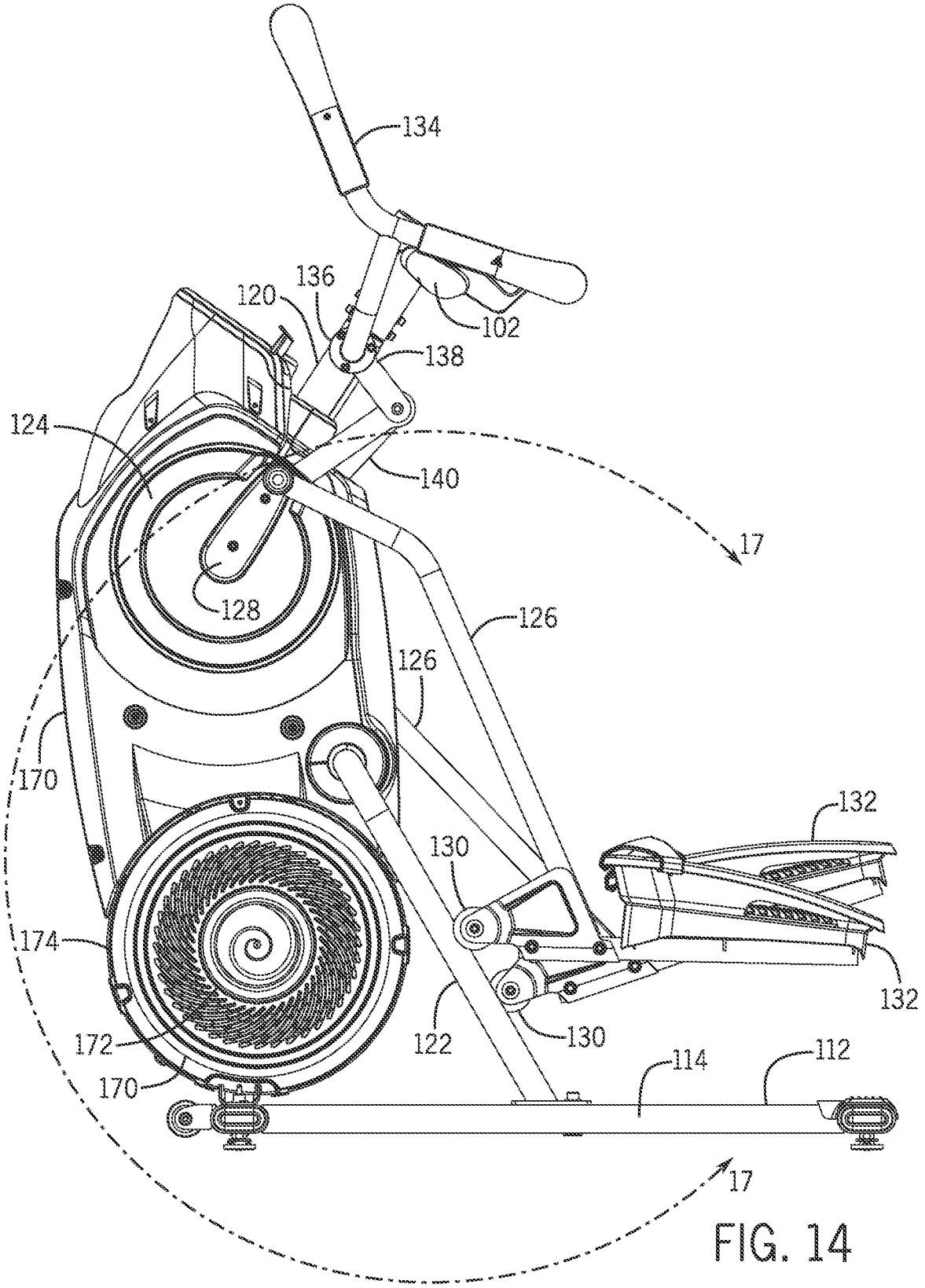
FIG. 14 is a left side view of the machine of FIG. 12.
Figure 15:
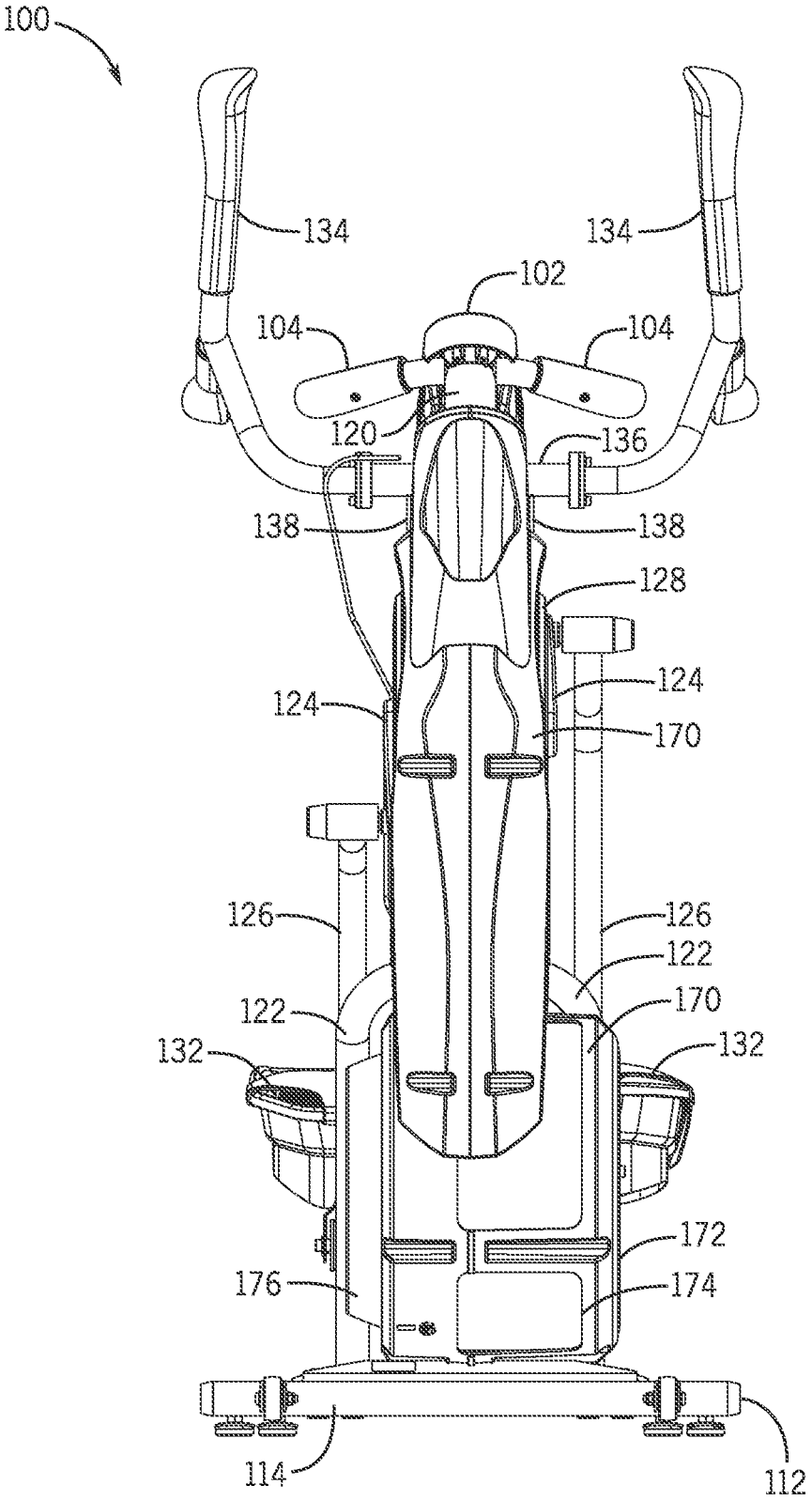
FIG. 15 is a front view of the machine of FIG. 12.
Figure 16:
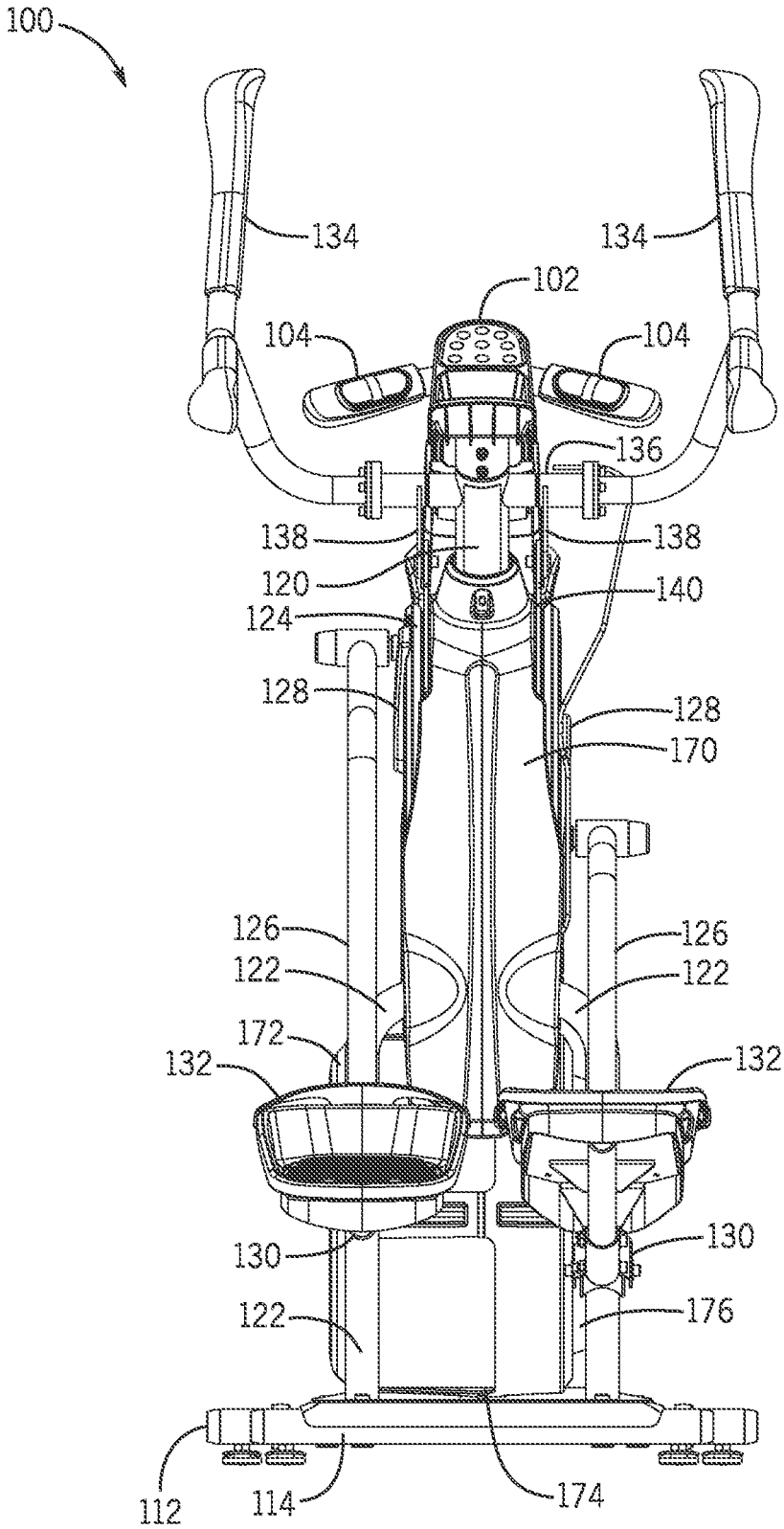
FIG. 16 is a rear view of the machine of FIG. 12.

FIGS. 12-16 show an embodiment of the exercise machine 100 with an outer housing 170 mounted around a front portion of the machine. The housing 170 can house and protect portions of the frame 112, the pulleys 125 and 146, the belts or chains 144 and 148, lower portions of the upper reciprocating members 140, the air brake 150, the magnetic brake 160, motors for adjusting the air brake and/or magnetic brake, wiring, and/or other components of the machine 100. As shown in FIGS. 12, 14, and 15 the housing 170 can include an air brake enclosure 172 that includes lateral inlet openings 176 to allow air into the air brake 150 and radial outlet openings 174 to allow air out of the air brake. As shown in FIGS. 13 and 15, the housing 170 can further include a magnetic brake enclosure 176 to protect the magnetic brake 160, where the magnetic brake is included in addition to or instead of the air brake 150. The crank arms 128 and crank wheels 124 can be exposed through the housing such that the lower reciprocating members 126 can drive them in a circular motion about the axis A without obstruction by the housing 170.

FIGS. 18A-G illustrate various views of one example of the exercise machine. In the example shown in FIGS. 18A-G, the exercise machine may be a generally upright device that occupies a small amount of floor space due to the generally vertical nature of the machine as a whole. As respectively shown, FIGS. 18A-G depict an example isometric, front, back, left, right, top, and bottom view of the exercise machine. Each of these views also depicts ornamental aspects of the exercise machine.

A further embodiment of the exercise machine 310 is shown in FIGS. 19 through 23. Many of the structural features and functions are the same or similar to those shown and described with respect to embodiments described herein, including with respect to FIGS. 1 through 7, and with respect to FIGS. 8, 9A, 9B and 10. Common elements between the embodiments may be referenced by the same or different name and by the same or different reference number.

Figure 19:
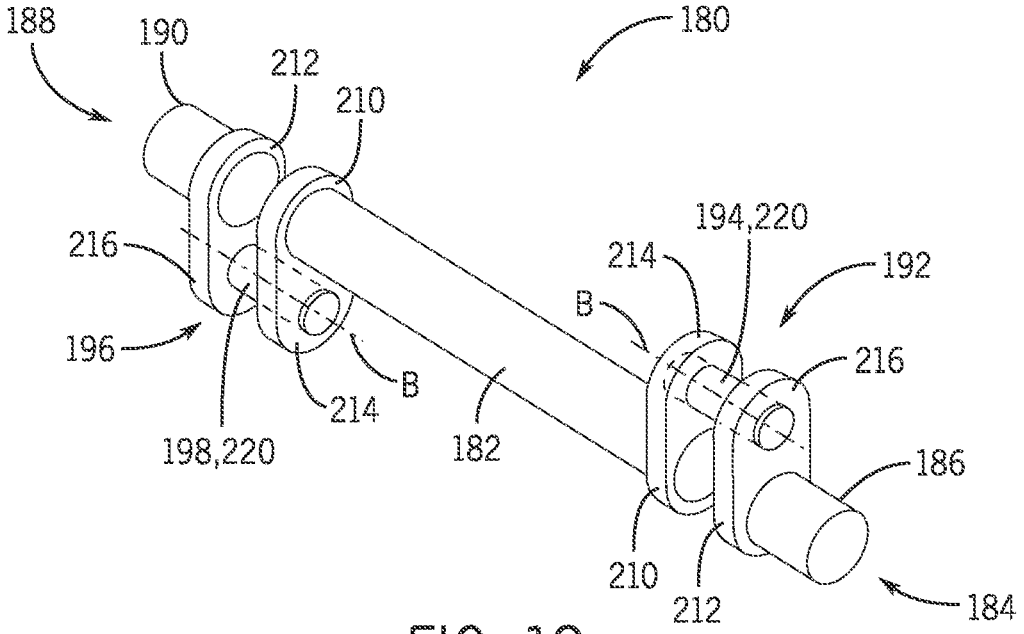
FIG. 19 is a perspective view of an exemplary drive member.
Figure 20:
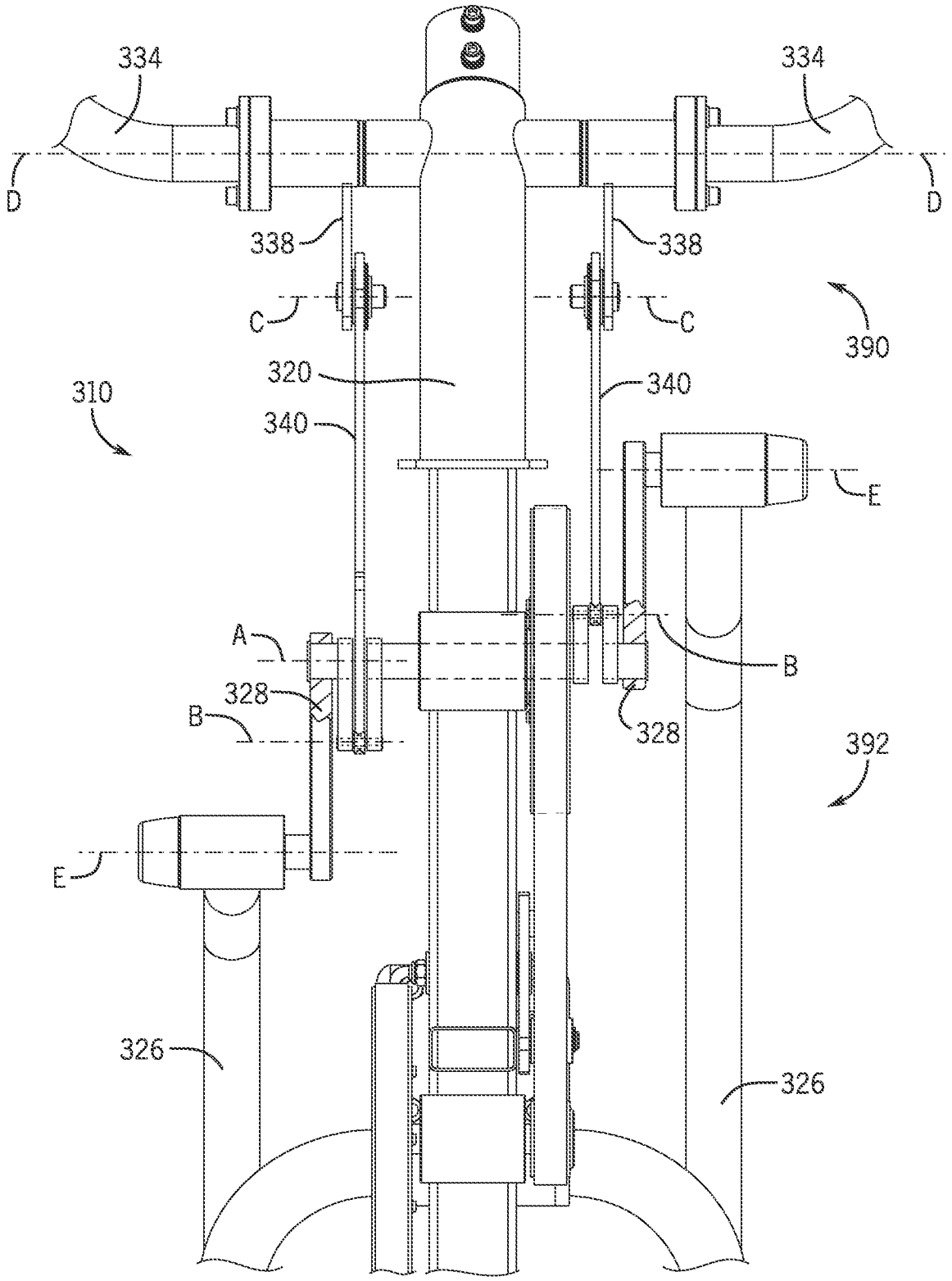
FIG. 20 is an enlarged, fragmentary front view of an exemplary embodiment of an exercise machine incorporating the drive member of FIG. 19.
Figure 21:
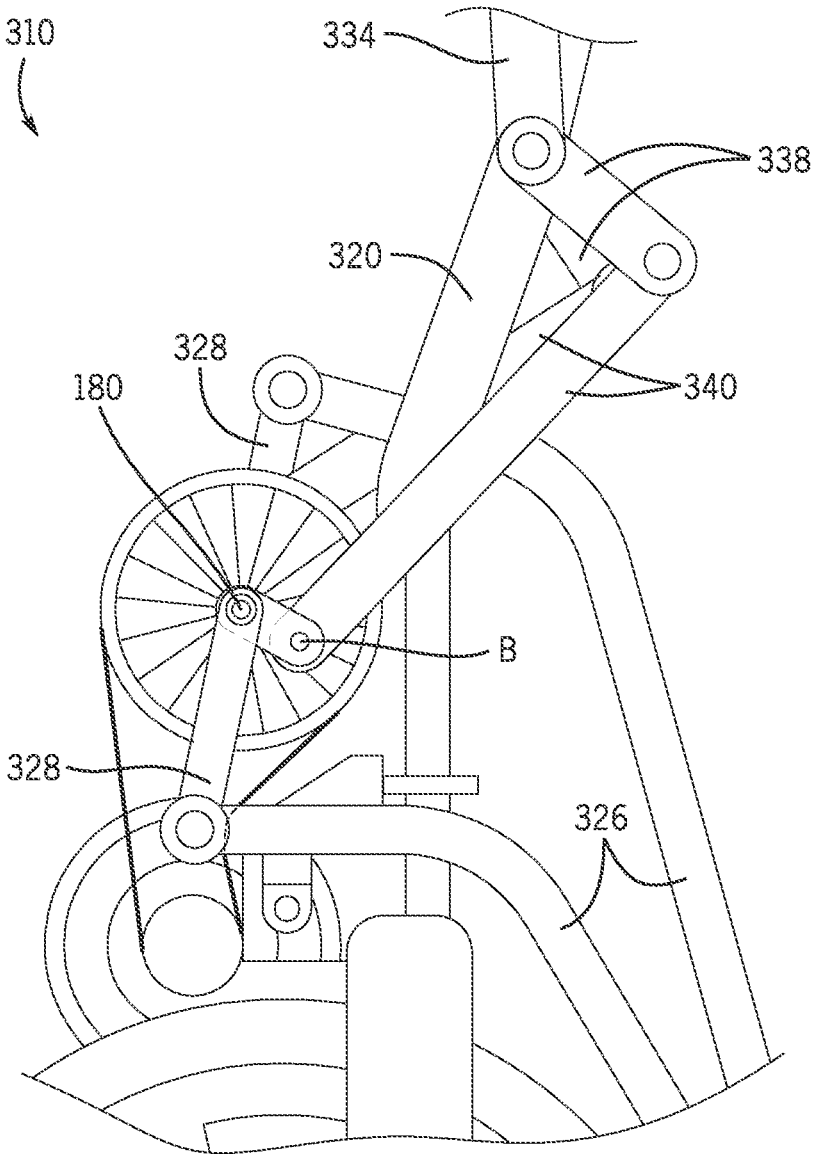
FIG. 21 is an enlarged, fragmentary left side view of the machine of FIG. 20.

In this further embodiment, and referring to FIGS. 19 through 21, a drive mechanism 180 operatively associates and inter-engages the upper moment-producing mechanism 390 and the lower moment-producing mechanism 392 to create a respective first and second mechanical advantage similar to or the same as the described herein with respect to the embodiment shown in FIGS. 8, 9A, 9B, and 10. The drive mechanism 180 of this further embodiment allows for the same or similar application of rotational moment to the crank axis as described in various other embodiments herein. In this further embodiment, the virtual crank arms 142*a* are formed by an eccentric mechanism formed by the certain elements of the drive mechanism 180.

Referring specifically to FIG. 19, the drive mechanism 180 is a longitudinally extending structure made from suitable materials, such as metal or the like, and defines a plurality of sections or portions along its length. The drive mechanism 180 may include a central portion or crank shaft 182, first and second outer end portions 184, 188, and first and second offset portions 192, 196. For increased strength, the drive mechanism 180 may be monolithically formed as an integral one-piece structure in some embodiments. The first outer end portion 184 may include a first connection member 186, and the second outer end portion 188 may include a second connection member 190. The first offset portion 192 may include a third connection member 194 defining a rotation axis. The third connection member 194 is operatively associated with the crank shaft 182 and the first connection member 186, and in one example is positioned between the first outer end portion 184 and the crank shaft 182. The second offset portion 196 may include a fourth connection member 198 defining a rotation axis. The second offset portion 196 is operatively associated with the crank shaft 182 and the second connection member 190, and in another example is positioned between the second outer end portion 188 and the crank shaft 182. At least part of the length of the crank shaft 182 is linear such that when rotated it defines a rotational axis or a crank axis. The outer end portions 184, 188 are at least partially linear, and aligned with the central portion 182 such that when rotated, each of the first and second connection members 186, 190 rotate about and define a rotation axis that coincides with the crank axis, including aligning coextensively with the crank axis.

With continued reference to FIG. 19, each of the first and second offset portions 192, 196 may be attached to the crank shaft 182. In one example, each of the first and second offset portions 192, 196 may extend away from the crank axis (e.g., diametrically from the crank axis) such that the rotation axis defined by each of the third and fourth connection members 194, 198 is parallel to and offset from the crank axis. In some embodiments, the first and second offset portions 192, 196 may extend away from the crank axis an equal distance, or in some examples may extend away from the crank axis different distances depending on the desired characteristics of the drive mechanism 180. Additionally, each offset portion 192, 196 may include an inner plate 210 spaced apart from an outer plate 212. Each inner plate 210 extends radially away from the crank axis with a proximal end fixed to an end of the central portion 182 and a distal end 214 coupled to its respective connection member 194, 198, the distal end 214 being considered a free end portion. Each outer plate 212 extends radially away from the crank axis with a proximal end fixed to an end of a respective outer end portion 184, 188, and a distal end 216 coupled to its respective connection member 194, 198, the distal end 216 being considered a free end portion. Each third and fourth connection member 194,198 extends between and is fixed (such as by press-fitting or welding) to the distal ends 214, 216 of each of its respective inner 210 and outer 212 plates. Each third and fourth connection member 194, 198 is spaced away from (the same or different distances) and may extend parallel with the crank axis, and in one example is circular in cross section along part of its length. Each third and fourth connection member 194, 198 may take the form of a shaft or the like that in part forms a bearing surface 220 around which a component is rotatably coupled, and through which a rotational axis extends. Each pair of plates 210, 212 may be positioned parallel or non-parallel to one another, and may extend orthogonally or non-orthogonally relative to the crank axis. The plate members 210, 212 may be similarly shaped to one another, or may have different shapes. The various components of the drive mechanism 180 described above may be secured together in a manner to create an integrally-formed one-piece structure having sufficient strength to resist bending forces applied along its length, whether or not through the crank axis. In one example of an alternative embodiment, the offset portions 192, 196 may include longitudinal extensions of the central portion 182 bent to form offset portions 192, 196 defining a bearing surface 220 spaced away from and extending parallel to the crank axis, and bent to form the outer end portions 184, 188. Such an alternative may provide a cost benefit in producing the drive mechanism 180. The drive mechanism 180 utilizing plates 210, 212 for the offset portions 192, 196 may be more expensive to produce because of the number of parts and required assembly steps, but provide a likely stronger structure with more efficient spacing and a tighter tolerance for rotational alignment, resulting in an overall shorter and higher-quality drive mechanism 180.

The upper moment-producing mechanism 390 of FIGS. 19 and 20 may include a first upper linkage and/or a second upper linkage corresponding to a left and right side of machine 310. The first and second upper linkages may include one or more of first and second handles 334, and/or first and second upper reciprocating members 340, respectively. The first and second upper linkages are operably associated with the drive mechanism 180, and operably transmit a force input by the user's movement of one or both of the handles 334 to the drive mechanism 180, and create a moment force about a crank axis (also referred to herein as crank axis A), which creates the first mechanical advantage. The first and second linkages may be eccentric linkages as noted below.

In more detail, and with continuing reference to FIGS. 19 and 20, the first and second handles 334 may be supported by the upper support structure 320 of the frame 312 and rotate about a handle axis, for example axis D. The first and second handles 334 are rotatably coupled to the first and second reciprocating members 340, respectively. In one example, a first portion of each of the reciprocating members 340, such as an end portion, is operably associated with a connection portion 338 of a corresponding handle 334, such as by a pivotal connection, so as to be rotatably coupled to the respective handle 334. Each of the reciprocating members 340 rotates relative to the connection portion 338 of the respective handle 334 about a reciprocating axis, similar to or the same as axes C described herein. Rotation of the handles 334 about the handle axis D causes corresponding rotation of each of the connection portions 338 (one on each handle 334) about the handle axis D. The connection portion 338 of each handle 334 to which the first portion of each reciprocating member is respectively attached may be a lever or extension member extending away from the handle 334, allowing the reciprocating axis to be positioned along the length of the lever members and be spaced away from the handle axis D. In this instance, when the handles 334 are rotated about the handle axis D, each reciprocating axis (and the first portion of each reciprocating member 340) moves about the handle axis D, such as in an orbital or circumferential manner. Each of the lever members may define more than one position for the respective reciprocating axis, allowing the adjustment of the radial location of each of the reciprocating axes relative to the handle axis D, and thus the length and curvature of the arc defined by the movement of each reciprocating axis (see FIG. 21). This in turn affects the length and curvature of the arc through which the first end of each reciprocating member 340 moves. Where the connection portions 338 are lever members, each lever member forms an angle ω with the respective handles, as described elsewhere herein.

Referring still to FIGS. 19 and 20, second portions of the upper reciprocating members 340, such as second end portions opposite the first end portions, are rotatably coupled, such as by a pivot or journaled connection, to the first and second offset portions 192, 196, respectively, forming first and second respective rotation axes, such axes being the same or similar to axes B described elsewhere herein. Each of the first and second rotation axes B may be offset radially from the crank axis A, and may be parallel to the crank axis A. The first and second rotation axes B may be spaced away from the crank axis A in radially opposite directions, or in radial directions defining an angle of less than 180 degrees. Each rotation axis B may be located proximal to an end of each of the upper reciprocating members 340. Each rotation axis B may also be located proximal to a free end 214, 216 of the offset portion 192, 196. Each rotation axis B may also be referred to herein as an offset axis B. Each respective offset portion 192, 196 may be perpendicular to the crank axis A and each of the rotation axes B, respectively. The distance between the crank axis A and each of the rotational axes B may define approximately the length of the offset portion 192, 196. The offset portions 192, 196 are each an embodiment of the virtual crank arm, for example such as virtual crank arm 142*a*, as described herein.

As indicated above, the first and second reciprocating members 340 may be rotatably coupled to the third and fourth connection members 194, 198, respectively, to rotate about the rotation axis B defined by its respective connection member 194, 198. In one example, the second ends of each of the upper reciprocating members 340 may be rotatably coupled with respective offset portions 192, 196 to allow relative movement about the respective rotation axis B. As the handles 334 articulate back and forth about the handle axis D, the first end of each respective reciprocating member 340 operably associated with the connection portion 338 of each respective handle 334 moves, such as through an arc where the connection portion 338 is defined on a lever member, which in turn articulates the upper reciprocating members 340. The movement of the first end of each upper reciprocating member 340 applies a moving force to the respective rotation axis B formed at the engagement between the second end of the reciprocating member 340 and the offset portion 192, 196. As each offset portion 192, 196 is fixedly connected to and rotatable with the crank shaft 182 about the crank axis A, each rotation axis B and offset portion 192, 196 also rotate about axis A. Because a rotational force is applied to the crank shaft 182 through one or both of the rotation axes B, and the rotational axes B are offset from the crank axis A (e.g. eccentric to the crank axis), the first linkage may be considered an eccentric linkage. Thus, as each of the upper reciprocating members 340 articulate back and forth, each biases the respective eccentric rotation axis B to at least partially rotate about, and at least partially orbit, the crank axis A. This relative motion applies a moment to the crank shaft 182 to rotate about the crank axis A.

Each offset portion 192, 196 and the adjacent crank arm 328 extend from different sections of the drive mechanism 180 and form an angle lambda λ with its vertex located on the crank shaft 182. This angle λ is similar to or the same as the angle lambda described with respect to the earlier embodiments related to FIGS. 7-10, and may range between 0 and 360 degrees, and may also be more preferably between approximately 60 and approximately 90 degrees, and in one example may preferably be 75 degrees. The structural difference in this further embodiment is that a discrete link between the rotation axis B and the crank axis A as compared to the disk 42 and outer collar 41 assembly used in the earlier embodiments.

In this further embodiment, with continuing reference to FIGS. 19-21, and in the same or similar manner described with respect to the other embodiments described herein, the lower moment-producing mechanism 392 may include a first lower linkage and a second lower linkage corresponding to a left and right side of machine 310. The first and second lower linkages may include one or more of first and second rollers 330, first and second lower reciprocating members 326 (also referred to as "foot members"), first and second pedals 332 coupled to the first and second reciprocating foot members 26, and/or first and second crank arms 328, respectively. The first and second lower linkages may operably transmit a force input from the user into a moment about the crank shaft 182. The first and second crank arms 328 are each coupled at a first end portion, such as by being fixedly attached, to first and second connection members 186, 190, respectively, of the drive mechanism 180. Each of the first and second crank arms 328 rotate about the rotation axis of the respective connection member 186, 190 to which it is attached. The crank arms 28 may extend in opposite radial directions from the drive mechanism 180. Movement of either or both of the crank arms 328 causes rotation of the drive mechanism 180, with the crank arms 328 and drive mechanism 180 rotating about the crank axis A. Each of the first and second crank arms 328 is operatively associated with respective reciprocating foot members 326 such that at least a portion of each of the first and second reciprocating foot members 326 orbits the crank axis A as the drive mechanism 180 rotates. In one example the second end portions of each crank arm 328 are pivotally attached at a first end portion of each reciprocating foot member 326 and each define a foot member pivot axis, such axis being the same or similar to axis E described elsewhere herein.

Figure 22:
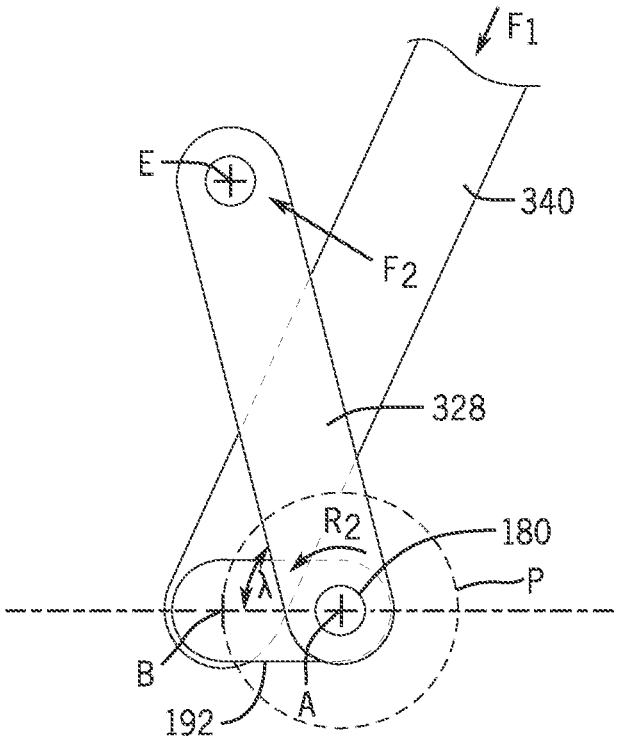
FIGS. 22 and 23 are simplified views of the machine of FIG. 20 highlighting the input linkages of the example exercise machine.
Figure 23:
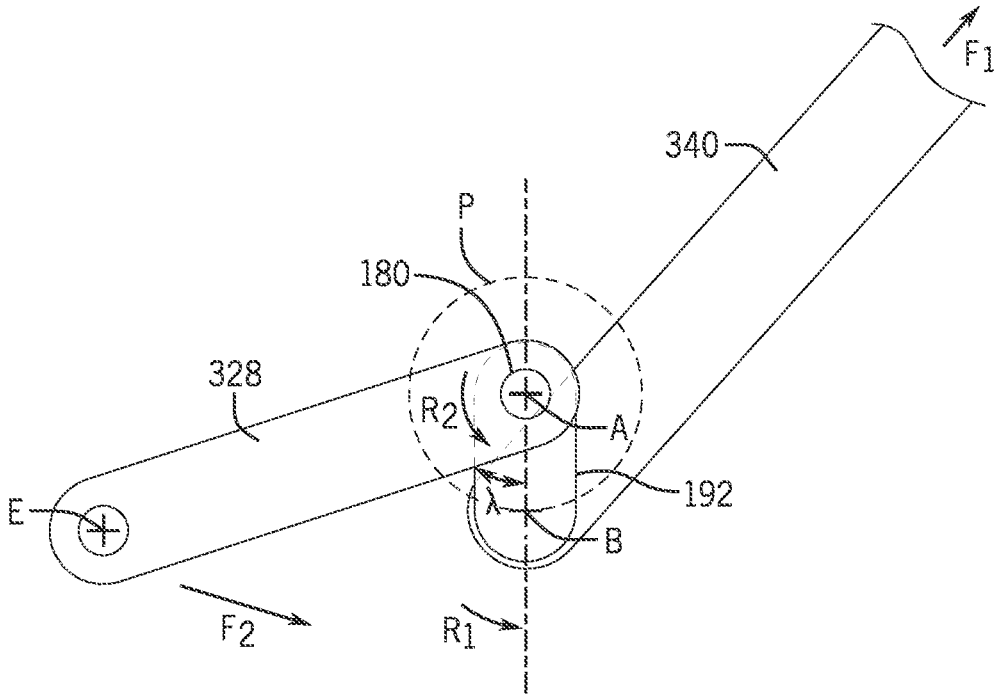

In accordance with various embodiments, and with reference to FIGS. 22 and 23, the first linkage may be an eccentric linkage. As illustrated in FIG. 22, the upper reciprocating member 340 drives the offset portion 192. With the offset portion 192 rotating around the crank axis A, which is a fixed pivot, the rotational axis (offset axis B) formed on the, for example, third connection member 194 travels around (e.g. orbits) crank axis A in a circular path as the crank shaft 182 rotates. The distance between crank axis A and rotational axis (offset axis B) is operable as the rotating arm of the linkage. As shown in the diagram illustrated in FIG. 22, a force F1 is applied to the upper reciprocating member 340. For example, the force F1 may be in the direction shown or opposite the direction shown. If in the direction shown by F1, the upper reciprocating member 340 and the offset member 192 place a load or torque on crank shaft 182, which is rotatable around axis A. As the force F1 is sufficient to overcome the resistance against rotation in crank shaft 182, the offset portion 192 begins to rotate in direction R1 and the drive mechanism 180 begins to rotate in direction R2. With F1 in the opposite direction, R1 and R2 would likewise be in the opposite direction. As illustrated by FIG. 23, as the cycle continues for the eccentric linkage, the force F1 must change directions in order to continue driving rotation in the direction R1, R2 of the offset portion 192 and the crank shaft 182, respectively. As is described elsewhere herein, the angle λ between the crank shaft 182 and the link formed by the offset member 192 remains constant.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element.

As used herein, the term "and/or" used between the last two of a list of elements means any one or more of the listed elements. For example, the phrase "A, B, and/or C" means "A," "B," "C," "A and B," "A and C," "B and C" or "A, B and C."

All relative and directional references (including: upper, lower, upward, downward, left, right, leftward, rightward, top, bottom, side, above, below, front, middle, back, vertical, horizontal, height, depth, width, and so forth) are given by way of example to aid the reader's understanding of the particular embodiments described herein. They should not be read to be requirements or limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Unless otherwise indicated, all numbers expressing properties, sizes, percentages, measurements, distances, ratios, and so forth, as used in the specification or claims are to be understood as being modified by the term "about." Accordingly, unless otherwise indicated, implicitly or explicitly, the numerical parameters set forth are approximations that may depend on the desired properties sought and/or limits of detection under standard test conditions/methods. When directly and explicitly distinguishing embodiments from discussed prior art, numbers are not approximations unless the word "about" is recited.

In view of the many possible embodiments to which the principles disclosed herein may be applied, it should be recognized that the illustrated embodiments are only examples and should not be taken as limiting the scope of the disclosure. Rather, the scope of the disclosure is at least as broad as the following exemplary claims.

The invention claimed is:

1. A stationary exercise machine comprising:

reciprocating members, wherein each reciprocating member includes a foot pedal positioned proximate an end portion of the reciprocating member to move in a respective substantially inclined foot pedal closed loop path as the reciprocating members reciprocate such that motion of the foot pedals simulates a climbing motion more than a flat walking or running motion;

reciprocating handles operatively associated with the reciprocating members to move in coordination such that reciprocating motion of the handles causes reciprocating motion of the reciprocating members, and vice versa;

a pair of crank arms, wherein each crank arm directly couples a respective one of the reciprocating members to a fixed crank axis; and a resistance assembly comprising a magnetism resistance based mechanism that resists movement of the reciprocating members and handles, and a rotating air-resistance based mechanism that provides increased resistance as a function of increased reciprocation frequency of the foot pedals.

2. The stationary exercise machine of claim 1, further comprising a plurality of inclined rails, wherein each reciprocating member includes a wheel positioned on the reciprocating member proximate the foot pedal supported by the reciprocating member, and each wheel moves along at least one of the plurality of inclined rails.

3. The stationary exercise machine of claim 1, further comprising a crank shaft operatively associated with the reciprocating handles and members, the crank shaft rotatable about the fixed crank axis, the crank arms comprising respective ends fixed to the crank shaft at the fixed crank axis.

4. The stationary exercise machine of claim 1, wherein a resistance of the magnetism resistance based mechanism is adjustable while the user is using the exercise machine.

5. The stationary exercise machine of claim 1, wherein each foot pedal closed loop path defines a major axis extending between two points in the foot pedal closed loop path that are furthest apart from each other, and the major axis of each foot pedal closed loop path is inclined more than 45° relative to a horizontal plane.

6. The stationary exercise machine of claim 1, wherein the magnetism resistance based mechanism comprises an adjustable portion that changes a magnitude of the resistance provided at a given reciprocation frequency of the foot pedals, the adjustable portion being adjustable by a user of the machine while the user is driving the foot pedals with the user's feet during exercise.

7. The stationary exercise machine of claim 6, wherein the adjustable portion is adjustable between two predetermined resistance settings.

8. The stationary exercise machine of claim 1, wherein:

rotation of the rotating air-resistance based mechanism draws air into a lateral air inlet and expels the drawn in air through radial air outlets; and the rotating air-resistance based mechanism comprises an adjustable air flow regulator that can be adjusted to change the volume of air flow through the air inlet or air outlet at a given rotational velocity of the rotating air-resistance based mechanism.

9. The stationary exercise machine of claim 1, wherein the magnetism resistance based mechanism comprises a rotor and a brake caliper, the brake caliper comprising magnets that induce eddy currents in the rotor as the rotor rotates between the magnets.

10. The stationary exercise machine of claim 9, wherein the brake caliper is adjustable to move the magnets to different radial distances relative to an axis of rotation of the rotor, such that increasing the radial distance of the magnets from the axis increases the amount of resistance the magnets apply to the rotation of the rotor, and decreasing the radial distance of the magnets from the axis of rotation decreases the amount of resistance the magnets apply to the rotor.

11. The stationary exercise machine of claim 10, wherein the brake caliper is configured to be controlled by an input received from a user remote from the magnetic resistance mechanism.

12. The stationary exercise machine of claim 11, wherein an adjustment of the brake caliper is enacted within a half second of receiving the input.

13. The stationary exercise machine of claim 10, further comprising a motor coupled to the brake caliper and configured to move the magnets to the different radial distances.

14. The stationary exercise machine of claim 10, wherein:

as the magnets are adjusted radially inwardly, a velocity of a portion of the rotor passing between the magnets decreases thereby decreasing the amount of resistance the magnets apply to the rotor; and as the magnets are adjusted radially outwardly, the velocity of the portion of the rotor passing between the magnets increases thereby increasing the amount of resistance the magnets apply to the rotor.

15. The stationary exercise machine of claim 1, further comprising:

a frame, wherein the reciprocating members are coupled to the frame; and a crank shaft fixed to the pair of crank arms and rotatably mounted to the frame to rotate about a crank axis, such that motion of the reciprocating members causes rotation of the crank shaft around the crank axis, via the pair of crank arms.

16. The stationary exercise machine of claim 15, further comprising:

a handle pivotably coupled to the frame to pivot about a first axis in response to be driven by a user's hand, the first axis being substantially parallel to and spaced apart from the crank axis at a fixed distance;

a first link member fixed relative to the handle and pivotable about the first axis and including a radial end that is distal from the first axis;

a second link member including a first end pivotally coupled to the radial end of the first link member and a second end, wherein the second link member pivots about a second axis that is substantially parallel to the crank axis; and a third link member that is rotatably coupled to the second end of the second linkage, wherein the third link member rotates about the crank axis and the second axis rotates around the crank axis.

17. The stationary exercise machine of claim 1, wherein the magnetism resistance based mechanism comprises a rotor and a brake caliper, the brake caliper comprising magnets that induce eddy currents in the rotor as the rotor rotates between the magnets, wherein the brake caliper is adjustable to move the magnets to different radial distances away from an axis of rotation of the rotor such that increasing the radial distance of the magnets from the axis increases the amount of resistance the magnets apply to the rotation of the rotor.

18. The stationary exercise machine of claim 1, wherein each of the reciprocating members comprises an intermediate portion that is constrained to move along a non-linear path defined by a non-linear portion of an inclined member of the frame.

19. The stationary exercise machine of claim 1, further comprising a frame that supports the reciprocating members, wherein the frame includes an upper support structure, and wherein the rotating air-resistance based mechanism is coupled to one side of the upper support structure and the magnetism resistance based mechanism is coupled to an opposite side of the upper support structure.

20. A stationary exercise machine comprising:

reciprocating members, wherein each reciprocating member includes a foot pedal positioned proximate an end portion of the reciprocating member to move in a respective substantially inclined foot pedal closed loop path as the reciprocating members reciprocate such that motion of the foot pedals simulates a climbing motion more than a flat walking or running motion;

reciprocating handles operatively associated with the reciprocating members to move in coordination such that reciprocating motion of the handles causes reciprocating motion of the reciprocating members, and vice versa;

a pair of crank arms, wherein each crank arm directly couples a respective one of the reciprocating members to a fixed crank axis;

a resistance assembly comprising a magnetism resistance based mechanism and a rotating air-resistance based mechanism; and a frame that supports the reciprocating members, wherein the frame includes an upper support structure, and wherein the rotating air-resistance based mechanism is coupled to one side of the upper support structure and the magnetism resistance based mechanism is coupled to an opposite side of the upper support structure.

* * * * *